US006062670A

United States Patent [19]

Iwata et al.

[11] Patent Number: 6,062,670

[45] **Date of Patent: *May 16, 2000**

[54] INK JET RECORDING APPARATUS HAVING DISCHARGE RECOVERY MEANS

[75] Inventors: Kazuya Iwata, Yokohama; Osamu Asakura, Sagamihara; Masasumi Nagashima, Yokohama; Yoshiyuki Shimamura, Yokohama; Kenji Kawazoe, Yokohama; Seiji Takahashi, Yokohama; Yuji Kanome, Kawasaki; Tetsuya Ishikawa; Takahiro Ohde, both of Yokohama, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/261,099

[22] Filed: Jun. 16, 1994

[30] Foreign Application Priority Data

Jun. 21, 1993 [JP] Japan ..... 5-149164

[51] Int. Cl.[7] ..... B41J 2/165

[52] U.S. Cl. ..... 347/23; 347/29; 347/30; 347/31

[58] Field of Search ..... 347/29, 30, 31, 347/23

[56] References Cited

U.S. PATENT DOCUMENTS

| | | | |
|---|---|---|---|
| 4,313,124 | 1/1982 | Hara | 347/57 |
| 4,345,262 | 8/1982 | Shirato et al. | 347/10 |
| 4,432,004 | 2/1984 | Glatti | 346/140 R |
| 4,459,600 | 7/1984 | Sato et al. | 347/47 |
| 4,463,359 | 7/1984 | Ayata et al. | 347/56 |
| 4,543,591 | 9/1985 | Terasawa | 346/140 R |
| 4,558,333 | 12/1985 | Sugitani et al. | 347/65 |
| 4,608,577 | 8/1986 | Hori | 347/66 |
| 4,723,129 | 2/1988 | Endo et al. | 347/56 |
| 4,740,796 | 4/1988 | Endo et al. | 347/56 |
| 4,967,204 | 10/1990 | Terasawa et al. | 347/23 |
| 4,970,533 | 11/1990 | Saito et al. | 346/140 R |
| 4,970,534 | 11/1990 | Terasawa et al. | 346/140 R |
| 5,138,344 | 8/1992 | Ujita | 347/86 |
| 5,164,748 | 11/1992 | Katayanagi et al. | 347/30 |
| 5,182,582 | 1/1993 | Okamura | 347/33 |
| 5,184,147 | 2/1993 | MacLane et al. | 346/1.1 |
| 5,214,447 | 5/1993 | Iwata | 347/30 |
| 5,245,362 | 9/1993 | Iwata et al. | 347/23 |

FOREIGN PATENT DOCUMENTS

| | | |
|---|---|---|
| 2085550 | 6/1993 | Canada . |
| 0291099 | 11/1988 | European Pat. Off. . |
| 0375407 | 6/1990 | European Pat. Off. . |
| 0435696 | 7/1991 | European Pat. Off. . |
| 0442713 | 8/1991 | European Pat. Off. . |
| 0465260 | 1/1992 | European Pat. Off. . |
| 0476679 | 3/1992 | European Pat. Off. . |
| 0494693 | 7/1992 | European Pat. Off. . |
| 0551752 | 7/1993 | European Pat. Off. . |
| 54-056847 | 5/1979 | Japan . |

(List continued on next page.)

*Primary Examiner*—John Barlow
*Assistant Examiner*—Charles W. Stewart, Jr.
*Attorney, Agent, or Firm*—Fitzpatrick, Cella, Harper & Scinto

[57] ABSTRACT

The present invention relates to a discharge recovery processing of an ink jet recording apparatus which forms an image on the recording medium by discharging the ink. The invention aims to prevent the increase in the running costs and the shortened life of a waste ink tank by preventing the wasteful ink consumption which may be caused by the dual use of an automatic recovery processing and a manual recovery processing after the replacement of an ink tank.

Also, the invention further aims to provide an ink jet recording apparatus with high safety and reliability as well as effecting an appropriate recovery by controlling the movement of head in involving the recovery.

8 Claims, 46 Drawing Sheets

FOREIGN PATENT DOCUMENTS

| | | |
|---|---|---|
| 58-008666 | 1/1983 | Japan . |
| 59-123670 | 7/1984 | Japan . |
| 59-138461 | 8/1984 | Japan . |
| 60-071260 | 4/1985 | Japan . |
| 60-189454 | 9/1985 | Japan . |
| 63-242671 | 10/1988 | Japan . |
| 2072962 | 3/1990 | Japan . |
| 3022113 | 1/1991 | Japan . |
| 4099680 | 3/1992 | Japan . |
| 2211330 | 6/1989 | United Kingdom . |

| FIG. 22A |
| --- |
| FIG. 22B |

S92
END OPERATION
S76
OPEN CAP
S75
RECORDING SIGNAL ?
YES
NO
S74
END SIGNAL ?
YES
NO
(c)
CAPPING 30sec
WITH NO SIGNAL
CLOSE CAP 51
73
S72
WIPING
S70
IDLE SUCTION BEFORE
CAPPING (d)
INDEPENDENT
IDLE SUCTION
N1 RESET & START
S71
S66
T2 RESET & START
S67
RECORDING SIGNAL ?
YES
NO
S68
T2 > 30sec ?
YES
NO
S69
END SIGNAL ?
YES
NO
1
2
3
4

| FIG. 37A |
| --- |
| FIG. 37B |

CARRIAGE HOME POSITION COMPENSATION TABLE

| TEMPERATURE (℃ ) | COMPENSATION VALUE f (STEP) |
|---|---|
| BELOW 7 | + 1 |
| 8 ~ 48 | 0 |
| OVER 49 | - 1 |

INK JET RECORDING APPARATUS HAVING DISCHARGE RECOVERY MEANS

BACKGROUND OF THE INVENTION

1. Field of the Invention

The present invention relates to an ink jet recording apparatus which forms an image on the recording medium by discharging the ink.

2. Related Background Art

Conventionally, various recording methods have been put to practical use for the image forming apparatus (so-called a recording apparatus or a printer) for forming an image on the recording medium such as a paper and OHP recording sheet.

The recording methods include a wire dot method which is an impact recording method, a thermal transfer method using an ink ribbon of transferring the ink fused by heating, a thermal recording method using a thermosensitive recording paper which is colored upon the reaction with the heating of a recording head, and an ink jet recording method of forming an image on the recording medium by discharging the ink.

Among a variety of kinds of recording methods, attention is particularly paid to the ink jet recording method as a silent method with low running costs because of discharging the ink directly onto the recording medium.

In the ink jet recording apparatuses with such an ink jet recording method, the type of using a disposable recording head is typically utilized in practice in which the recording head for discharging the ink and an ink reservoir (ink tank) for reserving the ink are integrated and mounted exchangeably on the recording apparatus. Also, an ink jet recording apparatus of the type in which only an ink reservoir apart from a recording head is exchanged with the recording head as permanent or longer life type has been put to practical use because of its inexpensive costs for the recording head.

In the above ink jet recording apparatuses, capping means for protecting the ink from drying by covering the ink discharge ports (nozzles) of the recording head is provided or a discharge recovery processing of discharging the ink through the nozzles to remove the ink having the increased viscosity or the ink containing the dust or dirt therein is typically practiced, in order to maintain the ink discharge condition of the recording head excellent and normal.

Exemplary of the above capping means is a cap formed of an elastic material such as rubber which is placed opposite to the nozzle formation face of the recording head, which cap is able to be brought into or out of contact with the nozzle formation face at a position for capping, thereby preventing the drying of the ink in or near the nozzles by capping, when the discharging of the ink is not performed beyond a predetermined time in other than the recording operation or even during the recording operation.

Further, exemplary of the above discharge recovery processing is a processing (preliminary discharge) of discharging the ink through all the discharge ports by driving the energy generating elements for use in discharging the ink, which are provided within the nozzles of the recording head, thereby removing air bubbles or the dust and dirt or the viscosity-increased ink unsuitable for the recording, as the discharge failure factors, by providing a cap which can be brought into or out of contact with the nozzle formation face of the recording head, with said cap opposed to the nozzle formation face of the recording head, or otherwise a processing (suction recovery processing) of compulsorily discharging the ink through all the discharge ports using a suction pump, with the discharge formation face covered with the cap, thereby removing the ink as the discharge failure factors.

Where the recording head and the ink tank integrated is exchangeably mounted on the recording apparatus or where the ink tank is exchangeably mounted, there often occur such instances where a newly mounted recording head may be in unexcellent recording condition. This may be caused by the vibrations during the transport or the penetration of air bubbles in the nozzles of the recording head or the ink supply passage into the nozzles, which may disrupt the ink supply so that the ink is not properly filled in the nozzles or the ink flow passages. Also, in the constitution where the replaceable ink tank is used, the excellent recording condition in mounting a new ink tank may not be attained, because the air may enter into a fitting portion between the ink tank and the ink supply passage into the nozzles. If the recording operation is performed while the ink is improperly filled, the energy generating elements for use in discharging the ink will generate the discharge energy, without ink, so that the energy generating elements may be broken. Also, in the ink jet systems of the type of discharging the ink by the use of a pressure caused by the state change due to the heat of the ink, using the heat energy as the discharge energy, the heat energy generating elements may generate heat without ink, often resulting in the breakage of the heat energy generating elements. In order to avoid such failures, the mechanisms have been recently developed in which, for example, the operator of the recording apparatus is prompted to perform the discharge recovery operation upon replacing the recording head, or the replacement of the recording head is automatically sensed to thereby carry out the discharge recovery processing prior to the recording operation.

Also, the capping means is often provided with a suction pump for effecting the discharge recovery processing, in which the discharge recovery processing is performed by activating the suction pump to discharge the ink, with the nozzle formation face covered with a cap. Further, of the discharge recovery processing, the art of effecting preliminary discharge toward the cap and receiving the waste ink discharged with the preliminary discharge within the cap is commonly practiced, owing to the reasons that there is no necessity of waste ink receiving member and the waste ink received is easily processed.

Where there remains the ink discharged by the above processing within the cap, the ink unsuitable for the recording may make contact with the nozzles of the recording head, bringing about some nonconformity in the subsequent recording operations, when the suction pump is activated for the capping operation or the discharge recovery processing. Further, when the cap is disposed vertically, there may occur such a nonconformity that the ink contaminates the recording apparatus or the recording sheet, because the ink within the cap drips. For the prevention of such nonconformities, to receive the ink within the cap into the ink receiving member (waste ink tank), it is the common practice to receive the ink within the cap into the waste ink tank in such a way as to operate the suction pump with the cap out of the recording head after the discharging of the ink from the recording head by means of the suction pump, or to calculate the predetermined number of preliminary discharges to be receivable within the cap from the amount of discharging the ink by one preliminary discharge and the amount of ink receivable within the cap, and upon the predetermined number of preliminary discharges being reached, to activate the suction pump with the cap out of the recording head.

FIG. 39 shows the constitution of a blade cleaner attached on a conventional carriage, as the blade cleaner for cleaning a wiper (wiper blade) in such a way as to wipe the discharge port face of the recording head.

49 is a blade cleaner unit, which is positioned with the embossed shape and secured to the carriage 11 by the snap-in action of a claw.

FIG. 30 is a chart representing the detailed configuration of the conventional blade cleaner unit 49.

49*a* is a blade cleaner, which is an absorbing member having high absorbing ability and less deformation, e.g., less swelling, after the absorption of the ink, wherein the ink adhering to the blade can be absorbed by this cleaner making contact with the blade. Specifically, Rubycerclean (Toyo Polymer Co., Ltd.), for example, can be used. 49*b* is a wiper cleaner holder for holding the wiper cleaner 49*a*. The wiper cleaner 49*a* is positioned by a boss portion provided in the wiper cleaner holder 49*b*, and screwed therein carried with a presser plate 49*c*. The presser plate 49*c* is of a shape to promote the drying of the wiper cleaner 49*a*, and to provide a number of opening portions to receive the ink splashed toward the wiper cleaner 49*a*, after a blade 59 wipes the face plane as shown in FIG. 42.

FIG. 41 shows the constitution of a conventional waste ink tank 55 having a breathable film.

A breathable film 55*c* is attached to the opening portion of the waste ink tank made of polypropylene. The breathable film 55*c* can pass therethrough the ink solvent vapor, but not the ink of liquid, and specifically, Vaporload (made by Teijin Limited), for example, is used.

A presser plate 55*f* is prepared for welding the breathable film, with the breathable film 55*c* carried therebetween.

FIG. 42 is a perspective view showing the appearance of a conventional recording apparatus.

As will be seen from this figure, conventionally, the waste ink tank 55 was disposed under a paper pan 37 adjacent to a head recovery unit containing a cap 51 and a pump 53. Also, with the conventional arrangement, not shown, it was requisite to arrange electrical components, owing to the space requirements, in the portion of an equipment containing a recording apparatus such as a word processor which is located under the head recovery unit and the waste ink tank, as well as its neighborhood.

FIG. 43 is a detailed exploded perspective view of a conventional waste ink seal 521 in part thereof.

The waste ink seal 521 which is a rubber member is a seal member for joining a pump shaft 519 which is the ink flow passage end portion of the pump 53 with an ink flow passage (not shown) extending in a vertical direction to an ink flow passage within the pump shaft 519. The pump shaft 519 is supported by a support plate 520, and rotated or swung in the directions as indicated by the arrow b around an axis a in the figure. A cylindrical bore fitted tightly around the pump shaft 519 is provided in the waste ink seal 521. Also, the outer shape of the waste ink seal 521 is substantially cylindrical and in coaxial with the above cylindrical bore. A waste ink cap 523 is provided with a bore which is of a shape identical to, and somewhat smaller in size than, the outer shape of the waste ink seal 521, within which the waste ink seal 521 is fitted.

Also, the printers of the ink jet system have conventionally a mechanism (cap means) for protecting the nozzles, when not printing, to prevent the clogging of the ink discharge nozzles due to the drying. And the on position of a carriage home sensor for detecting the position of a carriage having a head cartridge mounted therein, and the capping position at which the nozzle protection mechanism is activated, are mechanically set in predetermined dimensions, and assembled. Thus, the number of driving steps (constant value) of the carriage motor corresponding to the dimensions is prewritten into the ROM, and the capping position (i.e., carriage home position) is determined by driving a predetermined step number stored in the ROM from the on position of the carriage home sensor, irrespective of the conditions such as printer temperature, when the capping is made.

Also, when stopped at the carriage home position, the carriage is stopped in a stable phase (i.e., a phase where it is stably stopped when not excited) closest to the excitation phase of carriage motor at the carriage home position calculated from the on position of the carriage home sensor and the step number written in the ROM. And when the carriage is redriven, the driving is started from the excitation phase calculated previously.

However, in the above conventional example, the following problems were encountered.

At first, in carrying out the discharge recovery processing upon replacing the recording head or the ink tank, the demand for the operator of the recording apparatus to perform that processing is troublesome to the operation, and it is difficult to know whether the discharge recovery processing is securely performed by the operator.

In the constitution wherein the replacement of the recording head or ink tank is automatically sensed to effect the discharge recovery processing prior to the recording operation, there is a problem that when the discharge recovery processing, based on an instruction from the operator of the recording apparatus immediately after the replacement of the recording head or ink tank, is performed, a further discharge recovery processing based on sensing the replacement will be performed, resulting in the wasteful ink discharge from the recording head. The wasteful ink discharge led to the problem that in addition to increased time taken for series of recording operations including the discharge recovery processing, the reduced amount of ink for recording will raise the cost required for the recording or the running cost, and further shorten the life of the waste ink tank for receiving the discharged ink, as well as the life of the recording apparatus. The discharge recovery processing required to attain the excellent recording condition after the replacement of the recording head or ink tank is necessary to have a greater effect than when not in replacement, for which it is the common practice to repeat the discharge recovery processing in series multiple times. In such a case, if the discharge recovery processing is performed by the operator, the wasteful ink discharge amount will be possibly further increased as compared with the case where one automatic discharge recovery processing is performed.

On the other hand, in receiving the ink within the cap into the waste ink tank, there is a problem that where the ink within the cap is received after discharging the ink with suction, the unsuitable ink may be touched with the nozzles or their neighborhood, because of the preliminary discharge to be performed until the subsequent capping operation, or the movement of the ink within the cap over time.

In a conventional blade cleaner unit 49 as shown in FIG. 39, to attach it to the carriage 11 requires a presser plate 49*c* and two screws, in addition to a blade cleaner holder 49*b*, which was inconvenient because of too many parts. Also, the blade cleaner unit 49 is secured only by the snap-in action to the carriage 11, with more or less looseness contained, and particularly there is a great dispersion in the top position of blade cleaner on the blade side, which was inconvenient due to its effect on the cleaning performance. Further, Rubycer-clean (Toyo Polymer Co.,Ltd.) which is useful for the wiper blade is a special and expensive material, in which if there is a great supposed number of sheets to be printed for the recording apparatus, it is necessary to provide a large volume of the wiper blade, inconveniently resulting in the higher costs.

Also, in a conventional waste ink tank, Vaporload used for the breathable film is one in which a waterproof, moisture permeable layer is coated thin over the back face of a cloth made of polyester, in which the breathable film 55*c*, when welded over an opening portion provided on the waste ink tank 55, is liable to wrinkles, and can not be welded singly. Hence, it is necessary to prepare other member,,and weld it with the other member sandwiched therebetween, for which a presser plate 55*f* is required, inconveniently resulting in too many parts.

Further, conventionally, the electrical component was disposed beneath the head recovery unit and the waste ink tank, as previously described. Therefore, if an abnormal condition, for example, "a tube 57 for feeding the waste ink to the waste ink tank is disconnected", occurred, there was a risk that the ink sucked from the head may drip to the lower electrical component. Hence, there is the necessity of providing a cover to keep the electrical component away from the ink, a part serving as the "trough" for feeding the ink to the site off the electrical component or a member for absorbing the ink, resulting in the higher costs of the apparatus itself, which was inconvenient.

The conventional waste ink seal is provided with a hole 521*c* for ink flow passage on the curved surface of cylindrical outer shape, and is difficult to raise the finish level of the face of a mold for molding the waste ink seal and opposed to the seal surface, which was inconvenient.

In the mold for molding the seal surface on the side of waste ink cap, it is necessary to divide the mold to mold the ink flow passage. However, since the seal surface is curved, it is difficult to modify the mold and make a smooth curved face to reduce the, step of the seal surface produced by dividing the mold, which was inconvenient.

In an ink jet printer having the nozzle protection mechanism as previously described, the capping position may be shifted due to the dimensional variations caused by the printer temperature variations for the components of the recovery unit such as a nozzle protection mechanism, a printer chassis to which the recovery unit and a carriage home sensor are secured, a sensor light shielding plate for a carriage home sensor formed integrally with the carriage, or the sensitivity variations of the carriage home sensor caused by the printer temperature variations, resulting in inaccurate capping, in some cases causing a problem of clogging the nozzles.

When the excitation phase of the carriage motor at the carriage home position calculated and the actual stop phase are different, the driving amount at the first excitation upon redriving the carriage is one step or more, whereby there is a problem that if this step is greater, the impact noise may be produced in redriving.

In the recording apparatuses with a variety of recording methods, including the ink jet printer, at the power-on and the reset, an initial state setting signal (hereinafter referred to as an initial signal) is sent from the host computer or host processor, (hereinafter referred to as a host) and received by the recording apparatus, whereupon the initial setting (hereinafter referred to as an initial operation) is effected. One of the initial operations is an initial operation of the motor associated with the recording apparatus.

FIG. 44 shows a time chart regarding the initial operation of the motor. Note that for the explanation, the motor is a four phase pulse motor of the unipolar system wherein one directional current is only flowed through the coil, and the control system is an I-phase excitation wherein the current always in only one phase is flowed, wherein the motor is rotated only in a fixed direction at the initial operation. Also, the excitation (hereinafter referred to as conduction) initiation phase at the initial operation of the motor is necessarily initiated from the same phase (A phase in the figure), wherein the operation referred to as a hold as described blow is included at the first excitation.

Generally, in driving the motor, the motor which is normally in the non-excitation state (state a-0) is subjected to excitation to gradually increase the speed or a so-called acceleration (state a-2), until a predetermined speed is reached, and thereafter driven at a constant rate (state a-3). However, the motor may be rotated apart from the actual control operation, for example, so as to enable the carrier to be moved by the user or other external means. In this case, the rotor stop position of the motor is not fixed, and even if the recording is actually started, with the motor excited, a so-called step-out in which the rotor can not follow the excitation may occur, when the excitation phase and the phase where the rotor is actually stopped are matched. Accordingly, normally, the first excitation time is lengthened, and after the rotor is matched with the excitation phase, the excitation phase is switched so that the motor is controlled to be driven for rotation. This lengthening of the first excitation time is called a hold and its time called a hold time.

As shown in FIG. 44, after the recording apparatus receives an initial signal, the motor is subjected to the hold operation (state a-1), the acceleration (state a-2), the fixed speed driving (state a-3), thereafter the deceleration (state a-4), and the completion of the initial operation (state a-5), previously described. As shown in this figure, the initial conduction to each predetermined phase of the motor is referred to as a motor initial.

By the way, $\Delta t_1$ in the figure is a time from the start of initial operation for the recording apparatus to the start of actual motor initial, this time being smaller than the times $\Delta t_2$ and $\Delta t_3$ for the states a-1 and a-3. Hereinafter, $\Delta t_1$=5 $\mu$s, $\Delta t_2$=10 ms, and $\Delta t_3$=1ms are supposed for the explanation.

FIG. 45 shows a time chart representing the initial operation of the motor wherein the initial signal is sent consecutively every 9.005 ms, due to host malfunction, and is received by the recording apparatus. As shown in FIG. 45, the motor is repeatedly transferred to the state a-1, and excited at a ratio of 9000 to 5 in the A phase. That is, this state is substantially equivalent to the continuously excited state or so-called a motor lock state. If this state is continued, the internal temperature of the motor will rise, possibly leading to a fuming or firing. This is a phenomenon which is not limitative to the state a-1, but likewise can occur in the states of a-2to a-4, and which will occur even if the initial signal is not necessarily received at an equal interval.

SUMMARY OF THE INVENTION

To accomplish the above object of the present invention, there is provided an ink jet recording apparatus for forming an image on the recording medium by discharging the ink through the discharge ports, comprising, recovery means for recovering the discharge performance of the ink by discharging the ink through said discharge ports, ink supply means detachably provided on said ink jet recording apparatus, sensing means for sensing the mounting of said ink supply means to said recording apparatus, manual recovery means for manually handling the discharge operation of the ink with said recovery means, and automatic recovery control means for controlling the discharging of the ink with said recovery means to be effected multiple times prior to the first recording operation after sensing said mounting, when the mounting of said ink supply means on to said recording apparatus is sensed, characterized in that if the discharging of the ink is performed by said manual recovery means after sensing the mounting of said ink supply means on to said recording apparatus and prior to the operation of said automatic recovery control means, the discharging of the ink with said automatic recovery control means is controlled to be reduced.

Also, the ink jet recording apparatus of the present invention further comprises cap means for covering said discharge ports, cap moving means for moving said cap means to a cap position for covering said discharge ports and a release position for releasing said discharge ports, and negative pressure generating means, connecting to said cap means, for applying a negative pressure to said cap means, characterized in so that prior to the operation of said negative pressure means for applying negative pressure to said cap means at the cap position where said cap means covers said discharge ports, said negative pressure means is controlled to apply a negative pressure to said cap means at the release position where said cap means releases said discharge ports Also, the ink jet recording apparatus of the present invention is further characterized in that prior to the movement to the cap position where cap means covers the discharge ports, the recovery operation is controlled to be effected by applying a negative pressure to said cap means at the release position where said cap means releases the discharge ports.

Also, the ink jet recording apparatus of the present invention comprises wiping means for wiping the discharge port face of said recording head, a carriage for mounting said recording head thereon, and cleaning means for cleaning said wiping means, said cleaning means attached to said carriage and being able to make direct contact with said wiping member, characterized in that said cleaning means has an absorbing member attached contiguously with said cleaning means.

Also, the ink jet recording apparatus of the present invention comprises recovery means for recovering the discharge performance of the ink by discharging the ink through said discharge ports, and ink receiving means for receiving the ink discharged from said recovery means, characterized in that said ink receiving means is provided with a moisture permeable portion in which a water proof, moisture permeable membrane and a net-like member are superposed outside.

Also, the present invention provides ink receiving means for receiving the ink discharged with the recovery operation in the ink jet recording apparatus, said ink receiving means provided with moisture permeable means where a water proof membrane and a net-like member are superposed outside.

Also, the ink jet recording apparatus of the present invention comprises a recording head for forming an image of the recording medium by discharging the ink through the discharge ports, recovery means for recovering the discharge performance of the ink by discharging the ink through said discharge ports, ink receiving means for receiving the ink discharged from said recovery means, said ink receiving means provided on the bottom of the apparatus, and a form surrounding the circumference around said ink receiving means, characterized in that an ink flow passage is provided through which the ink can naturally fall from said recovery means to a space of said ink receiving means.

Also, the ink jet recording apparatus of the present invention comprises a recording head for effecting the recording by discharging the ink onto the recording medium, a first fluid flow passage revolvable and having a cylindrical outer shape, said first flow passage being revolvable around the center of its cylindrical outer shape as a revolution axis, its passage end being released, and seal means for connecting to a second passage perpendicular to its revolution axis from said first passage end, characterized in that said seal means has a cylindrical bore shape containing said first fluid flow passage inside and a substantially cylindrical outer shape outside which is coaxial with said cylindrical bore shape, and a planar shape in a part of the outer shape on the side of said seal means connecting to said second passage.

Also, the ink jet recording apparatus of the present invention comprises temperature detecting means for detecting the ambient temperature of the ink jet recording apparatus, and altering means for altering the scan amount with said scanning means with reference to the position of the recording head, based on the temperature detected by said temperature detecting means, characterized in that said recording head is scanned to a position opposed to protecting means, based on the scan amount altered by said altering means, and the ink is discharged by recovery means, with said discharge ports protected by said protecting means.

Also, the ink jet recording apparatus of the present invention comprises a recording head for effecting the recording onto the recording medium, scanning means for scanning said recording head within a scan range including a home position of the recording head relative to the recording medium by driving a stepping motor, and storage means for storing the excitation phase of said stepping motor when said recording head is stopped at said home position, characterized in that when said recording head is scanned from said home position where it is stopped, the driving of said stepping motor is controlled to be started from the excitation phase stored in said storage means.

Also, the present invention provides a recording apparatus having an initial state setting signal from the host, and control means for effecting the initial conduction in a predetermined phase of a pulse motor in accordance with said signal, said control means preventing initial conduction from being repeatedly made within a predetermined interval even if the initial state setting signal is repeatedly input into the recording apparatus.

BRIEF DESCRIPTION OF THE PREFERRED EMBODIMENTS

The preferred embodiments of the present invention will be described in detail with reference to the drawings.

Figure 2:
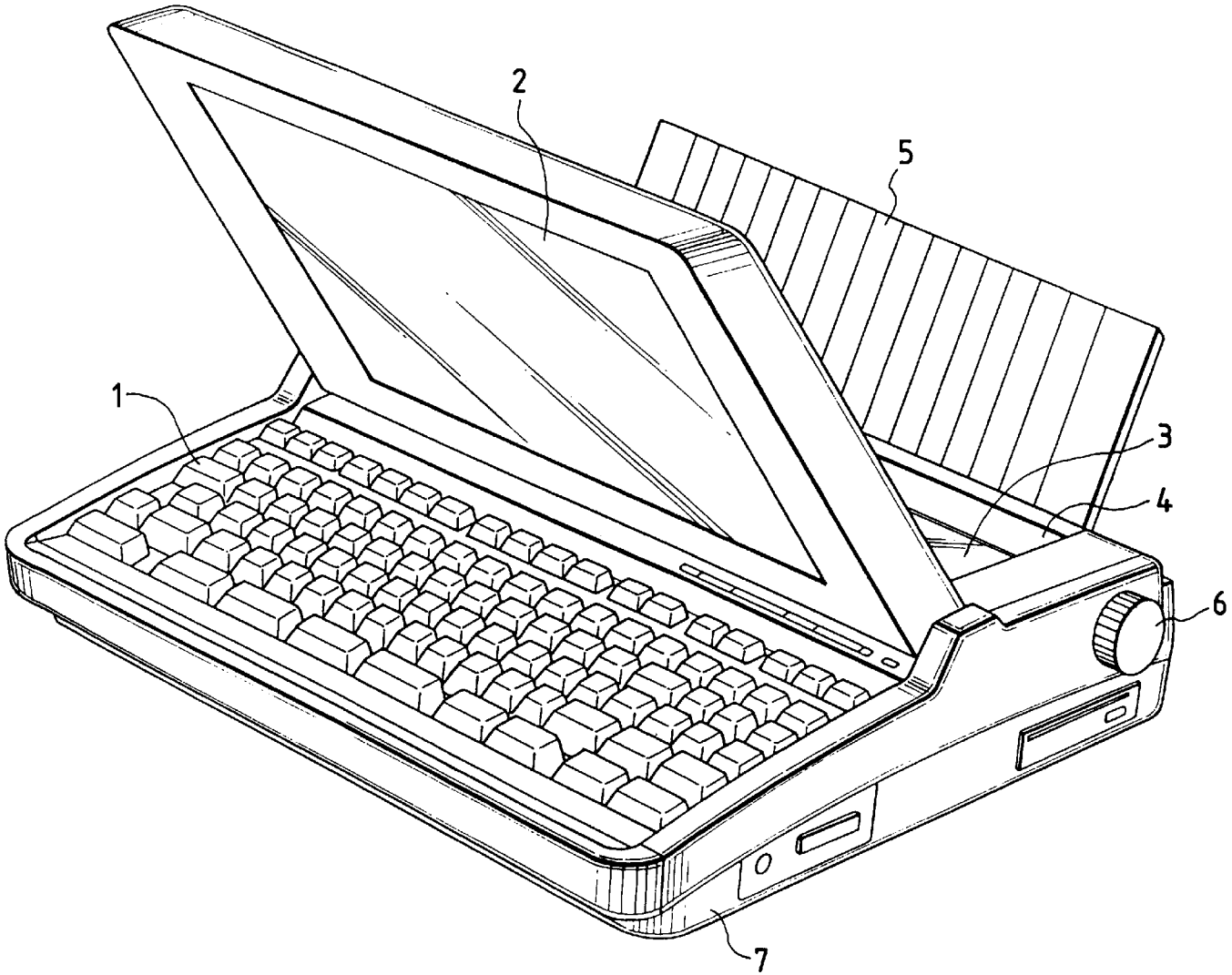
FIG. 2 is an external perspective view of a document creation equipment containing the recording apparatus according to one embodiment of the present invention.

FIG. 2 shows an external constitutional perspective view of a document creation apparatus (hereinafter referred to as a "word processor") as an apparatus example containing an ink jet recording apparatus of the present invention.

In FIG. 2, 1 is a keyboard which is input device. 2 is a display portion for displaying the input document, which is configured to be held rotatably around a horizontal axis on the keyboard 1, and folded to overlie the keyboard 1 when not in use. 3 is a protective cover being openable or closable provided on an opening for the replacement of this recording head. 4 is a spur cover for carrying a spur. 5 is a paper supporter for supporting the recording sheet in supplying or exhausting the recording sheet, and 6 is a knob for manually effecting the supply and exhaust of the recording sheet. Each unit as above mentioned is attached to an outer package component called a lower case.

Figure 1:
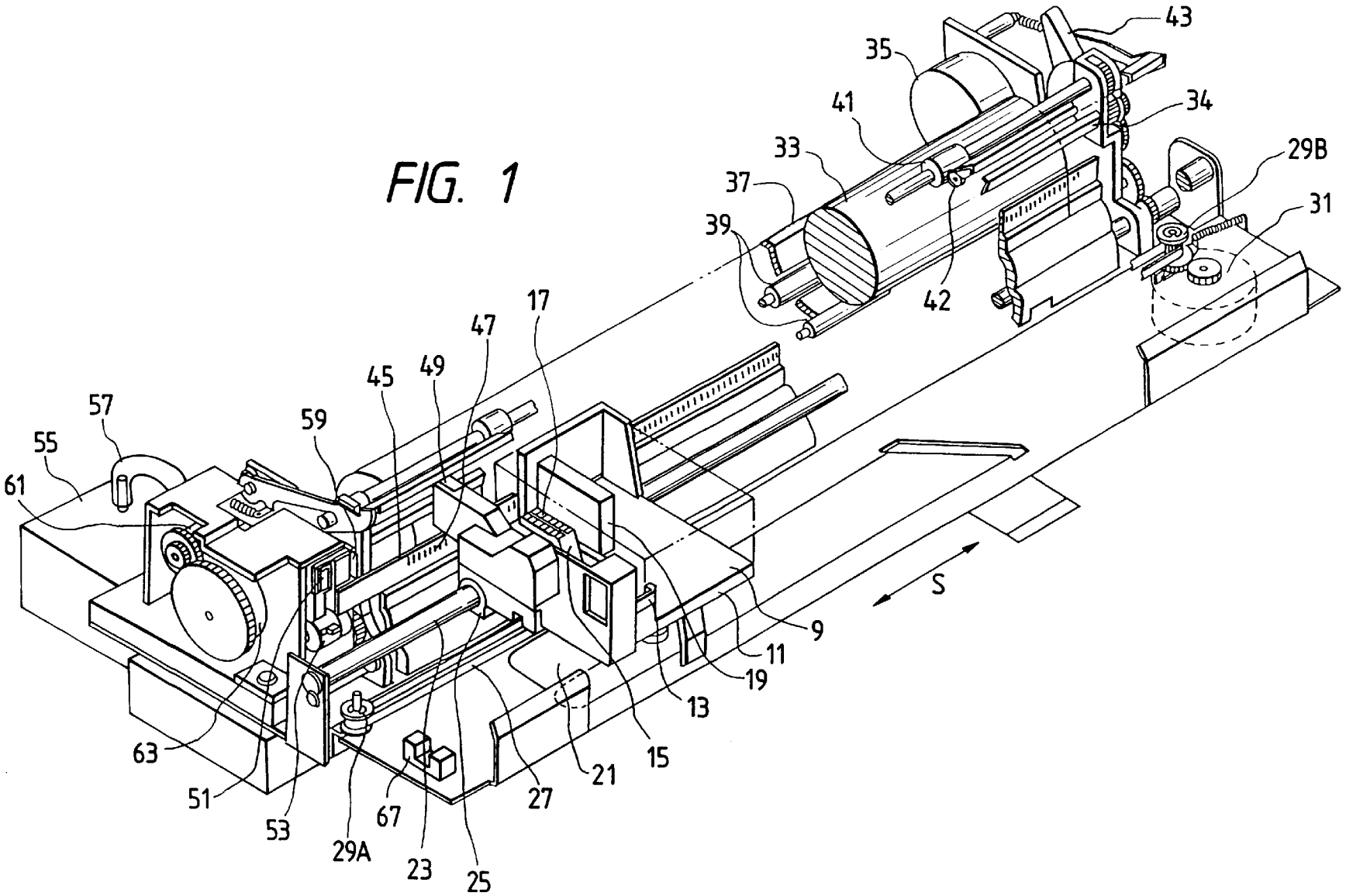
FIG. 1 is an external perspective view of a recording apparatus according to one embodiment of the present invention.

FIG. 1 shows a perspective view of the constitution of one embodiment of the ink jet recording apparatus (printer unit) of the present invention.

The ink jet recording apparatus as shown in FIG. 1 is a printer portion contained within the word processor of FIG. 2.

Herein, 9 is a head cartridge having an ink jet recording head, and 11 is a carriage having the head cartridge mounted for the movement in the directions indicated by the arrow S. 13 is a hook for attaching the head cartridge 9 on to the carriage 11, and 15 is an operation lever for manipulating the hook 13. This lever 15 is provided with a marker 17 which supports a memory provided on a cover as hereinafter described to allow for the reading of the recording position or set position with the recording head of the head cartridge. 19 is a support plate for indicating an electrical connection to the head cartridge 9. 21 is a flexible cable for the electrical connection to a control unit of a main device.

23 is a guide shaft for guiding the carriage 11 in the directions indicated by the arrow S, this guide shaft inserted through a bearing 25 of the carriage 11. 27 is a timing belt, to which the carriage 11 is secured, for transmitting the motive power to move the carriage 11 in the directions indicated by the arrow S, this timing belt extended around the pulleys 29A, 29B disposed on both sides of the apparatus. To one pulley 29B, a drive power is transmitted from a carriage motor 31 via a transmission mechanism such as a gear.

33 is a transport roller for transporting the recording medium in recording, as well as regulating the recording face of the recording medium such as paper, this transport roller being driven by a transport motor 35. 37 is a paper pan for guiding the recording sheet from a sheet supply tray to the recording position, and 39 is a feed roller for feeding the recording sheet while pressing the recording sheet against the transport roller 33, the feed roller disposed midway on the course of supplying the recording sheet. 34 is a platen for regulating the recording face of the recording medium while being opposed to the discharge ports of the head cartridge 9, and 41 is a sheet exhaust roller, disposed downstream of the recording position in the transport direction of the recording sheet, for exhausting the recording sheet into a sheet exhaust opening, not shown. 42 is a spur provided corresponding to the sheet exhaust roller 41, for pressing on the roller 41 via the recording sheet to produce a transport power for the recording sheet with the sheet exhaust roller 41. 43 is a release lever for releasing the energization of each of the feed roller 39, the presser plate 45 and the spur 42.

45 is a presser plate for suppressing the floating of the recording sheet near the recording position to secure the intimate contact against the transport roller 33. In this embodiment, the recording head employed is an ink jet recording head for effecting the recording by discharging the ink. Accordingly, because the distance between the discharge port formation face of the recording head and the recording face of the recording sheet is comparatively small, and thus must be severely managed to avoid the contact of the recording sheet with the discharge port formation face, the provision of the presser plate 45 becomes effective. 47 is a scale provided on the presser plate 45.

51 is a cap formed of an elastic material such as rubber and opposed to the ink discharge port formation face of the recording head at the home position, this cap being supported to be movable into or out of contact with the recording head. This cap 51 is used for the protection of the recording head when not recording, or in effecting the suction recovery processings of the recording head. The suction recovery processings include a preliminary discharge processing of placing the cap 51 opposed to the discharge port formation face, driving the energy generating elements for use in discharging the ink provided inward of the ink discharge ports, thereby discharging the ink through all the discharge ports to remove the discharge failure factors such as air bubbles or the dust, the thickened ink unsuitable for the recording, and besides, a processing of compulsorily discharging the ink through the discharge ports with the discharge port formation face covered with the cap 51, removing the discharge failure factors.

53 is a pump for generating a suction force for the compulsory discharge of the ink, and useful in sucking the ink as spent into the cap 51 in the suction recovery processing of such compulsory discharge or the suction recovery processing of preliminary discharge. 55 is a waste ink tank for reserving the waste ink discharged by suction, the pump 53 being in communication with the waste ink tank 55 via a tube 57.

59 is a blade as a wiping member to wipe the discharge port formation face of the recording head, the blade supported to be movable to any one of a first position where the blade projects toward the recording head to effect the wiping on the head movement, a second position wherein the blade 59 is cleaned, and a retracted position where the blade is out of engagement with the discharge port formation face. A cam mechanism 63 drives the pump 53 and moves the cap 51 and the blade 59 upon receiving a motive power transmitted from the motor 61. Also, the blade cleaner 49 is a second member for cleaning the blade 59 which is the first member.

Figure 3:
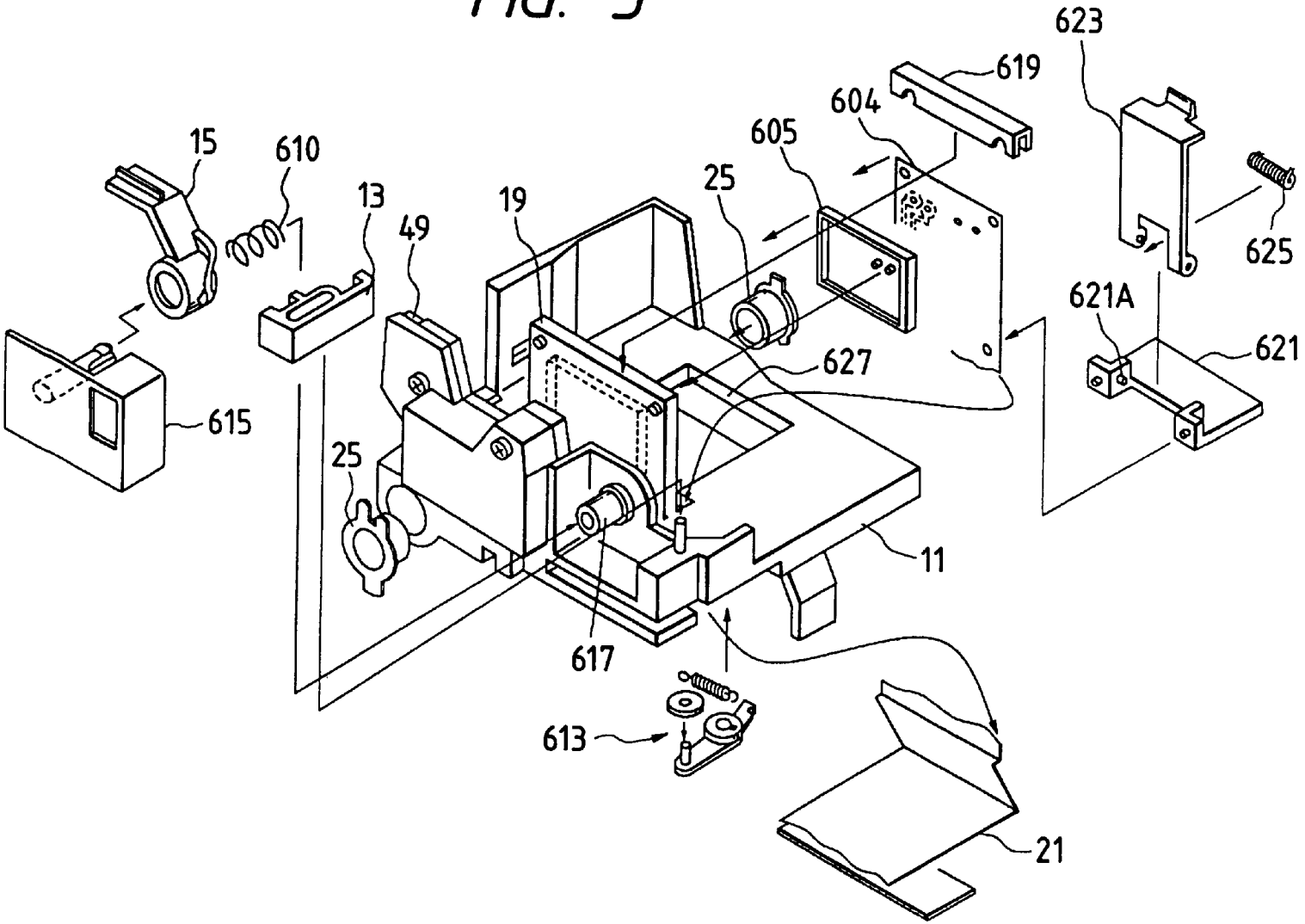
FIG. 3 is an enlarged exploded perspective view of a carriage for the recording apparatus according to one embodiment of the present invention.

FIG. 3 is an enlarged exploded perspective view of the carriage 11 as shown in FIG. 1.

Herein, 613 is a roller spring as described below, 615 is a lever fastener for attaching the operation lever 15 to a fixture 617 on the carriage 11, and 610 is a coil spring. 619 is a fixing member for constituting one end portion of the flexible cable 21, and in this embodiment, fixing the upper edge portion of a flexible substrate 604 formed integrally therewith and a rubber pad 605 to the support plate 19, and 621 is a fixing member for likewise fixing the lower edge portion thereof. The construction of the surrounding of the blade cleaner unit 49 will be described later.

In addition to the above constitution, in this embodiment, a substrate cover 623 is provided to cover the flexible substrate 604 on the carriage side, when the head cartridge 9 is not mounted, and protect the flexible substrate 604 and the circuits on the main device connected thereto from the breakage or action of electrostatic force due to the touch with the operator's hands or the contact therebetween. This substrate cover 623 is disposed rotatably around a pin 621A of the fixing member 521 for substrate on the lower edge side. 625 is a torsion coil spring for rotatably urging the substrate cover 623 in a direction tending to cover the flexible substrate 604, and 627 is a concave portion for accommodating the substrate cover 623 when the head cartridge 9 is mounted.

Figure 4:
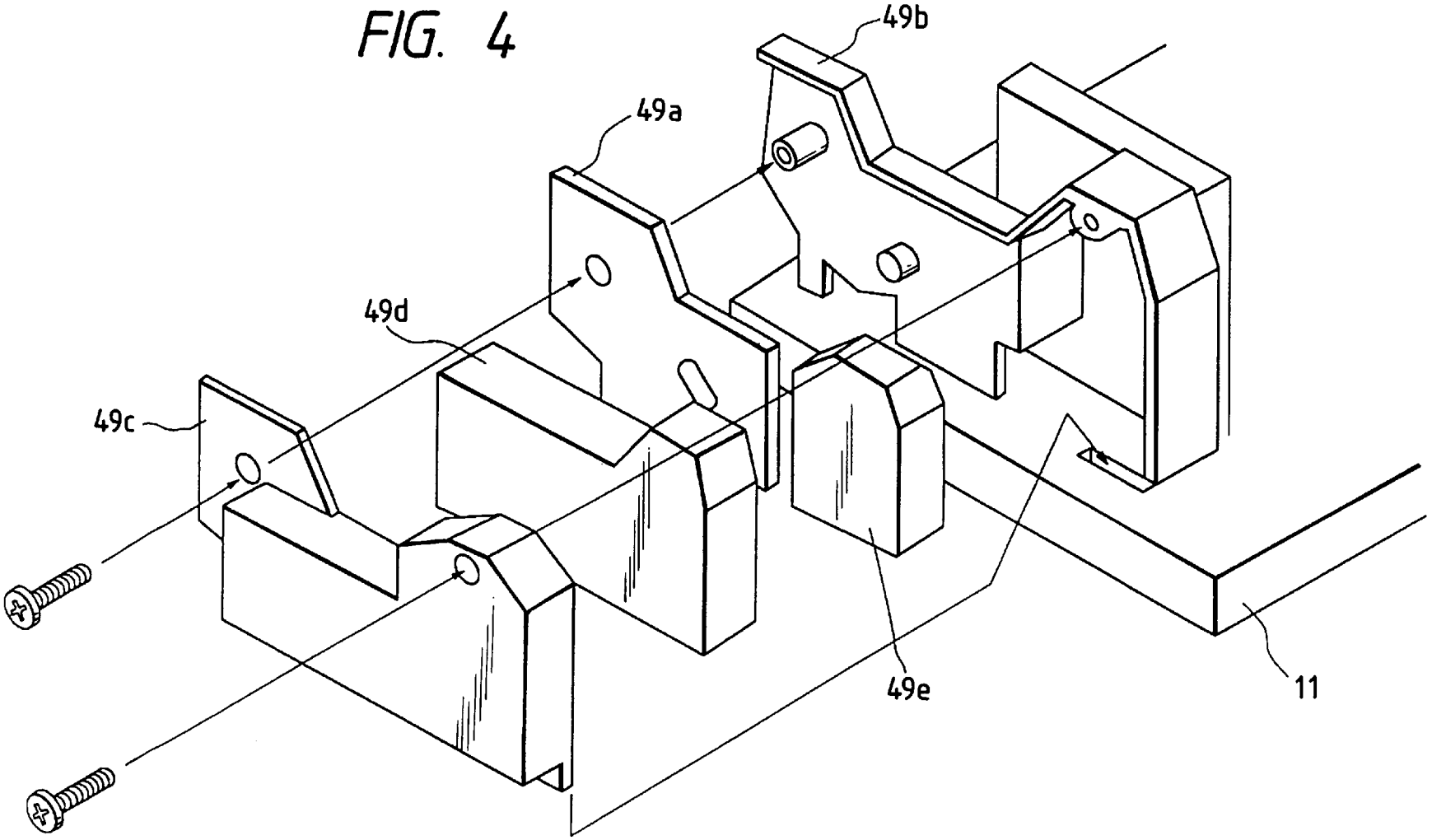
FIG. 4 is an enlarged exploded perspective view of a wiper cleaner on the carriage for the recording apparatus according to one embodiment of the present invention.

FIG. 4 is an exploded perspective view representing the constitution of the blade cleaner unit 49.

49*a* is a blade cleaner to clean off the ink adhering to the blade 59 by wiping the head cartridge 9 under the control as will be described later. Specifically, for example, Rubycer-clean (trade name, Toyo Polymer Co., Ltd.) may be used. The blade cleaner 49*a* is provided with a round hole and a round long hole which are positioned to be fitted over two boss portions provided on a cleaner holder portion 49*b* integrated with the carriage 11. 49*d* and 49*e* are ink stores, which are auxiliary members for storing the overflowing ink wiped by the blade cleaner 49*a*. Specifically, for example, Hatosheet (trade name, Honshu Paper Co., Ltd.) may be used. 49*a*, 49*d* and 49*e* have a property as the absorbing member, with a capacity of absorbing and holding the ink of about 4.5 g, in this example. 49*c* is a cleaner holder lid which is a member for holding and securing 49*a*, 49*d* and 49*e* as above, wherein claws provided in the lower part are fitted into holes provided on the carriage 11 and secured to the carriage 11 by two screws, respectively.

Figure 5:
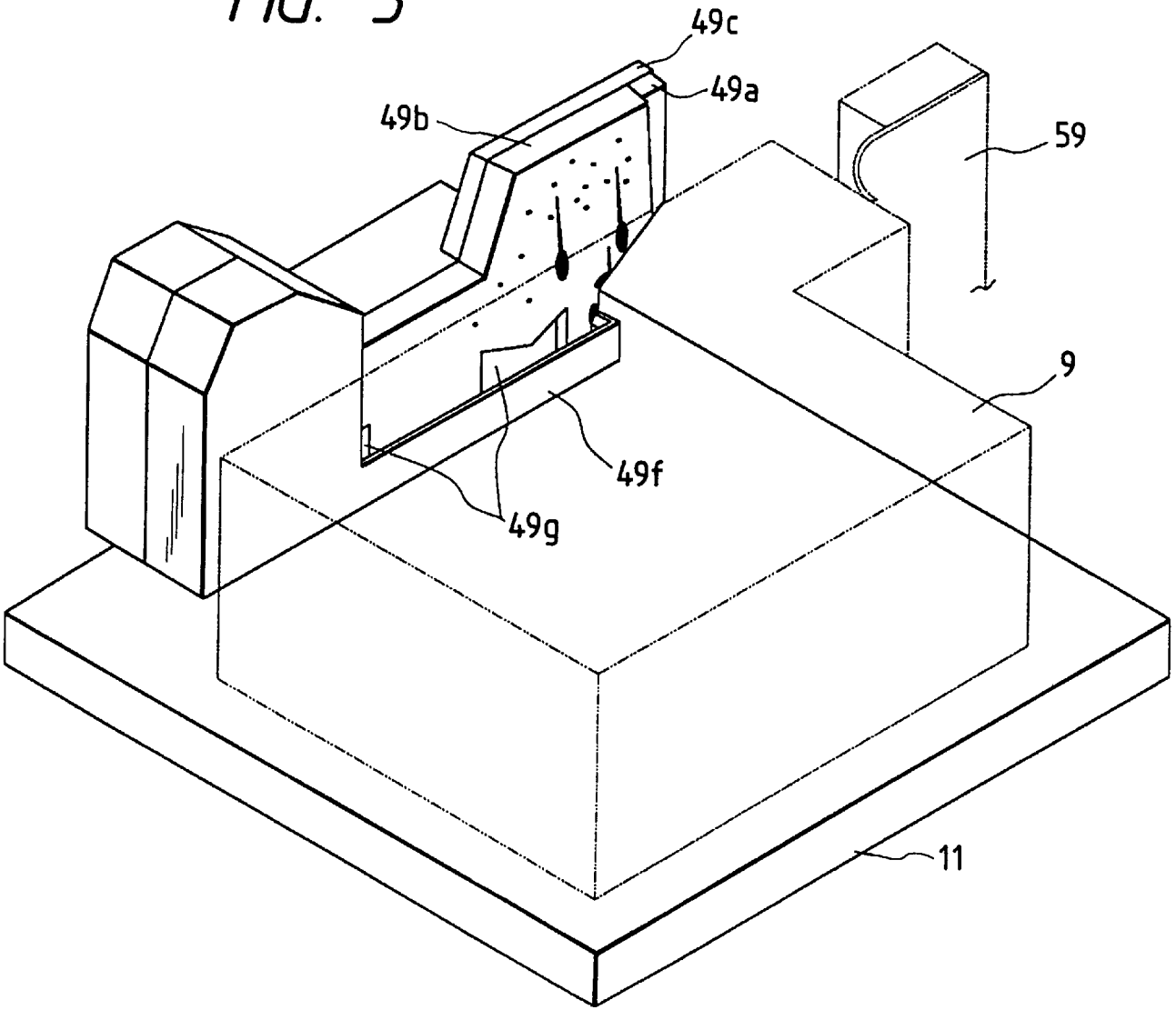
FIG. 5 is an enlarged perspective view useful for the description of the function of the carriage for the recording apparatus according to one embodiment of the present invention.

FIG. 5 is an external perspective view representing the constitution of the blade cleaner unit 49.

A blade 59 which has wiped the head cartridge 9 may splash the ink upon leaving the head cartridge 9. Such ink is received on the lateral side of the blade cleaner unit 49, and adhered thereto, rarely contaminating the other portions within the apparatus. 49*f* is a "trough" provided in the blade cleaner unit. When the apparatus is further used and the amount of adhering ink increases, the ink reserved as shown in the figure will drip down. The trough 49*f* is to prevent the spreading of the ink over the carriage 11, whereby the adhering ink can be reserved within the blade cleaner unit 49. Also, an opening portion 49*g* is to lead the ink reserved within the trough 49*f* to the ink stores 49*d*, 49*e* of the blade cleaner 49*a*.

Figure 6B:
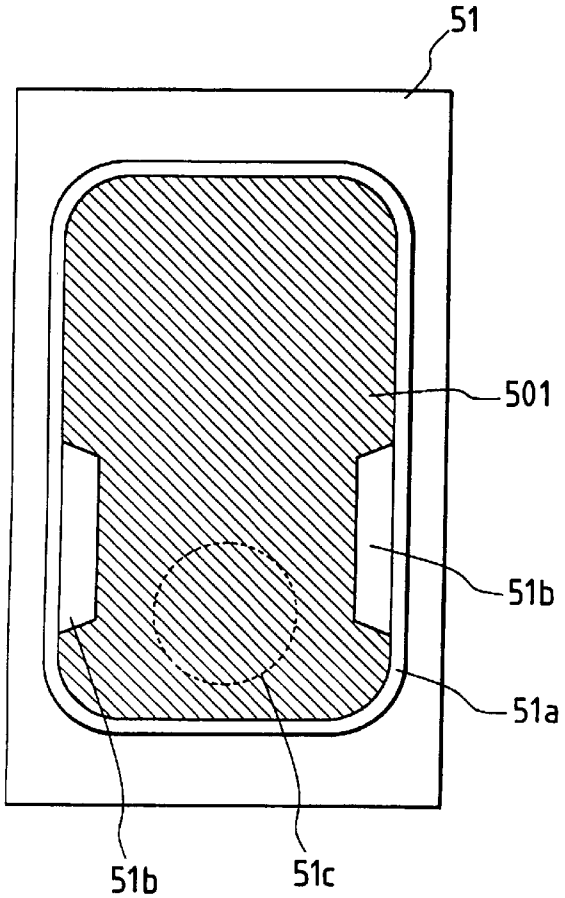
FIGS. 6A and 6B are exploded perspective views of the essence of a recovery unit for the recording apparatus according to one embodiment of the present invention.
Figure 6A:
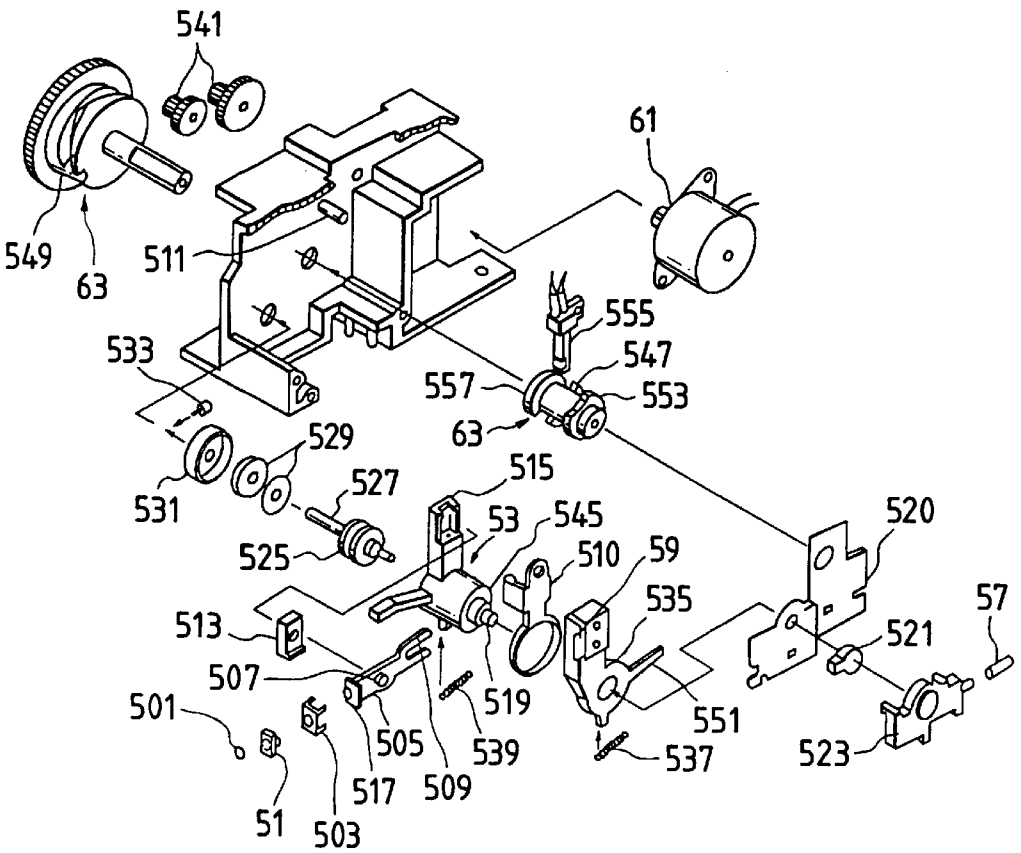

FIG. 6A is an exploded perspective view of the essence of a recovery unit composed of a cap 51, a pump 53, a blade 50, a motor 61 and a cam mechanism 63 in the figure.

Herein, 501 is an ink absorbing member disposed within the cap 51, 503 is a holding member for holding the cap 51, and 505 is a cap lever, rotatably attached around a pin 507, for bringing the cap 51 into or out of contact with the discharge port formation face of discharge portion for the head cartridge 9 owing to a force applied by the pin 507.

FIG. 6B shows the constitution of cap 51. The cap 51 has a rib 51*b* for holding the absorbing member to prevent the falling of absorbing member 501 or the shifting of the holding position. 51*a* is a rib provided on the cap 51 to securely cover the face plane of the head. 51*c* is an ink flow passage leading from the cap to the pump 53, wherein in this embodiment, because of the ink flow passage 51*c* disposed downward vertically so that the ink within the cap is more likely to accumulate, the removal of the ink can be securely effected by the action of the pump. Also, the absorbing member 501 within the cap is configured to cover the ink flow passage 51, wherein even when the ink flow from the pump back to the cap may transiently occur, due to the pump operation, the transfer of the ink in the head can be suppressed at minimum.

In FIG. 6A, 511 is a pin for regulating the rotation range of the cap lever 505 by engagement with an end portion 509 of the cap lever 505.

513 is a jig having a bore into which the pin 507 of the cap lever 505 is fitted, which jig is useful for attaching the cap lever 505 to a support portion 515 provided on the pump 53. 510 is a fixture member for assuring its mounting state. 517 is a working portion for exerting a force to the cap 51 to make contact with the discharge port formation face, so as to engage substantially at the center on the rear side portion of the cap 51. This working portion has a discharge opening for the ink sucked, and the ink flow passages are formed inside the cap lever 505, inside the pin 507, inside the jig 513 and inside the support portion 515, respectively. And if the pump 53 exerts a suction force, the ink is introduced through these ink flow passages into the pump 53, as indicated by the arrow in the Figure.

519 is a shaft projecting from the center on the end face of the pump 53 and formed with an ink flow passage inside, this shaft rotatably attached to a pump support plate 520. The rotational force of the pump 53 itself is exerted via the support portion 515 to the cap lever 505, whereupon the cap 51 is advanced or retracted.

521 is a flow passage forming member connecting to the pump shaft 519, which is referred to as a waste ink seal. 523 is a fixture member for the tube 57, which is referred to as a waste ink cap. That is, the ink flow passages are formed inside the shaft 519, the waste ink seal 521 and the waste ink cap 523, whereby the ink sucked by the pump 53 is introduced through these flow passages via the tube 57 into the ink tank 55 of FIG. 1, as indicated by the arrow in the figure.

525 is a piston for the pump 53, 527 is a piston shaft which is an axis thereof, 529 is a packing, and 531 is a cap for the pump 53. 533 is a pin attached to the piston shaft 527 and receiving the transmission of a force to activate the piston 525. 535 is a blade lever attached to the blade 59, and supported rotatably around a shaft projecting from the end face of the pump 53 to project or retract the blade 59 to or from the recording head along with the rotation. 537 is a tension coil spring for applying a rotational force in a direction of projecting the blade 59 to the blade lever 535. Also, 539 is a tension coil for rotating the pump 53 itself in a direction of the cap 51 tending toward the recording head side.

541 is a gear train for transmitting the rotation of the motor 61 to the cam mechanism 63. The cam mechanism 63 has a cam 547 for engaging and rotating an engagement portion 545 provided on the pump 53, a cam 549 for engaging a pin 533 provided on the piston shaft 527 and rotating the pump, a cam 553 for engaging and rotating an engagement portion 551 provided on the blade lever 535, and a cam 557 engaging a switch 555 for detecting the home position of the cam mechanism 63. The operation of these cams will be described later with the explanation of FIG. 12.

Figure 7:
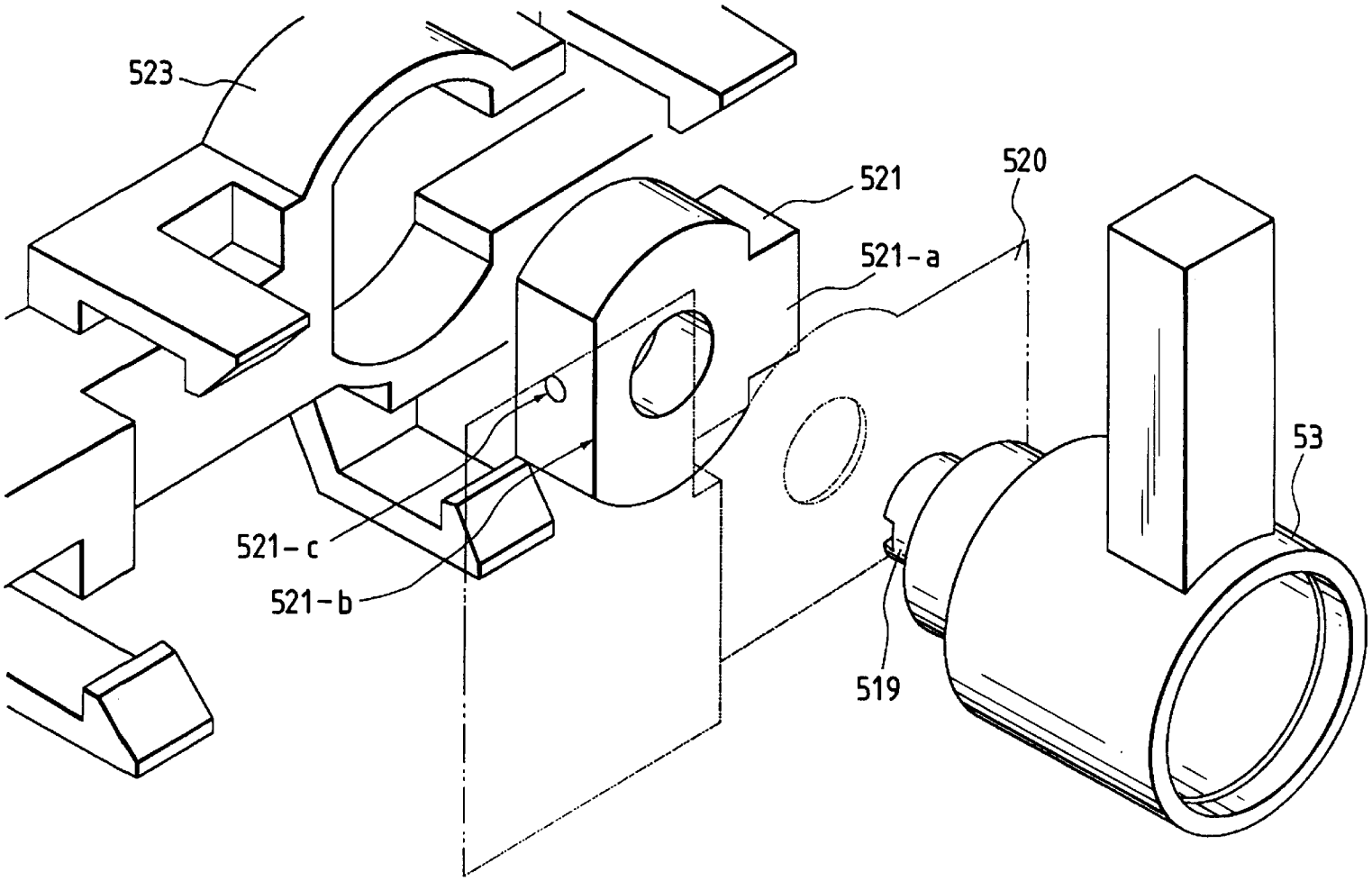
FIG. 7 is an exploded detailed perspective view of a waste ink seal in the recovery unit for the recording apparatus according to one embodiment of the present invention.

FIG. 7 is an exploded perspective view showing the details of the waste ink seal 521.

The waste ink seal 521 is made of NBR. Its external shape is substantially cylindrical but convex in a part 521*a* thereof to prevent the inverted mounting, and is planar on its opposite side as indicated at 521*b*, with an ink flow passage formed therein. The flat shape is given due to the easiness of finishing the parts in the molding process.

The waste ink cap 523 is provided with a hole similar in outer shape to and slightly smaller than the waste ink seal 521, into which the waste ink seal 521 is inserted. It is provided with an ink flow passage, not shown in the figure, at the position corresponding to the ink flow passage 521*c* of the waste ink seal 521 to connect to the tube 57, not shown. And it is also planar, corresponding to the plane 521*b* of the waste ink seal 521. This is also of an effective shape to raise the finishing level of this plane.

The inner diameter of the waste ink seal 521 is slightly smaller than the outer diameter of the pump shaft 519. The pump shaft 519 is inserted into the pump support plate 520 and supported, and projected beyond the pump support plate 520.

If the waste ink cap 523 having the waste ink seal 521 inserted thereinto is attached to the pump support plate 520 by the snap-in action, the inner diameter of the waste ink seal 521 is fitted with the outer diameter of the pump shaft 519 to complete the flow passage.

Figure 8:
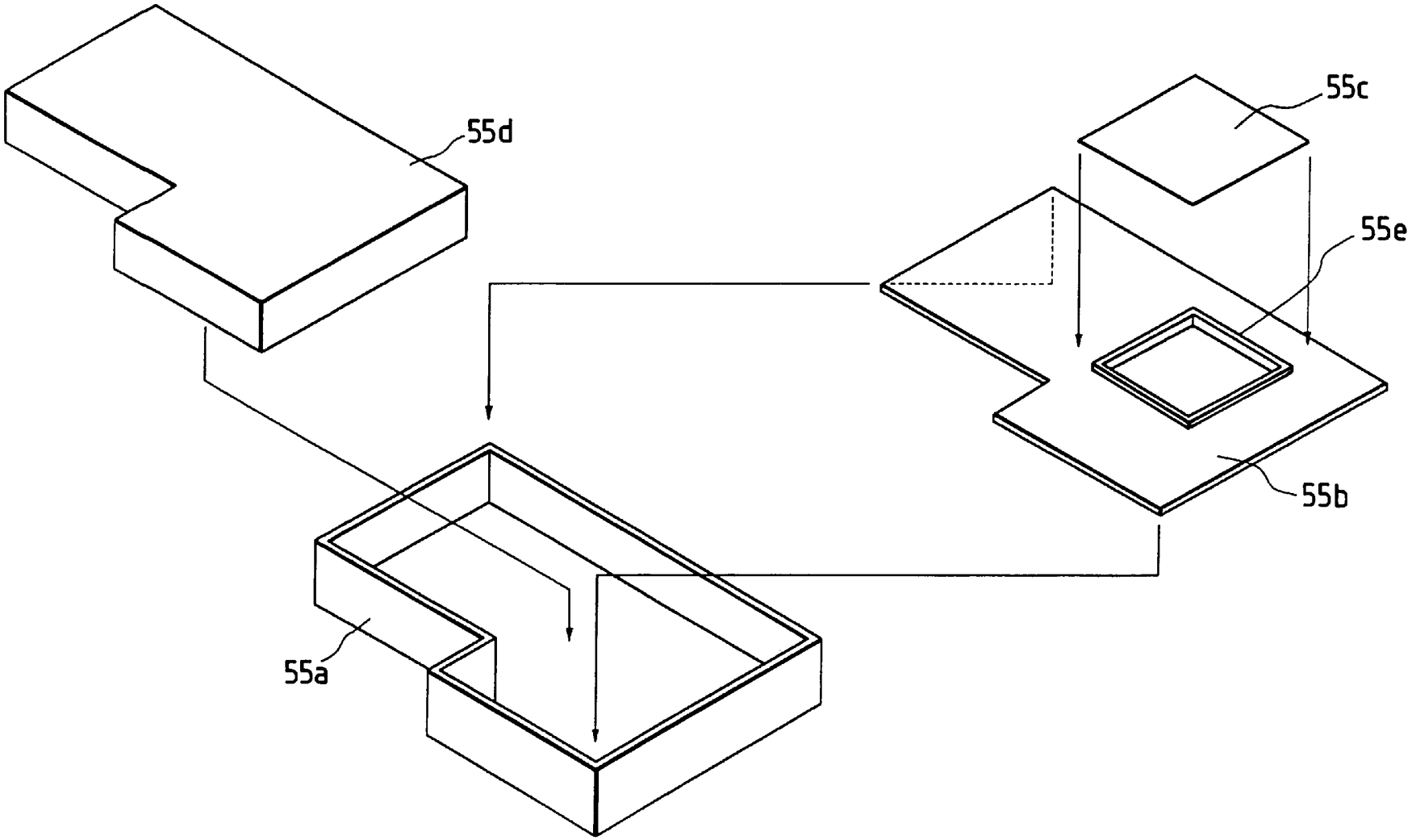
FIG. 8 is an exploded perspective views of a waste ink tank for the recording apparatus according to one embodiment of the present invention.

FIG. 8 is an exploded perspective view of the waste ink tank 55.

55*a* is a waste tank, 55*b* is a waste tank lid, 55*c* is a breathable film, and 55*d* is a tank absorbing member.

First, the breathable film 55*c* is ultrasonic welded to the waste tank lid 55*b*. Next, the tank absorbing member 55*d* is placed in the waste tank 55*a*, and the waste tank lid 55*b* is ultrasonic welded, thereby completing the waste ink tank 55.

Figure 9A:
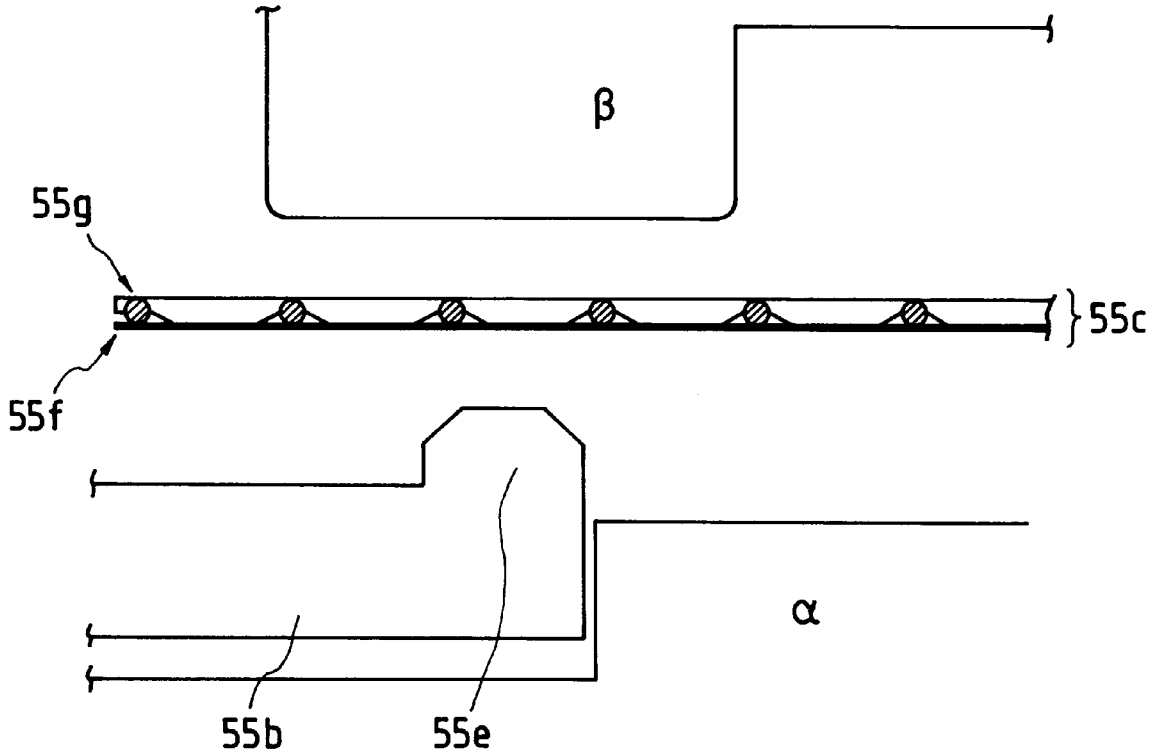
FIGS. 9A and 9B are cross-sectional detailed views of a waste ink tank breathable film welding portion for the recording apparatus according to one embodiment of the present invention.

FIG. 9A is a view in detail of ultrasonic welding the breathable film 55*c*.

For the breathable film 55*c*, for example, Microtex (trade name, made by Nitto Denko Co., Ltd.) can be used.

The upper view shows the state before welding. a is a reception jig for welding and β is a welding hone. The reception jig is to receive the waste tank lid 55*b*, but convex in part on the opening portion for the breathable film. It has a height slightly lower than the thickness of the waste tank lid 55*b*, and makes no contact therewith when the hone β comes to the lowest point. With the effect of the convex portion, the wrinkle of breathable film 55*c* which may be produced escaping into the space in the opening portion at the welding can be relieved.

At the welding portion of the waste tank lid 55*b* made of polypropylene, a welding rib 55*e* having a height of about 0.5 mm and a width of about 1 mm is provided. Also, its top apices are chamfered not to damage the breathable film.

The breathable film 55*c* is of two layer construction consisting of a porous membrane 55*f* made of tetrafluoroethylene resin, several tens microns thick, and a polypropylene net 55*g*, several hundreds micros thick, which two layers are laminated. The ultrasonic welding is conducted with the polypropylene net 55*g* facing the hone β.

Figure 9B:
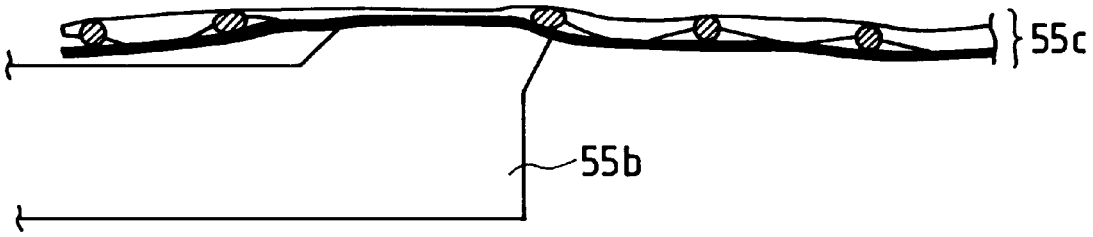

FIG. 9B represents the state after welding of FIG. 9A. The welding rib 55*e* and the polypropylene net 55*g* melt with the vibration of the hone α in the state of penetrating into the porous membrane 55*f* made of tetrafluoroethylene resin, i.e., the welded state. The porous membrane 55*f* made of tetrafluoroethylene resin is very thin, and weak, but because of the vibration via the polypropylene net 55*g*, it is less damaged. Also, because the polypropylene net 55*g* faces the outside of the waste ink tank 55, the porous membrane 55*f* made of tetrafluoroethylene resin is less damaged even if the breathable film is touched in assembling.

Figure 10:
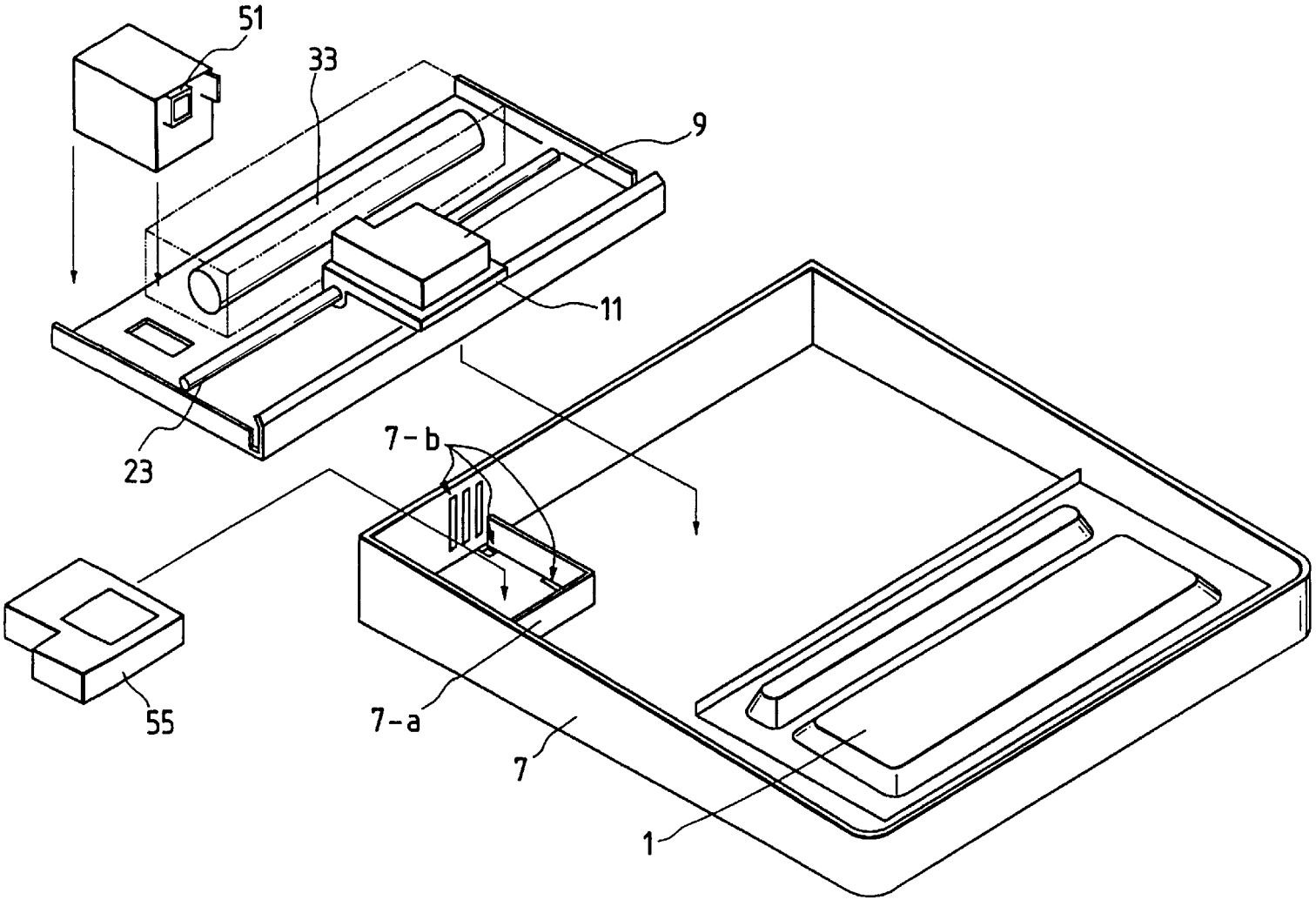
FIG. 10 is an explanation view of the arrangement of the recovery unit and the waste ink tank for the recording apparatus according to one embodiment of the present invention.

FIG. 10 is a view explaining how to position the waste ink tank 55 and the recovery unit within the word processor.

A keyboard 1 and a printer unit are disposed in front of the user and in the rear thereof on a lower case 7 of the word processor, respectively. On the left rear side of the lower case 7 is prepared a waste ink tank space surrounded by a rib 7*a*, within which the waste ink tank 55 is placed. On the bottom face or the back face of the space for the waste ink tank, a louver 7*b* is opened, whereby even if the closeness of the waste ink tank 55 is so insufficient as to cause the waste ink to leak therefrom, the waste ink is discharged out of the word processor without contacting the electrical components within the apparatus.

Also, the recovery unit on the printer unit is disposed directly above the waste ink tank space, and a chassis under the recovery unit is provided with an opening portion. With such constitution, even if the waste ink tank 55 is filled enough to cause the overflowing of the waste ink from the cap 51, the waste ink is led out of the word processor without any risk of making contact with the electrical components within the apparatus.

Figure 11:
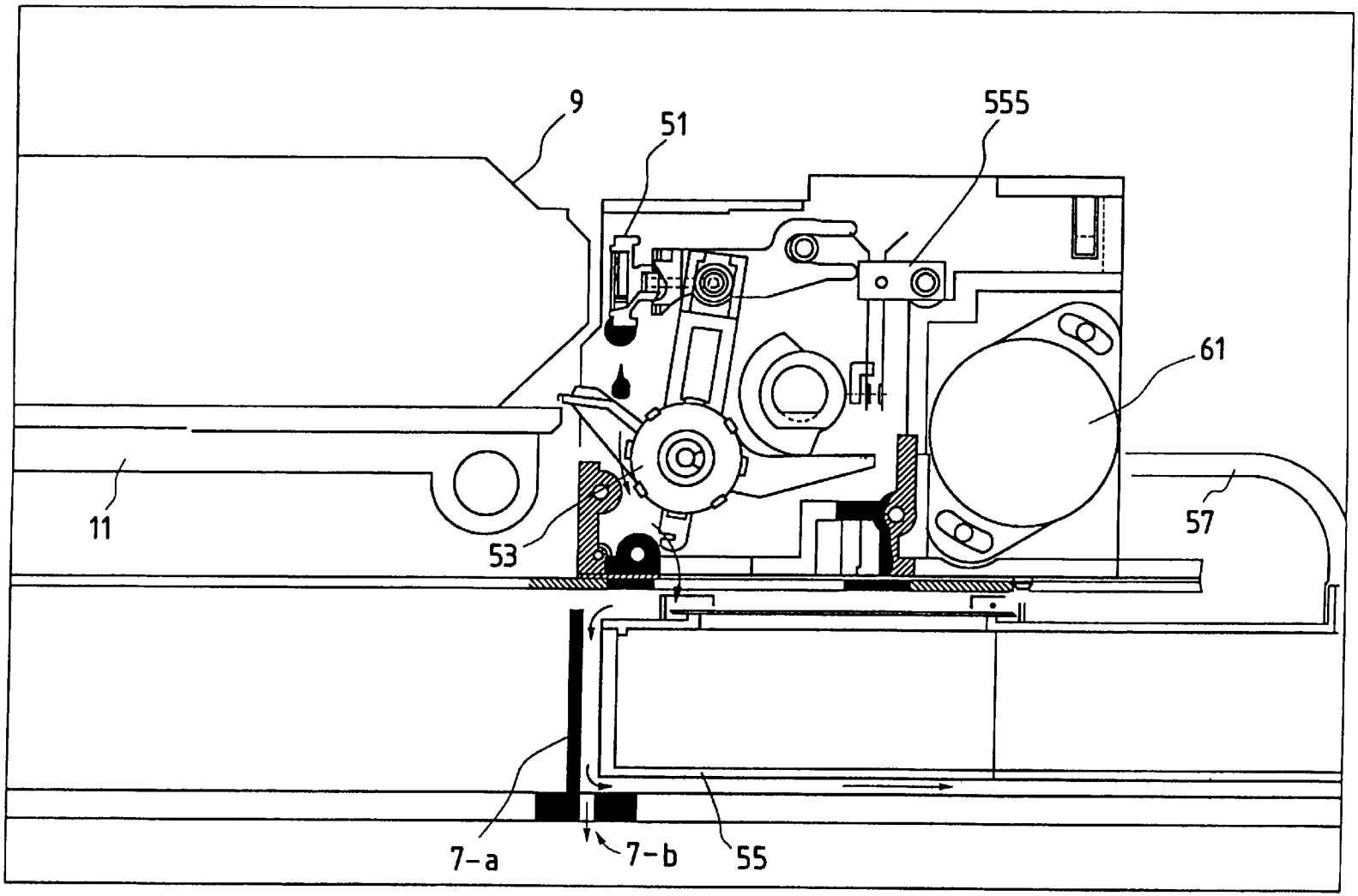
FIG. 11 is an explanation view of the ink flow path when ink overflow from the cap occurs in the recording apparatus according to one embodiment of the present invention.

FIG. 11 is a view for explaining the path when the waste ink overflows from the cap 51.

If the suction operation is made in the state where the waste ink tank 55 is filled, the ink sucked from the head cartridge 9 will overflow from the cap 51, due to no more capacity of receiving, dripping down the pump 53. Because an opening portion is provided on the bottom face of the component of the recovery unit, and an opening portion also provided in the chassis, as previously mentioned, the waste ink will drop into the waste ink tank space, and is discharged out of the word processor by virtue of the louver 7*b*.

Next, the specific operation of the recovery unit according to the present embodiment will be described below with reference to FIGS. 12 to 20.

Figure 12:
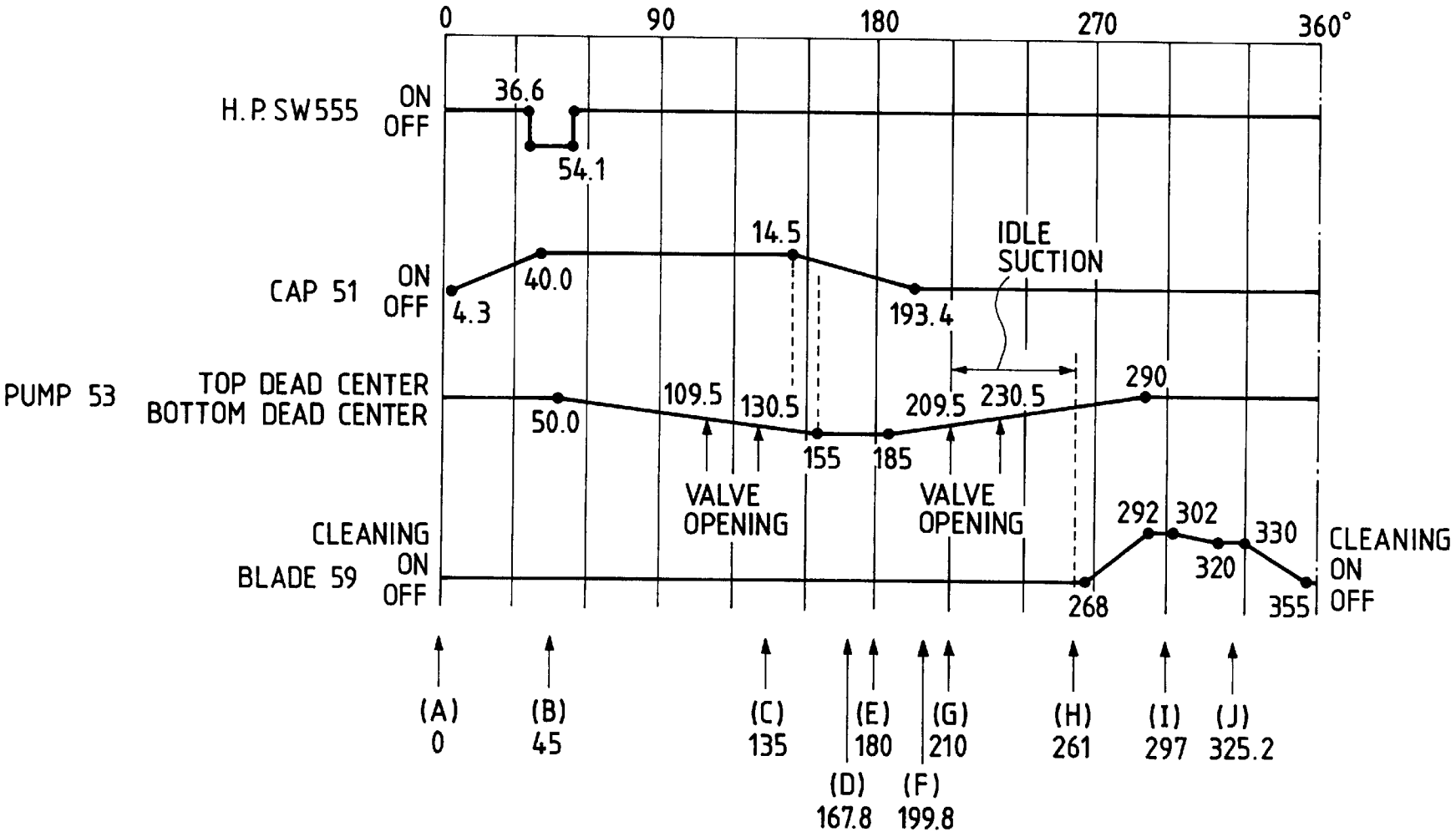
FIG. 12 is a cam chart of the recovery unit for the recording apparatus according to one embodiment of the present invention.

FIG. 12 is a cam chart representing the specific operation of the recovery unit. Four operation points are provided, including a recovery home position detecting switch (H.P.SW) 555 (FIG. 6A), cap 51, pump 53, and blade 59. The explanation of the recovery operation involves, in addition to the operation of the above recovery unit, the movement of the carriage 11 into which the head cartridge 9 and the blade cleaner unit 49 are incorporated.

The recovery home position detecting switch 555 is in the switch on state, except for a range from 36.6° to 54.1° where it is turned off in the state (B) on the cam chart.

The cap 51 is in the abutting state with the head cartridge 9 which is represented as "on" in a range from 40° to 145°, or otherwise in the release state which is represented as "off".

FIGS. 13A to 13E are explanation views for the operation states for the pump 53 within the recovery unit. (This Figure is shown by omitting the hatching on the cross section of each component not to make the view less recognizable.)

Figure 13A:
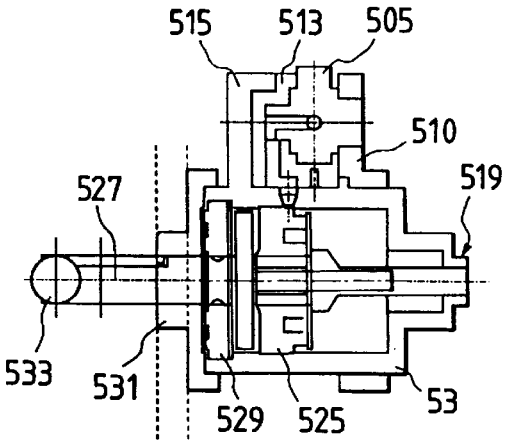
FIGS. 13A to 13E are explanation views of the pump operation state in the recovery unit for the recording apparatus according to one embodiment of the present invention.
Figure 13B:
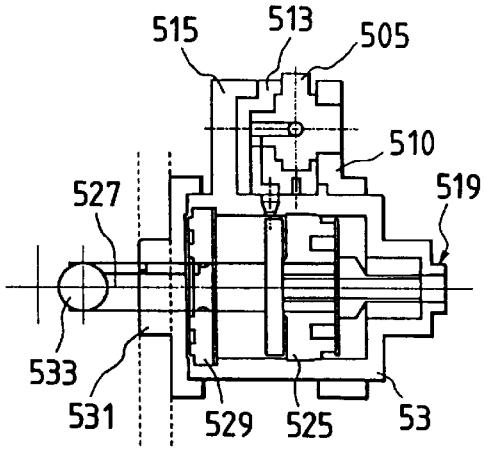
Figure 13C:
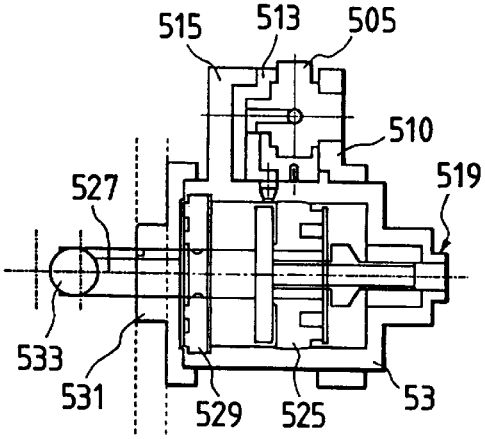
Figure 13D:
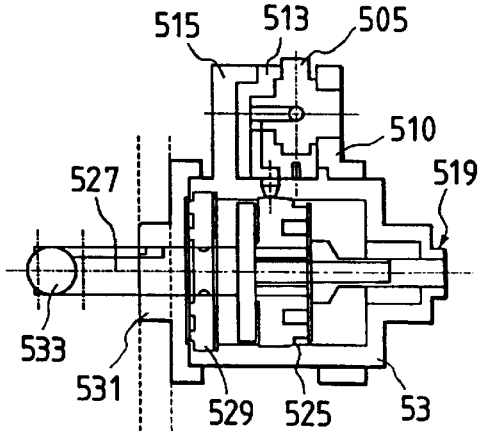
Figure 13E:
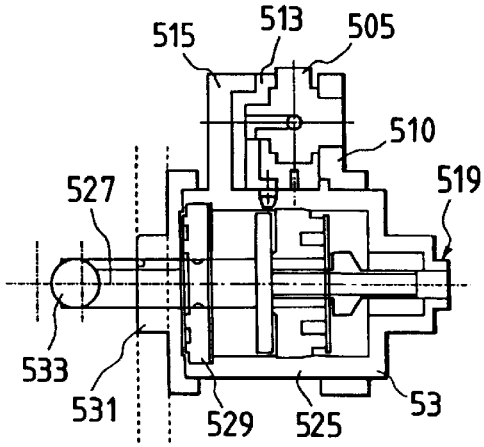

The state of the pump 53 is continuously changed as the cam 549 as shown in FIG. 6A acts on the pin 533, but the following five important positions are given as shown in FIGS. 13A to 13E. FIG. 13A shows a position called an upper dead center, FIG. 13B shows a position called a lower dead center, and FIG. 13C shows a stop position after the suction in the state as indicated by (C) on the cam chart of FIG. 12. FIG. 13D shows a position of starting the idle suction in the state as indicated by (H) on the cam chart, which is also called an idle suction preparation position. FIG. 13E shows a stop position after the idle suction in the state as indicated by (G) on the cam chart.

Figure 14:
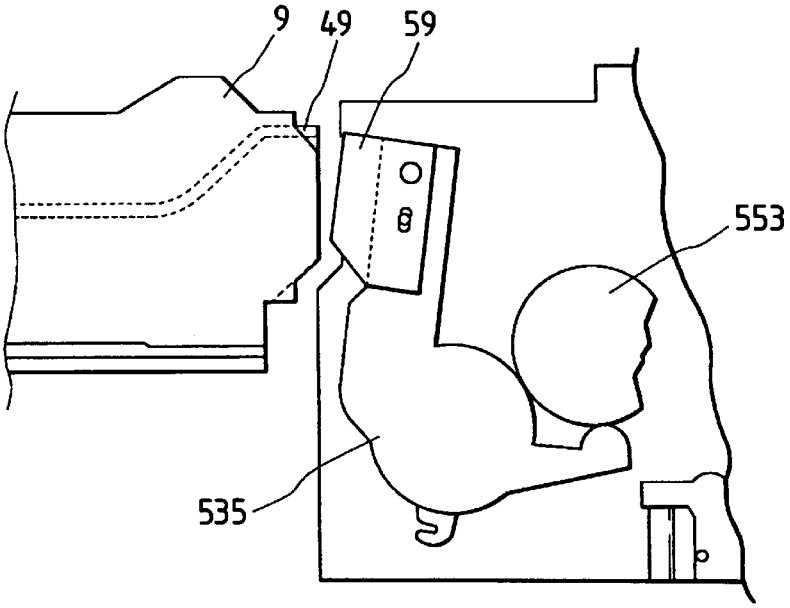
FIG. 14 is an explanation view of the "OFF position" of blade in the recovery unit for the recording apparatus according to one embodiment of the present invention.

FIG. 14 is a view showing the off position of the blade 59 within the recovery unit in this embodiment. This is the state where the blade is completely retreated away from the head cartridge 9 and the blade cleaner unit 49, which state is represented as "off" on the cam chart of FIG. 12.

Figure 15:
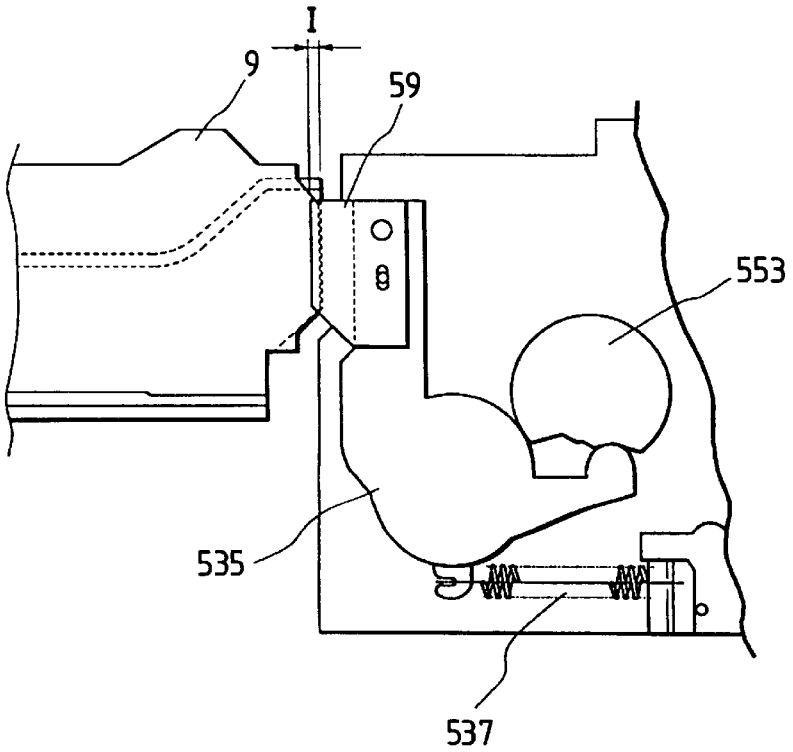
FIG. 15 is an explanation view of the "ON position" of blade in the recovery unit for the recording apparatus according to one embodiment of the present invention.

FIG. 15 is a view showing the on position of the blade 59. This is a position where the head cartridge 9 can be wiped, the intrusion amount as indicated by "I" being about 1 mm. This state occurs at (J) position which is represented as "on" on the cam chart as shown in FIG. 12.

Figure 16:
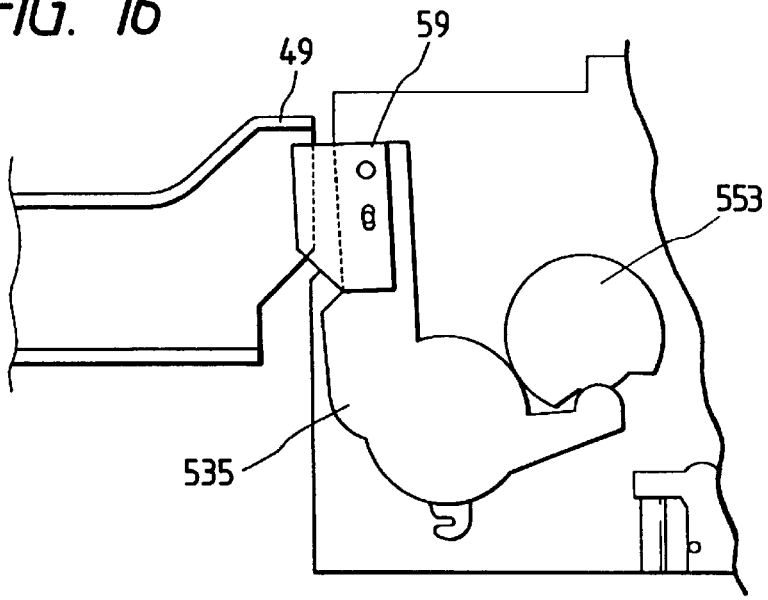
FIG. 16 is an explanation view of the cleaning position of blade in the recovery unit for the recording apparatus according to one embodiment of the present invention.

FIG. 16 is a view showing the cleaning position of the blade 59. This is the state of projecting from the "on" state further toward the head cartridge 9 or the blade cleaner unit 49, which state occurs at the (I) position which is represented as "cleaning" on the cam chart of FIG. 12. The carriage 11 is operated with the blade 59 as the "cleaning" state, and upon the blade cleaner unit 48 being pressed against the blade 59, the ink not only at the top end of the blade 59, but also in the broader area of the blade 59, can be removed.

Figure 17:
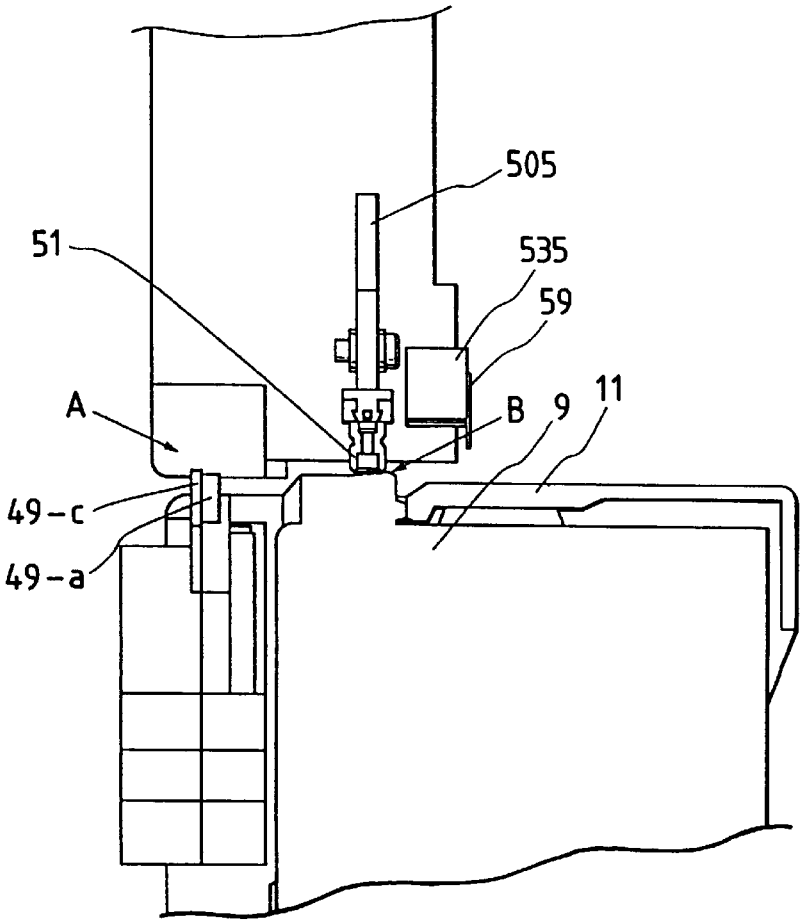
FIG. 17 is an explanation view of the "capping position" of carriage for the recording apparatus according to one embodiment of the present invention.

FIG. 17 is a view showing the capping position of the carriage 11 with respect to the recovery unit, and also showing the recovery unit and the head cartridge as seen from the above. This is a position where the ink discharge ports of the head cartridge 9 have faced the front surface of the cap 51, whereby the cap 51 makes contact therewith for the protection or the suction of the ink in communication with the pump 53. This position is called a "capping position". Also, as seen in this figure, in this embodiment, the blade cleaner unit 49 is disposed on the carriage 11 several millimeters left from the head cartridge 9. Also, the top end (arrow A) of the blade cleaner unit 49 is substantially at the same height as the top end (arrow B) of the head cartridge 9. This is required to maximize the performance of the blade cleaning and to prevent contamination of the recording sheet by the interference during the printing.

Also, if the recovery unit is placed in the capping state at this position of the carriage 11, though not shown, the lock mechanism of the recovery unit is activated to regulate the movement of the carriage 11 within a small range.

Figure 18:
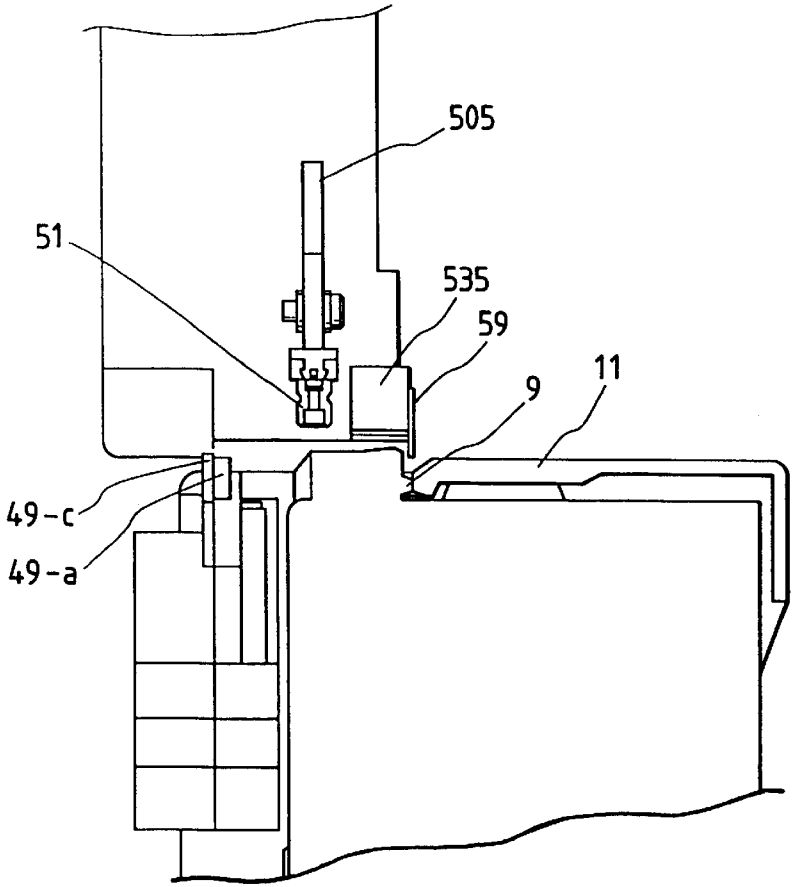
FIG. 18 is an explanation view of the "wiping preparation position" of carriage for the recording apparatus according to one embodiment of the present invention.

FIG. 18 is a view showing the wiping preparation position of the carriage 11 in FIG. 17 for the recovery unit of this embodiment. This is a position where the blade 59 is turned on to prepare for the wiping of the head cartridge 9. As the blade 59 in the figure is already turned on, the wiping is effected if the carriage 11 is moved to right from this state. This position is called a "wiping preparation position".

Figure 19:
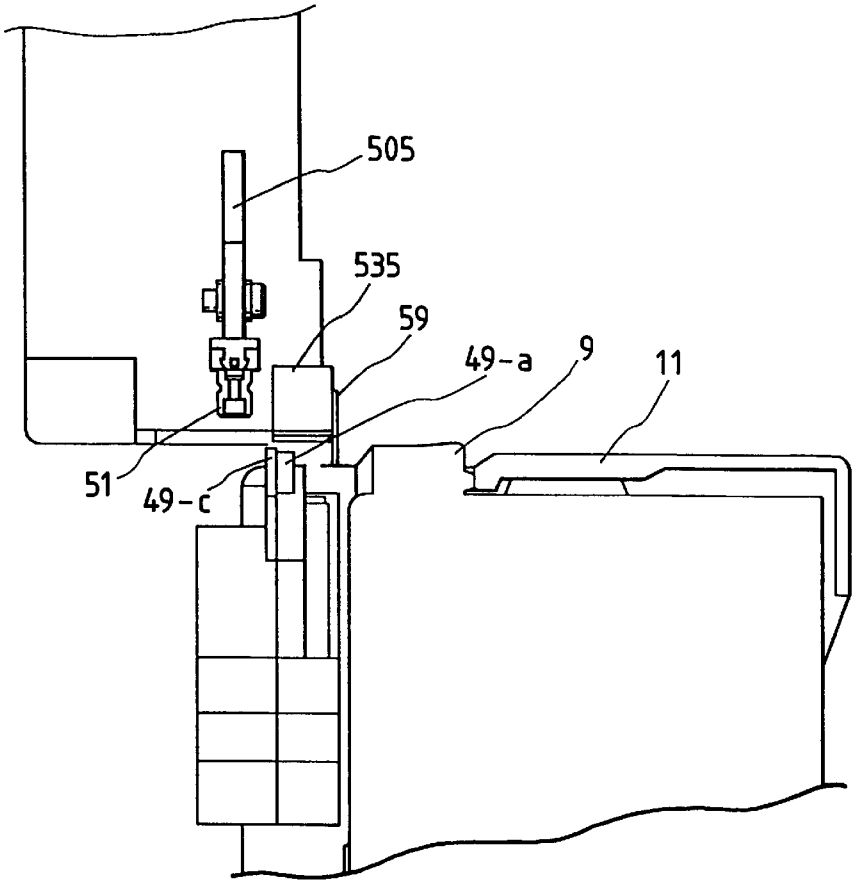
FIG. 19 is an explanation view of the "blade cleaning preparation position" of carriage for the recording apparatus according to one embodiment of the present invention.

FIG. 19 is a view showing the blade wiping position of the carriage 11 in FIG. 18 for the recovery unit. This is a position where the wiping of the head cartridge 9 is completed, and the blade 59 is placed in the "cleaning" state to effect the blade cleaning at the next time. As the blade 59 in the figure is already in the "cleaning" state, the blade cleaning is effected if the carriage 11 is moved to right from this state. This position is called a "blade cleaning preparation position".

In wiping, there is a phenomenon wherein the ink adhering to the blade 59 is splashed away leftward as it is released instantaneously from the state where the blade 59 is in contact with the head cartridge 9, but in this embodiment, such ink can be received by the blade cleaner unit 49, resulting in quite less amount of ink splashing out of the printer unit.

Figure 20:
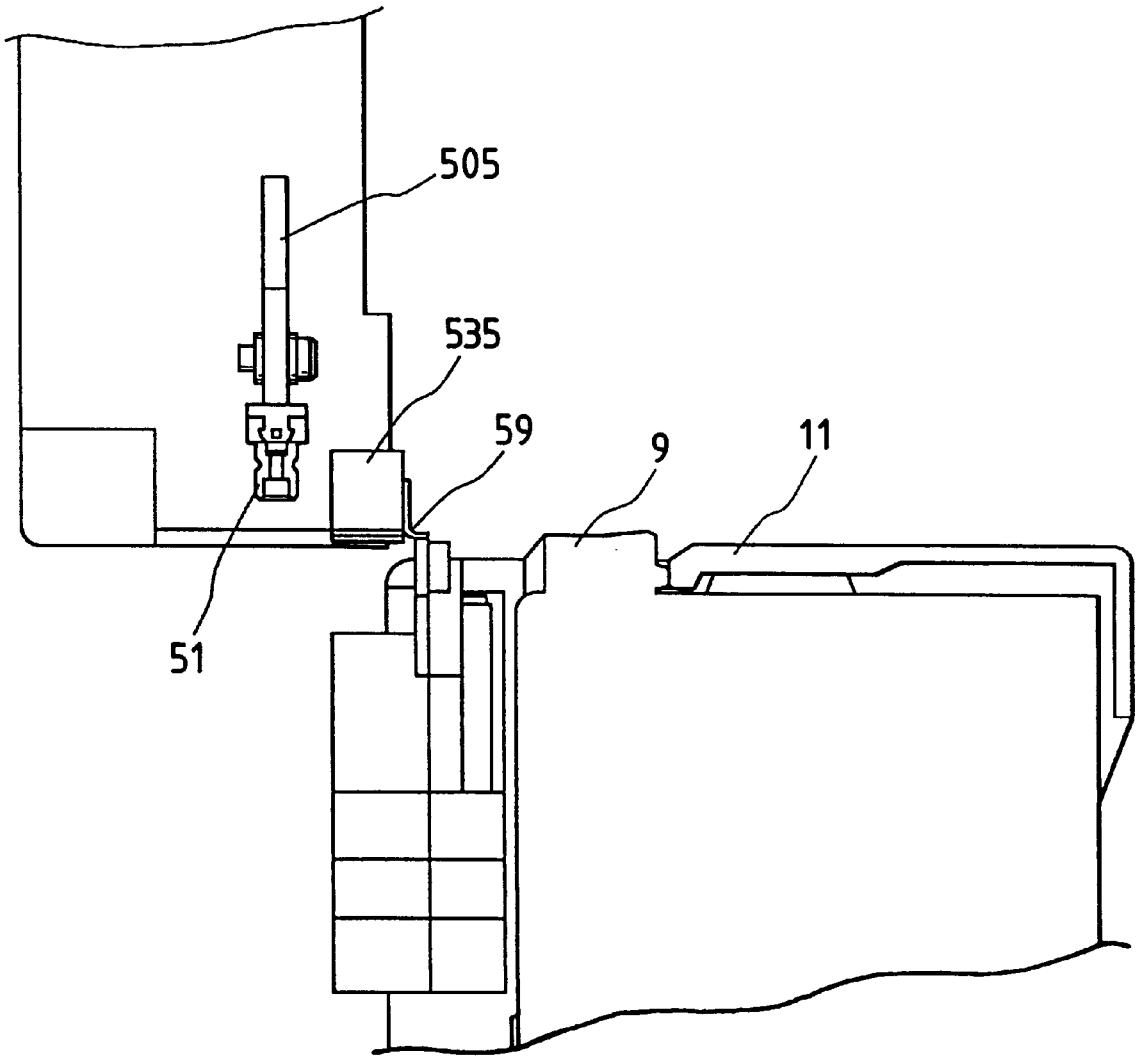
FIG. 20 is an explanation view of the "blade cleaning completion position" of carriage for the recording apparatus according to one embodiment of the present invention.

FIG. 20 is a view showing the blade cleaner completion position of the carriage 11 of FIG. 19 for the recovery unit. As will be seen from this figure, at the position where the blade cleaner unit 49 is not completely left away from the blade 59, the blade cleaning is supposed to be complete. If the blade 59 is switched off from this state, the ink is prevented from splashing leftward as shown in the figure. This position is called a "blade cleaning completion position".

Figure 21:
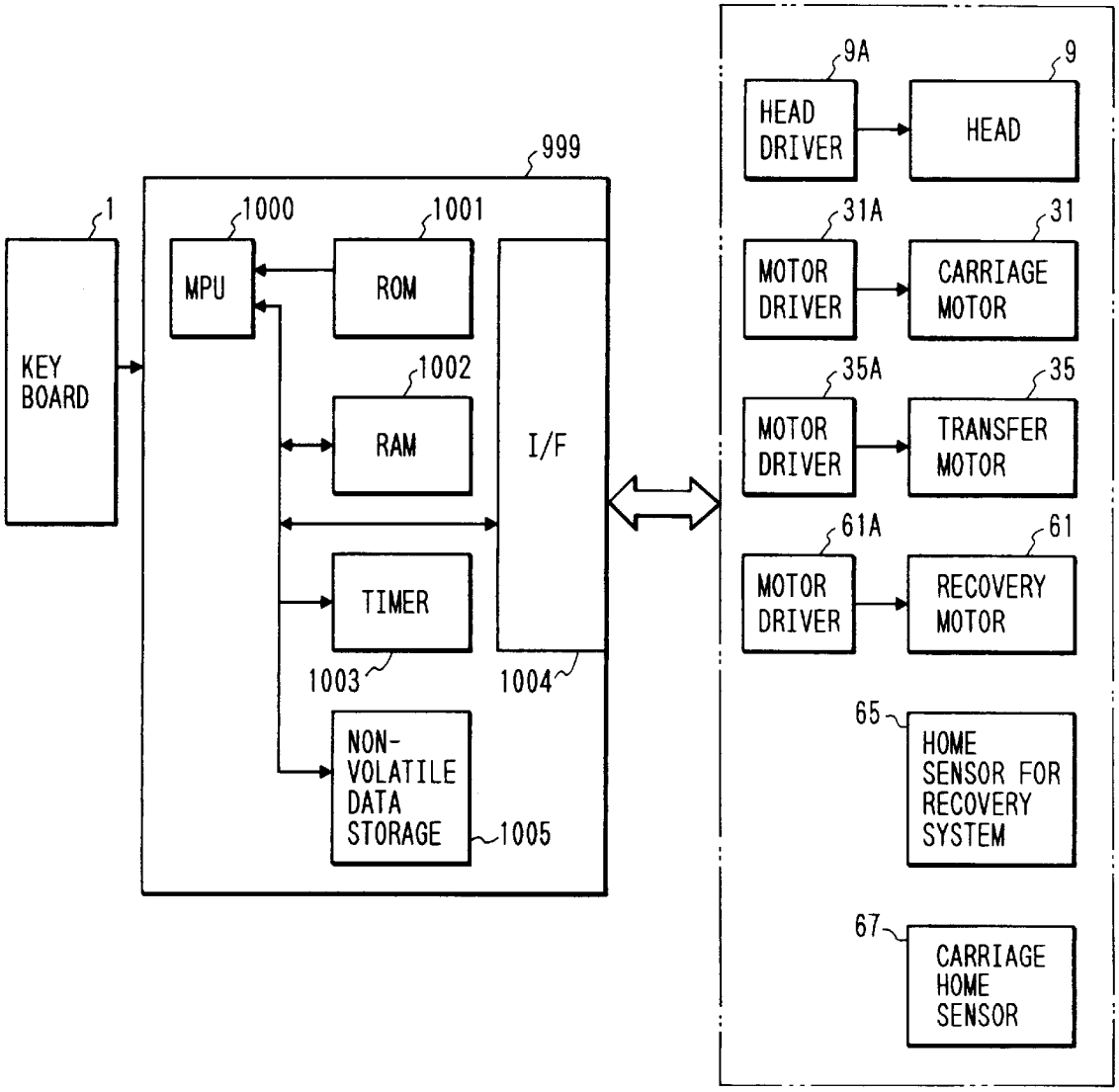
FIG. 21 is a configuration block diagram of a control system for the recording apparatus according to one embodiment of the present invention.

FIG. 21 is a configuration block diagram showing an example of the control system for the recording apparatus with the above constitution in this embodiment.

The cap position or movement position of the carriage 11 can be known based on the detected value of the recovery home sensor 65 or the carriage home sensor 67. In the same Figure, 1000, which constitutes a microcomputer 999, is an MPU for controlling each unit by executing a control procedure and issuing a control signal, as will be described later, wherein a ROM 1001 stores a program corresponding to each control procedure. A RAM 1002 is used as the work area in performing the control procedure. Also, 1003 is a timer for clocking.

Figures 22, 22A:
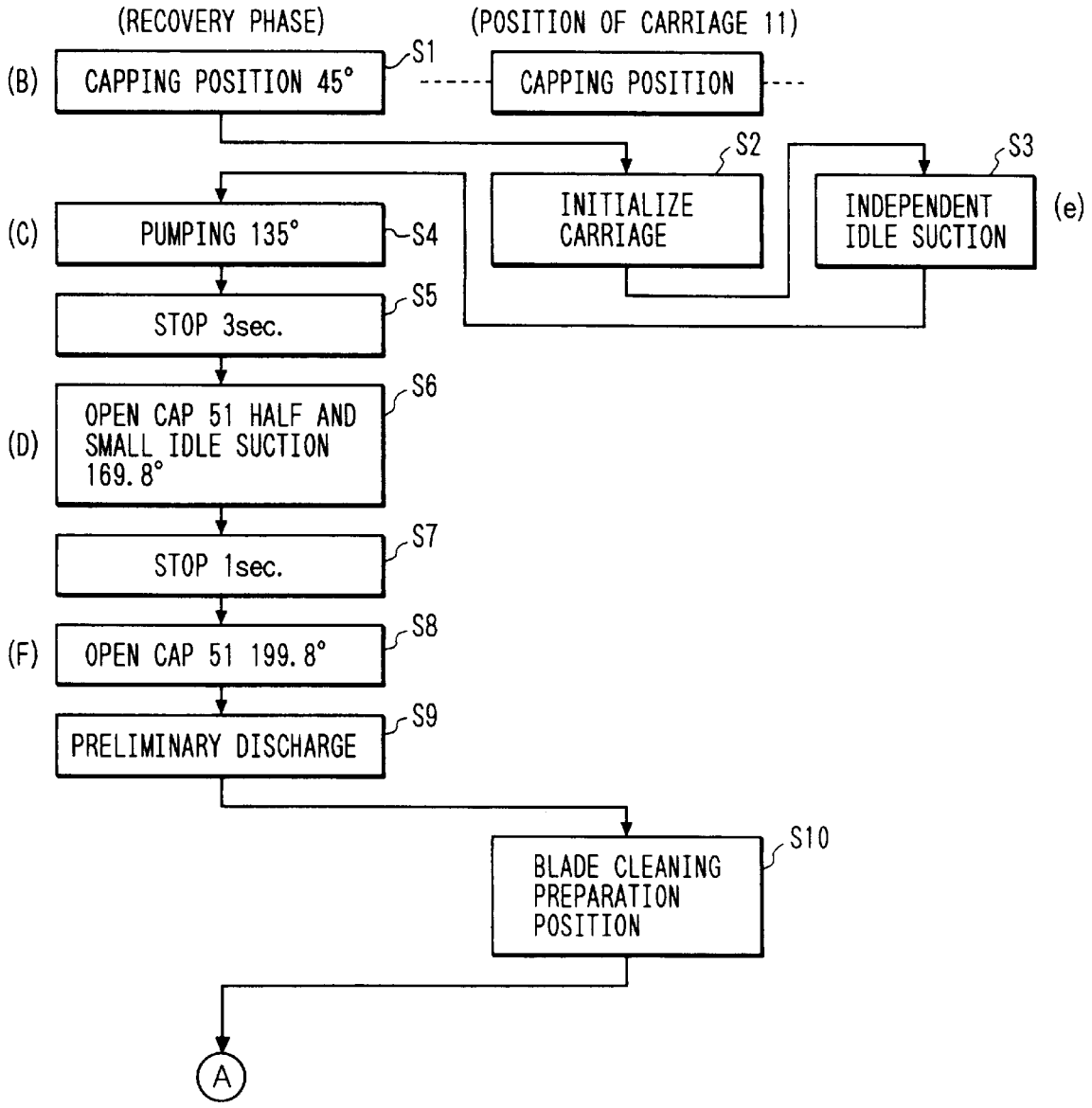
FIG. 22 which is comprised of FIGS. 22A and 22B and FIG. 23 are flowcharts for explaining the cleaning operation in the recording apparatus of the present invention.
Figure 22B:
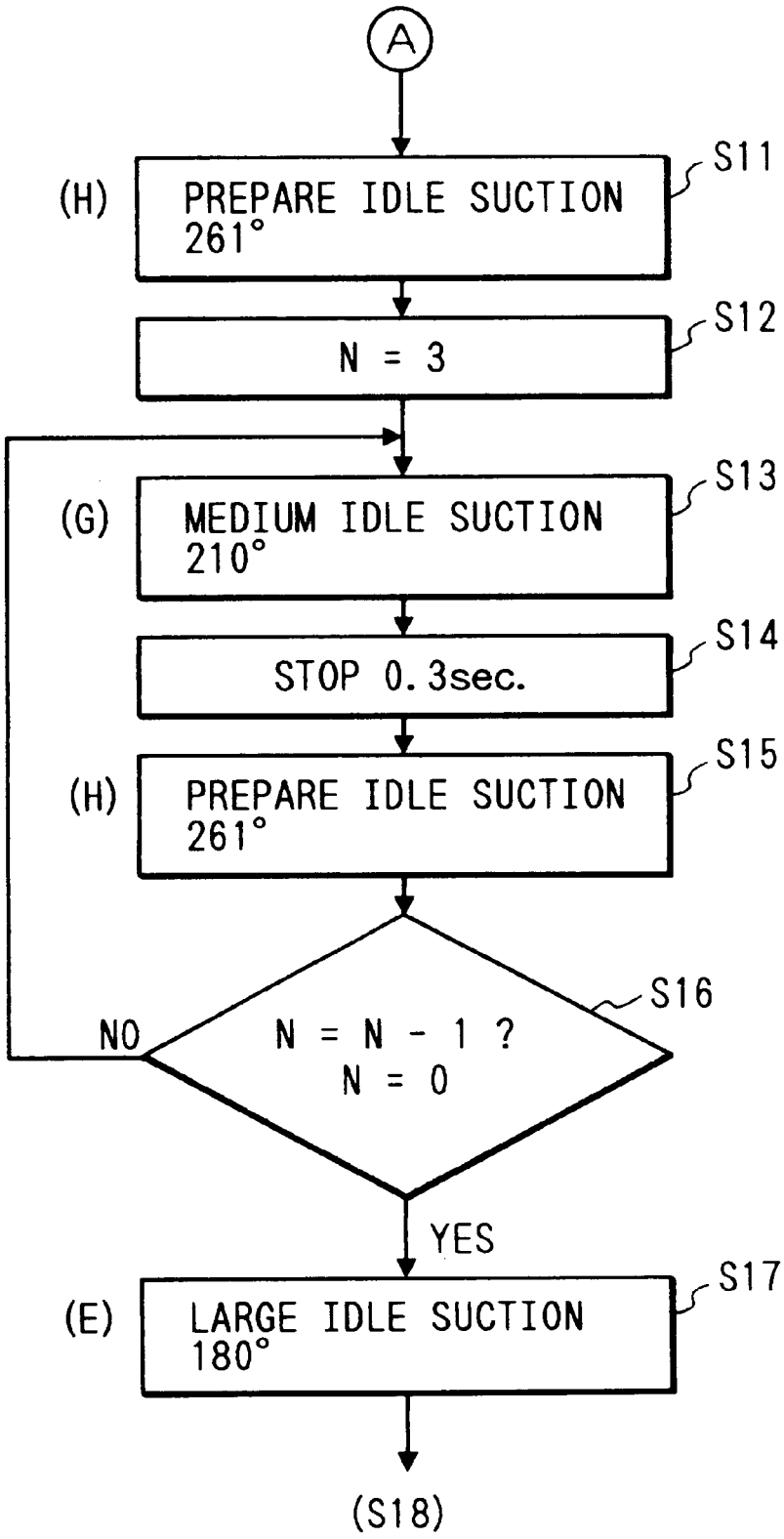
Figure 23:
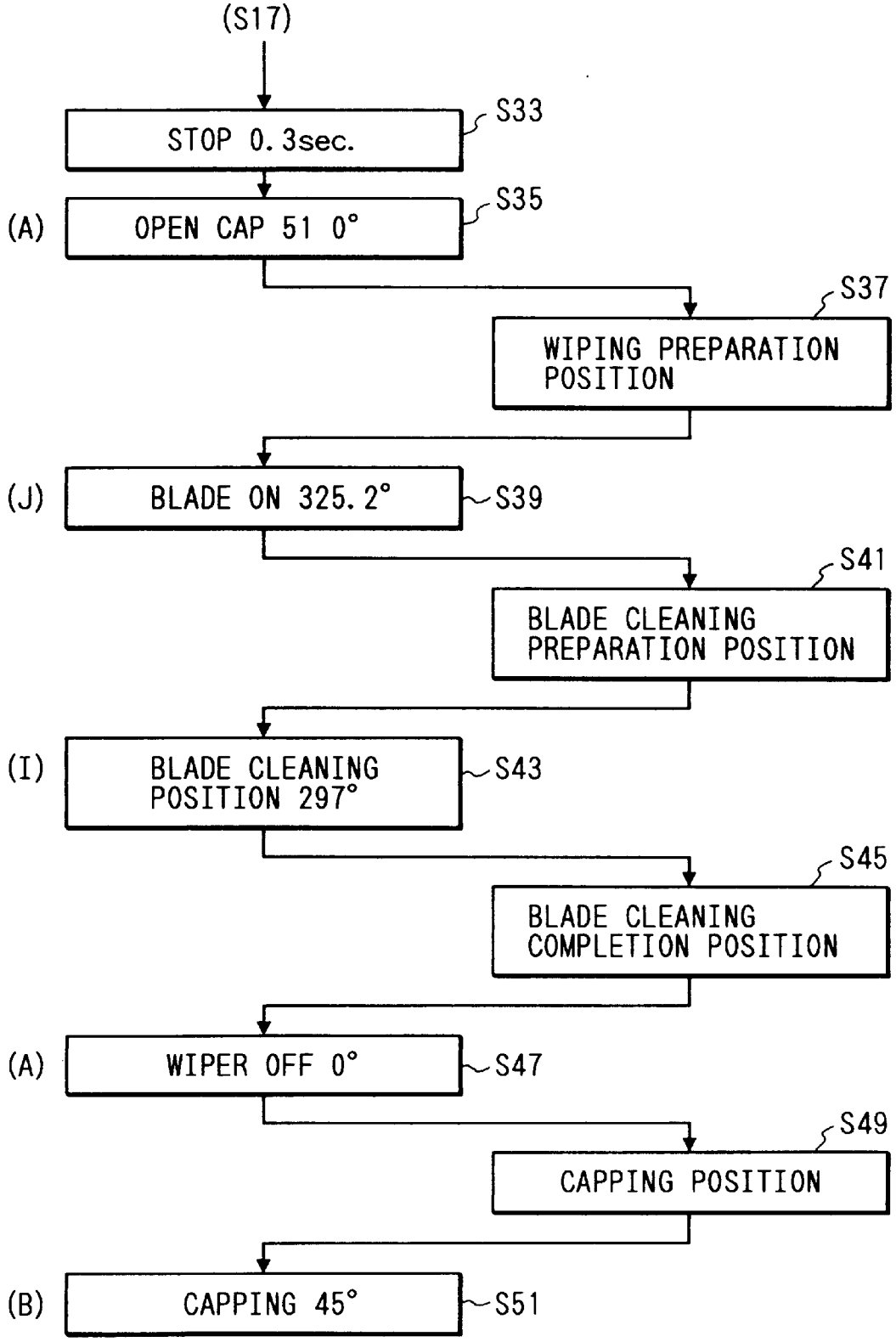

In the flowcharts as shown in FIGS. 22A, 22B and 23, one example of the operation sequence for the discharge performance recovery processing (hereinafter referred to as a "cleaning") to be performed by the recovery unit and the carriage 11 under the control of the MPU 1000 is shown. The alphabetical symbols (A) to (J) to the left of the flow showing the recovery state of this figure correspond to those in the cam chart as shown in FIG. 12.

First, at the capping position (also referred to as the carriage position) where the carriage 11 is located at the front face of the cap 51, the recovery phase is started from the capping state (step S1). Then, at step S2, the carriage initialization is effected to set the carriage home position. The details of the carriage initialization will be described later. This is performed to correctly activate a lock mechanism of the recovery system for regulating the movement of the carriage in the capping state as previously described, and to accurately position the carriage 11 during the wiping operation which is performed subsequently, thereby effecting an independent idle suction as will be next described (step S3).

At step S3, the operation returns to the (C) state, whereby a negative pressure is produced at 53 to allow the head cartridge 9 to suck the ink. The operation stops for 3 seconds in this state (step S5) to secure the time required for the movement of the ink.

After the end of suction, the operation transfers to the (D) state (step S6), where the cap 51 is half opened while performing small idle suction. With a slight suction, the ink left within the cap 51 when the cap is opened is drawn into the pump 53, so that no ink drips outside the recovery unit. A next one-second stop (step S7) is provided to securely effect small idle suction as will be described later. Upon transferring to the (F) state (step S8), the cap 51 is fully opened and the preliminary discharge is performed (step S9). In this embodiment, the preliminary discharge is configured to effect 100 discharges per nozzle at a drive frequency of 500 Hz.

Then, prior to entering the idle suction process for feeding the ink previously absorbed from the head cartridge 9 into the waste ink tank 55 as shown in FIG. 1, the carriage 11 is moved to the blade cleaning preparation position (step S10) to retreat the head cartridge 9 and the blade cleaner unit 49 from the front face of the cap 51. This is conducted to avoid the contamination of the head cartridge 9 and the blade cleaner unit 49 owing to the possibility that a slight amount of ink may splash away from the cap 51 in the idle suction process.

And the operation then enters the idle suction process. First, the operation transfers to the idle suction preparation position (step S11), and therefrom transfers to the medium idle suction position of (G) (step S13), with a stop of 0.3 seconds (step S14), which operation in series is repeated three times. At the fourth idle suction, the operation transfers to the large idle suction position of (E) (step S17), wherein the piston 52 is moved to the lower dead center at this position, so that the ink within the pump 53 is sufficiently fed into the waste ink tank 55.

Then, the recovery system transfers to the (A) state (step S19), and the carriage is moved to the wiping preparation position with the cap 51 opened (step S20). Herein, the recovery system is placed in the (J) state (step S21) to project the blade 59 into a wiping enable state. And the carriage position is shifted to the blade cleaning preparation position (step S22), whereby the blade 59 wipes the face plane of the head cartridge 9. Further, the recovery system is placed in the (I) state at its carriage position (step S23) to project the blade 59 further one step as the blade cleaning position. In its state, the carriage position is shifted to the blade cleaning completion position (step S24), whereby the blade 59 is cleaned.

Finally, the recovery system is placed in the (A) state (step S25) to turn off the blade 59, and the carriage position is returned to the capping position (step S26). Then, the recovery system is placed in the (B) state (step S27), whereby the capping is closed and ended.

Figure 24:
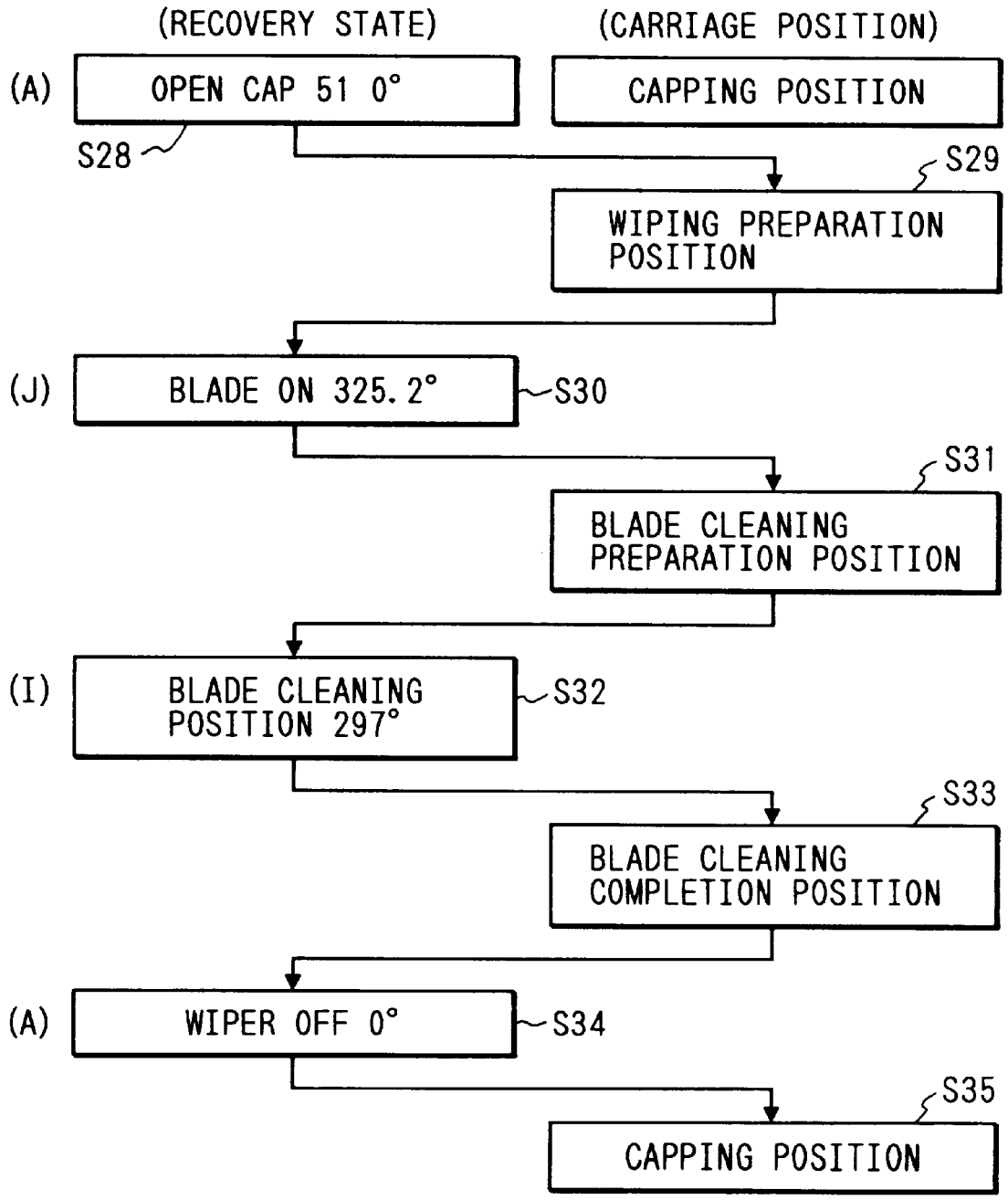
FIG. 24 is a flowchart for explaining the wiping operation in the present invention.

FIG. 24 is a flowchart showing one example of the wiping operation sequence to be executed by the recovery unit and the carriage 11 under the control of MPU 1000 of FIG. 21. Note that the "wiping" as herein referred to includes the operation of cleaning the face plane of the head cartridge 9, as well as the operation of cleaning the blade 59. Thereby, it is possible to avoid the phenomenon in which the ink adhering to the blade 59 will adhere to the face plane of the head cartridge 9, contrary to the purpose of wiping, so that the excellent wiping can be expected at any time.

First, the recovery system is started from the cap open state of (A) as shown in FIG. 24 at the capping position where the carriage 11 is opposed to the front face of the cap 51 (step S28), and the carriage position is shifted to the wiping preparation position (step S29). Herein, the recovery system is placed in the (J) state (step S30), whereby the blade 59 is projected to the wiping enable state. And the carriage position is shifted to the blade cleaning preparation position (step S31), whereby the blade 59 wipes the face plane of the head cartridge 9. Further, the recovery system is placed in the (I) state at its carriage position (step S32) to project the blade 59 further one step as the blade cleaning position. In its state, the carriage position is shifted to the blade cleaning completion position (step S33), whereby the blade 59 is cleaned.

Finally, the recovery system is placed in the (A) state (step S34) to turn "off" the blade 59, and the carriage position is returned to the capping position (step S35). Thereby, the recovery operation is ended.

Figure 25:
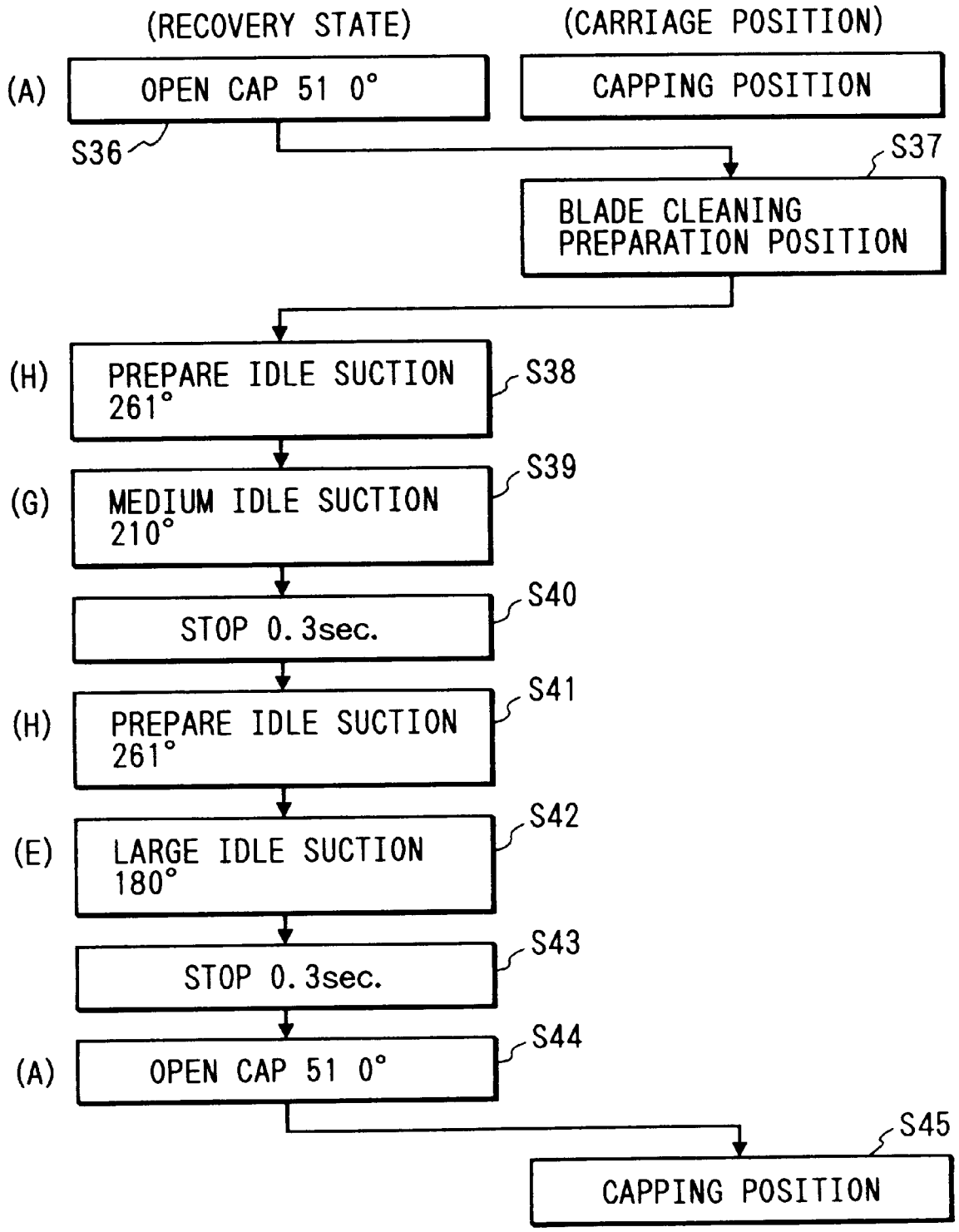
FIG. 25 is a flowchart for explaining the independent suction operation in the present invention.

FIG. 25 is a flowchart showing one example of the independent idle suction operation sequence to be executed by the recovery unit and the carriage 11 under the control of MPU 1000 of FIG. 21. Note that the independent idle suction involves withdrawing the ink accumulated within the cap 51 by the preliminary discharge during the print operation and further feeding the ink to the waste ink tank 55 in order to keep the head from making contact with the ink within the cap or the ink adhering to the cap.

First, the recovery system is started from the cap open state of (A) at the capping position where the carriage 11 is opposed to the front face of the cap 51 (step S36). Then, the carriage is moved to the blade cleaning preparation position (step S37) to retreat the head cartridge 9 and the blade cleaner unit 49 from the front face of the cap 51. Then the carriage position is shifted to the idle suction preparation position (step S38), and then to the medium idle suction position (G) (step S39), followed by a stop of 0.3 seconds (step S40), whereafter one medium idle suction is performed. Then, the recovery system is transferred again to the idle suction preparation of (H) (step S41), and moved therefrom up to the large idle suction position of (E) (step S42), followed by a stop of 0.3 seconds (step S43). At this position, the piston 525 is moved to the lower dead center, so that the ink within the pump 53 is sufficiently fed into the waste ink tank 55.

Finally, the recovery system is placed in the (A) state (step S44) to make the cap open, and the carriage position is returned to the capping position (step S45). Thereby, the recovery operation is ended.

FIGS. 26, 27, 28 and 29 are flowcharts showing the recording operation sequence of this embodiment. The "wiping" and the "independent idle suction" as represented in the figure are already shown in FIGS. 24 and 25, respectively, and as previously described.

At step S101, the power is turned on, and the recovery system is first set to the home position (A) state (step S52). This state is one in which the cap 51 and the blade 59 are retreated from the head cartridge 9, so that the carriage 11 is free to move. Then, at step S53, the carriage initialization (detailed later) is performed to set the carriage 11 to the home position or the capping position opposed to the front face of the cap 51. Then, the independent idle suction of FIG. 25 is performed as an idle suction before closing of the cap.

$N_1$ in the chart is a counter for the number of preliminary discharges to control the initiation of the independent idle suction. At step S54, $N_1$ is reset, and the ink reception state of the waste ink tank 55 as described below is checked at step S56. At steps S57 and S58, various cleaning operation sequences as will be described later are performed.

The recording signal is input at step S59, the paper is supplied at step S60, the cap 51 is opened at step S61, the carriage initialization is performed at step S62, the wiping is effected at step S63, and the preliminary discharge is effected at step S64. Then, $N_1$ is incremented by +1.

Also, in this embodiment, the preliminary discharge for recording is performed every 30 seconds, wherein a timer $T_1$ manages this time. After the preliminary discharge is performed, the timer $T_1$ is reset at step S65, and started to prepare for the next preliminary discharge. Thereupon, one line of recording is executed at step S78.

A determination is made whether or not the value of the timer $T_1$ exceeds 30 seconds, at step S79, every time after the execution of recording. If the affirmative judgement is made, the operation transfers to steps S80 and S81, like steps S64 and S65, and then to step S82. On the other hand, if the negative judgement is made, the operation transfers directly to step S82. That is, through this flow, the preliminary discharge is performed every 30 seconds during the recording. At step S82, a determination is made whether or not the value of counter $N_1$ reaches 8. If the affirmative judgement is made, the independent idle suction is performed on the course of recording one page at step S83. In this case, a procedure as shown in FIG. 25 is initiated. Thereafter, the counter $N_1$ is reset and started again at step S84, whereby the operation transfers to step S85. Note that if the negative judgement is made at step S82, the operation transfers directly to step S85.

At step S85, a determination is made whether or not a next page is instructed after one page of recording is ended. If the negative judgement is made, the operation transfers to step S86 to determine the presence or absence of a print signal. If the affirmative judgement is made a step S86, a determination is made whether or not there is an END signal for the end of recording. If the negative judgement is made, the operation returns to step S78 to execute the recording for the next one line. This operation is repeated in one page until the recording is completed.

On the other hand, if no recording signal is entered (e.g., the processing within the word processor taking some time) at step S86, the operation transfers to step S66, where when no recording data is entered for a predetermined period (30 seconds in this embodiment), a timer $T_2$ useful for the capping is reset and started again. Then, at step S67, a determination is made whether or not any recording signal exists. If the affirmative judgement is made, the operation returns to step S78 to execute the recording for the next line.

On the other hand, if the negative judgement is made, a determination is made at step S68 whether or not the clocking content of the timer $T_2$ exceeds 30 seconds. If the negative judgement is made, the operation transfers to step S69, where if no END signal is entered, the operation returns to step S67. Until the elapse of 30 seconds, this routine is cyclically continued on standby.

If the affirmative judgement is made at step S68, that is, if the state having no recording data exceeds 30 seconds, the operation transfers to step S70, where the idle suction before closing the cap is performed, and then to step S71, where $N_1$ is reset and started. Thereafter, the operation transfers to step S72 to effect wiping, and to step S73 to close the cap 51. Then, at step S74, a determination is made whether or not any END signal is entered. If not, the operation transfers to step S75, where the presence or absence of recording signal is determined. If the negative judgement is made, the operation returns to step S74. Thereby, this routine is cycled until a recording signal arrives, whereby the operation is on standby in the state in which the cap 51 is closed. At step S75, if the affirmative judgement is made, that is, if a recording signal arrives, the cap 51 is opened at step S76. Then, the operation returns to step S63, whereupon the recording is restarted in accordance with a procedure similar to that of the start of recording.

By the way, if a next page instruction is entered at step S85, the idle suction before closing the cap is performed at step S87. At step S88, counter $N_1$ is reset and started again, and at step S89, the wiping operation is performed as shown in FIG. 23.

Then, at step S90, the cap 51 is closed, and at step S91, the recording sheet is exhausted. The operation returns to step S59 to wait for a next recording signal.

Note that if the END signal is detected at step S77 or S74, the end operation of step S92 is executed. This is a processing including the carriage initialize independent idle suction (step S93, S94), the reset of counter $N_1$, the restart (step S95), the wiping (step S96), the closing of cap 51 (step S97), and the exhausting of recording sheet (step S98), as shown in (B) in FIG. 29.

Summarizing the above principal operation, the preliminary discharge is first stated. In this embodiment, the first preliminary discharge is performed after wiping and immediately before starting the recording, and thereafter the preliminary discharge is performed every 30 seconds. Also, when the capping is made on the course of recording (e.g., when no recording signal exists for 30 seconds or longer or when an interruption signal, not shown in the flowchart, is entered), the preliminary discharge is also made after wiping and immediately before restarting the recording.

In this embodiment, the waste ink is left within the cap 51 by the preliminary discharge. Accordingly, in repeating the preliminary discharge, it is necessary to perform the independent idle suction for feeding the ink accumulated within the cap 51 into the waste ink tank 55. This is the independent idle suction as shown in FIG. 25. Fundamentally, when the ink is accumulated within the cap 51 due to repeated preliminary discharges, the cap 51 is closed, or immediately before the cleaning operation is performed, the independent idle suction is performed.

When $N_1$ is equal to or greater than 8, that is, in the document which requires a long recording time, the idle discharge in the middle of a page (c) is performed during the printing, the idle suction immediately before closing the cap (d) is performed immediately before closing the cap, and the idle suction immediately before cleaning is performed before the cleaning operation. Also, when the recording operation is ended, the independent idle suction is carried out at all times.

The principal object of this operation is to prevent securely the ink back flow from the cap to the head in capping or the recovery operation. While in FIG. 25, the independent idle suction is constituted of two suction processes, it will be appreciated that it may be constituted of four suction processes, or the number of suction processes is not limited.

Then, the wiping is necessarily performed before the start of printing and after the cap is opened from the capping state. Further, it is necessarily performed before the closing of cap from the recording state.

The head cartridge 9 discharges the ink through the nozzles onto the recording sheet during the recording, while a considerable amount of ink will adhere to the face plane itself. Therefore, after the recording, the ink is removed from around the periphery of the nozzles on the face plane by wiping to prepare for the next recording, and avoid the ink sticking to the cap 51. Also, it is difficult to avoid slight sticking of the ink to the cap 51 upon the preliminary discharge or the cleaning, even though the contamination of the cap 51 with the ink from the face plane is avoided, as previously described. Accordingly, the ink may often stick on to the face plane when the cap is opened from the capping state. Hence, it is necessary to remove the ink by wiping before the recording.

Figure 26:
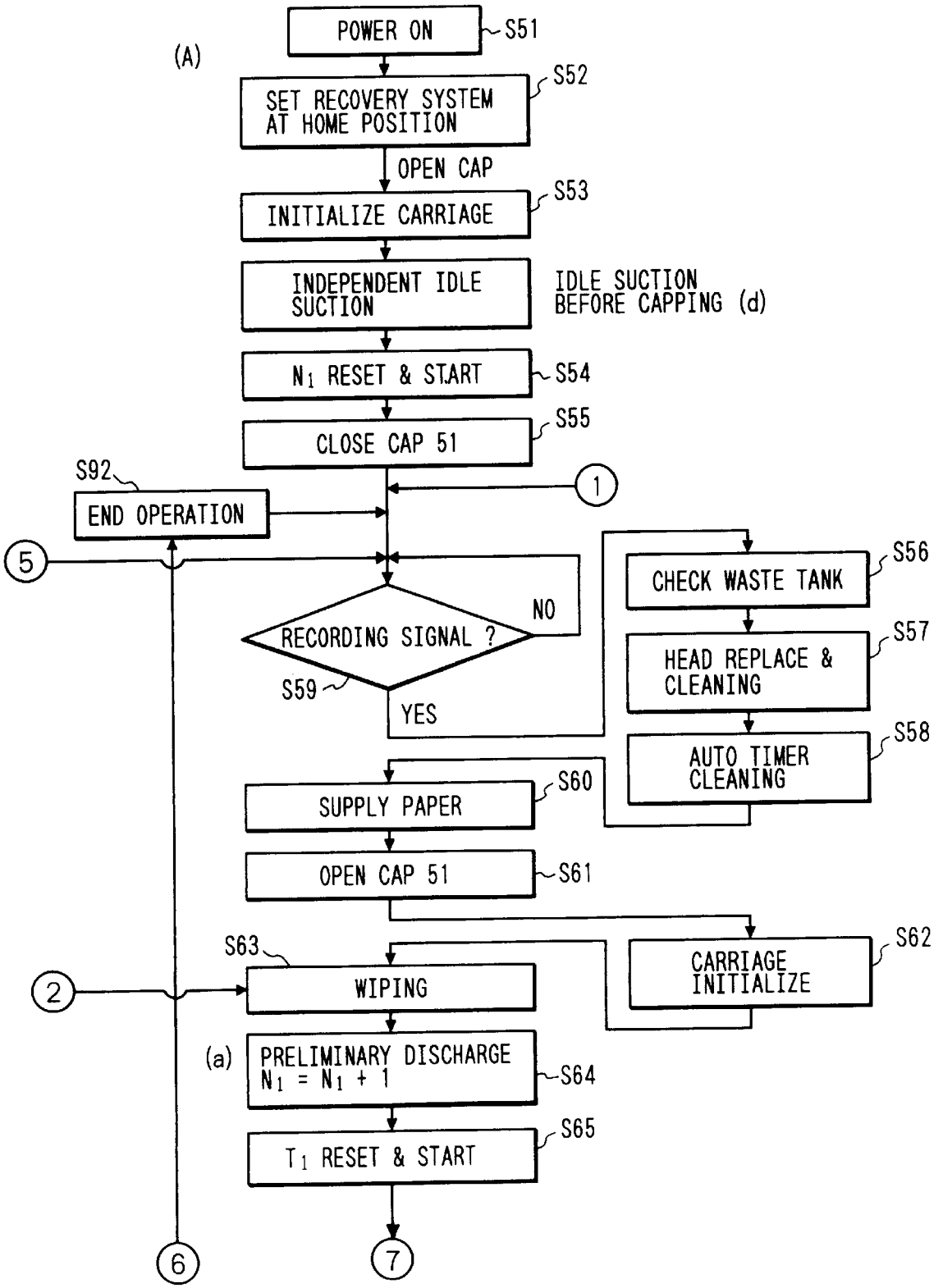
FIGS. 26, 27, 28 and 29 are flowcharts for explaining the operation for record printing processing in the recording apparatus of the present invention.
Figure 27:
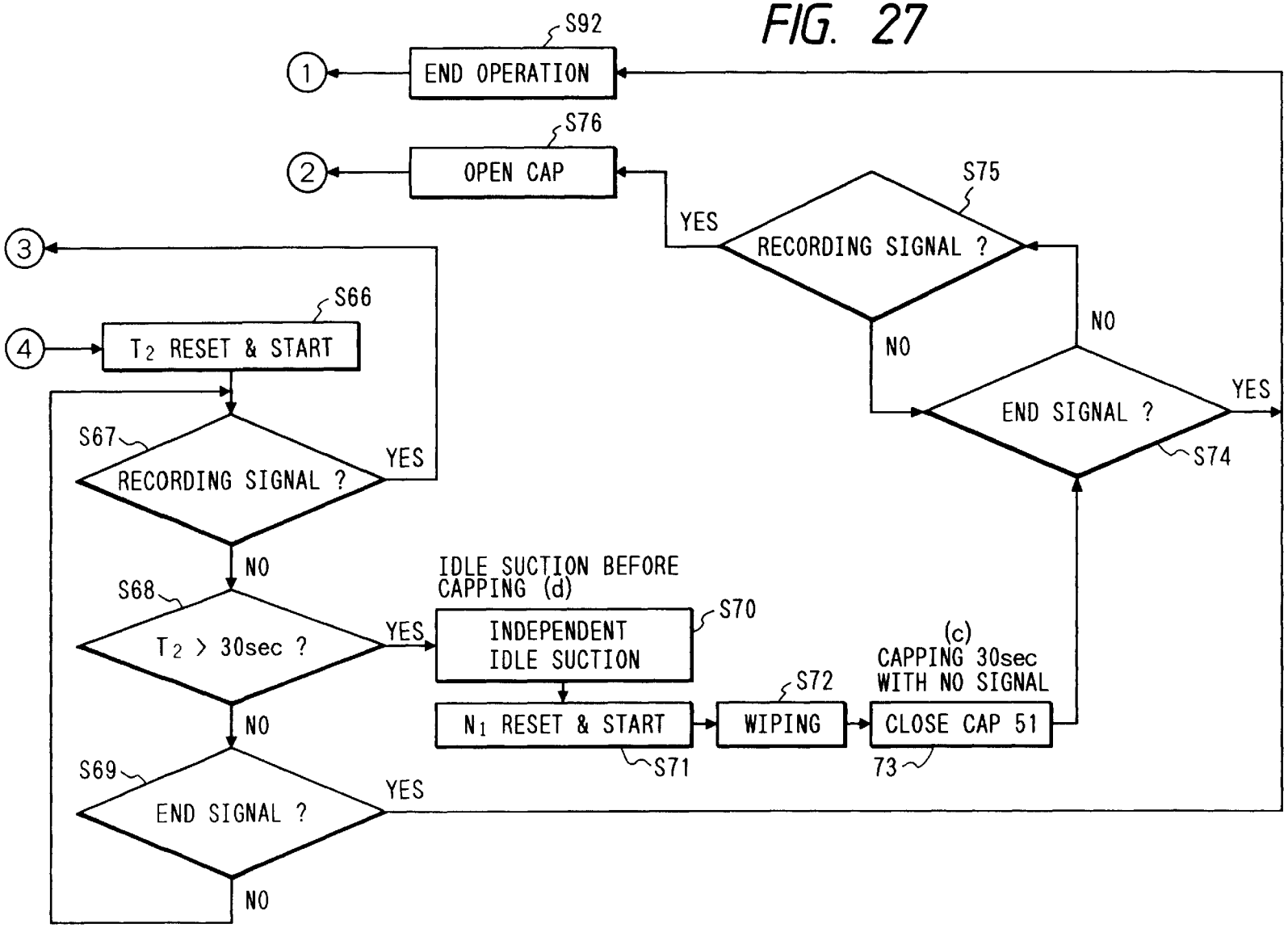
Figure 28:
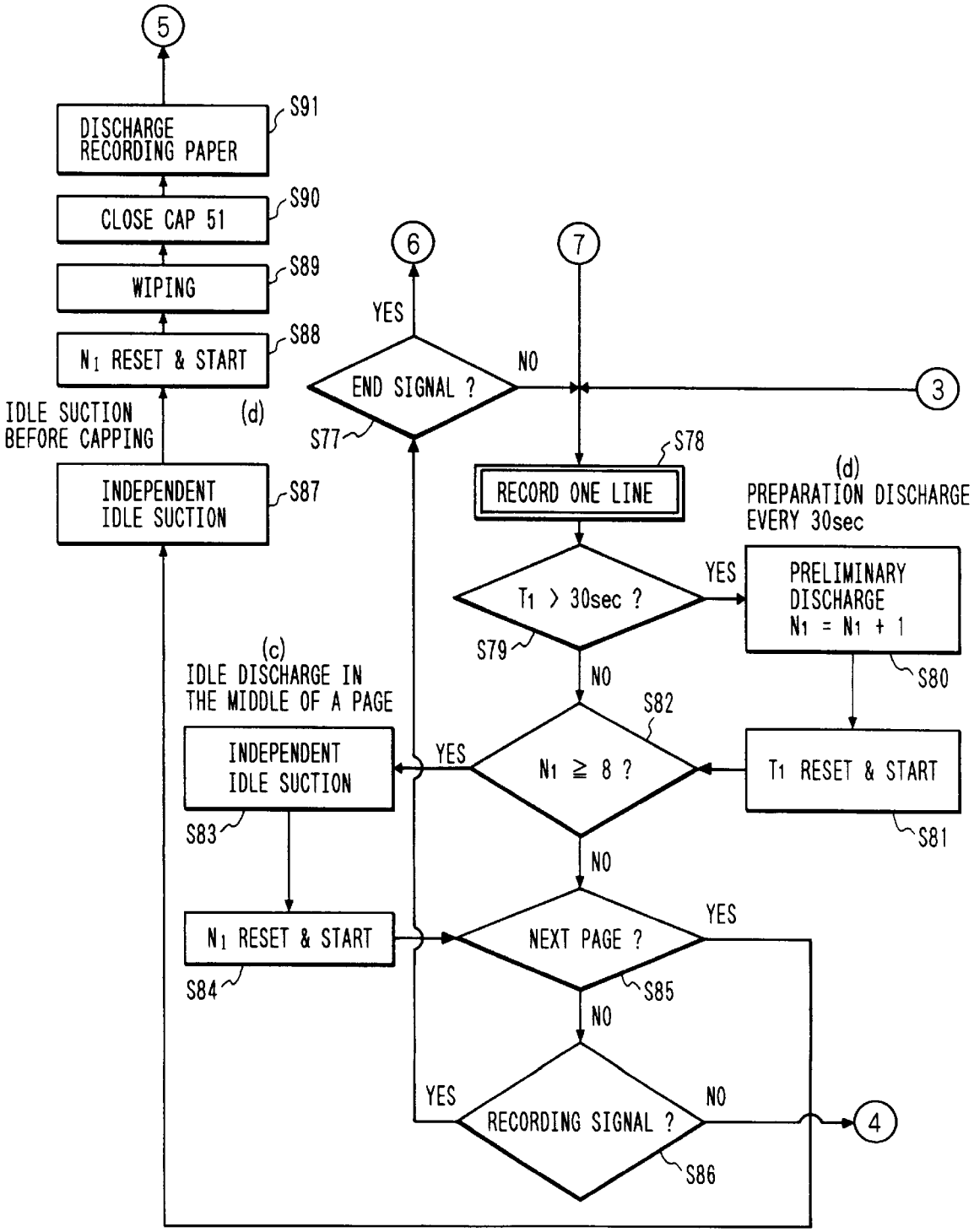
Figure 29:
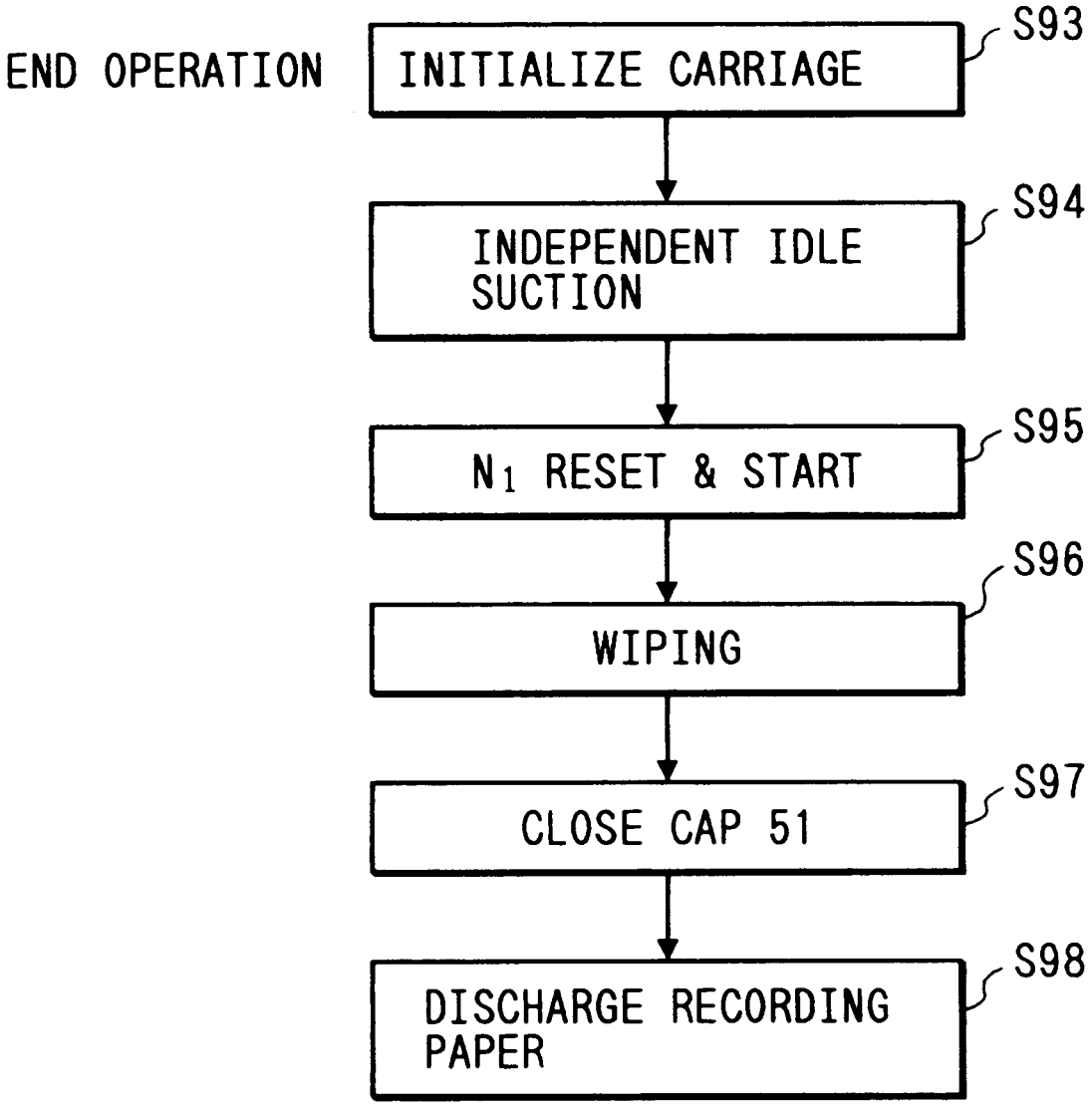

Next, a variety of cleaning operations will be described below, including a waste ink tank state check S56, a head replacement cleaning S57, and an automatic timer cleaning S58, which are performed after step S59 waiting for a recording signal as shown in FIG. 26.

Figure 30:
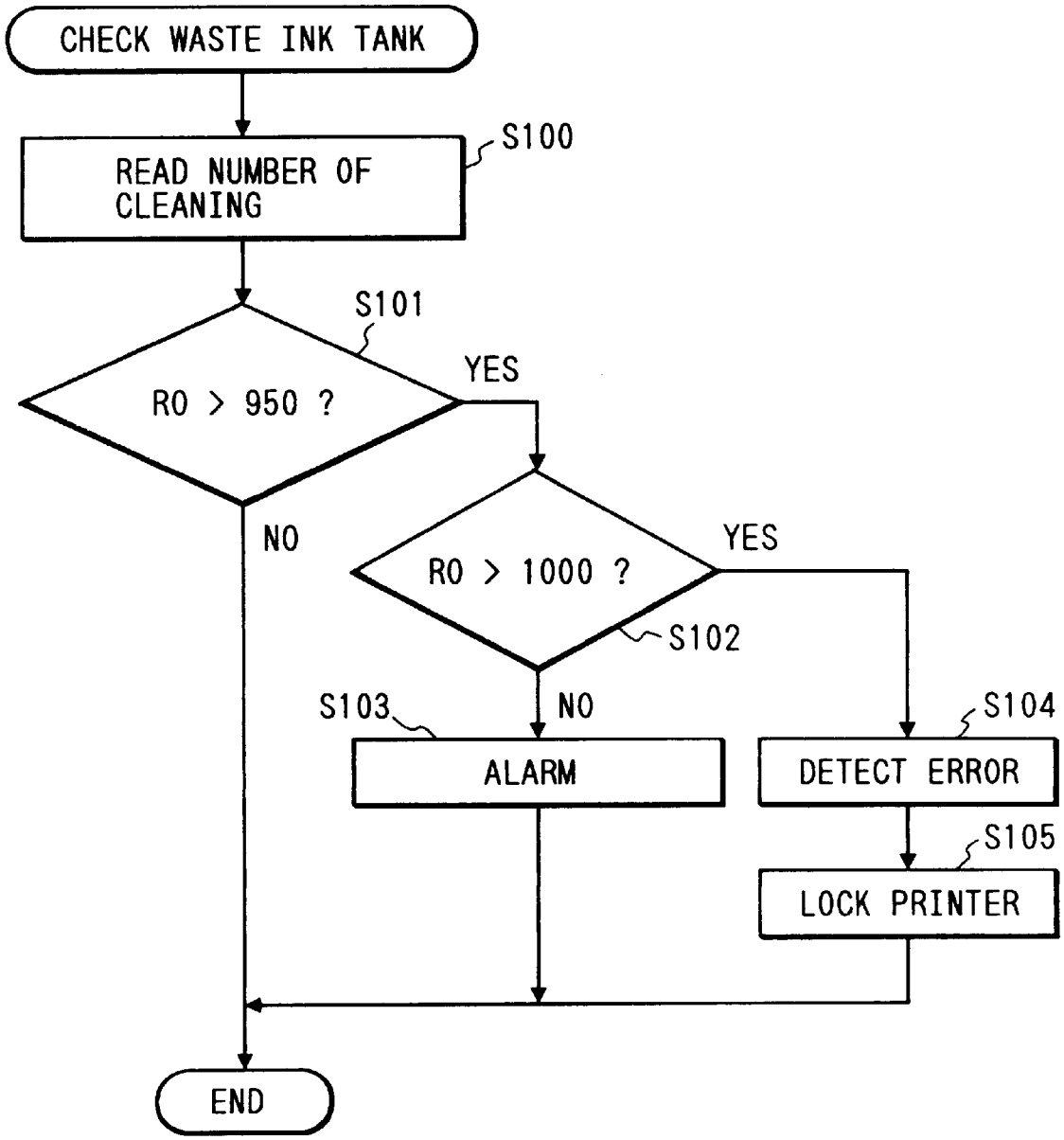
FIG. 30 is a flowchart for checking the waste ink tank state in the recording apparatus according to one embodiment of the present invention.

FIG. 30 is a flowchart for explaining the waste ink tank state check S56. The waste ink tank state check is performed by counting the number of cleaning operations to determine whether or not the ink discharged from the recording head is normally receivable through the discharge recovery processing such as preliminary discharge or suction operation.

Specifically, the allowable number of cleanings is predetermined from the ink discharge amount per cleaning operation and the amount of ink receivable within the waste ink tank, and by comparing the accumulated number R0 of cleaning operations up to the current time with the allowable number, the normal reception of the waste ink is judged to be acceptable or not. In this embodiment, two allowable numbers of cleanings are given, 950 and 1000. The number of cleanings is counted and accumulated every time the cleaning operation of discharging the ink is performed, its result being stored in non-volatile data holding means 1005 such as EEPROM. That is, first, at step S100, the accumulated cleaning number R0 is read out from the data holding means 1005, and then, compared with a first allowable cleaning number at step S101. Herein, since the normal reception of the waste ink is possible if R0 is smaller than the first allowable cleaning number, this routine is terminated (S106).

If R0 is larger at step S201, R0 is compared with a second allowable cleaning number at step S102. Herein, if R0 exceeds the second allowable cleaning number, the occurrence of an abnormal condition is informed to the printer user, and thereafter, the recording operation with the printer is prohibited (steps S104, S105). If R0 is smaller than the second allowable cleaning number at step S102, a warning is issued and the operation is ended.

Figure 31:
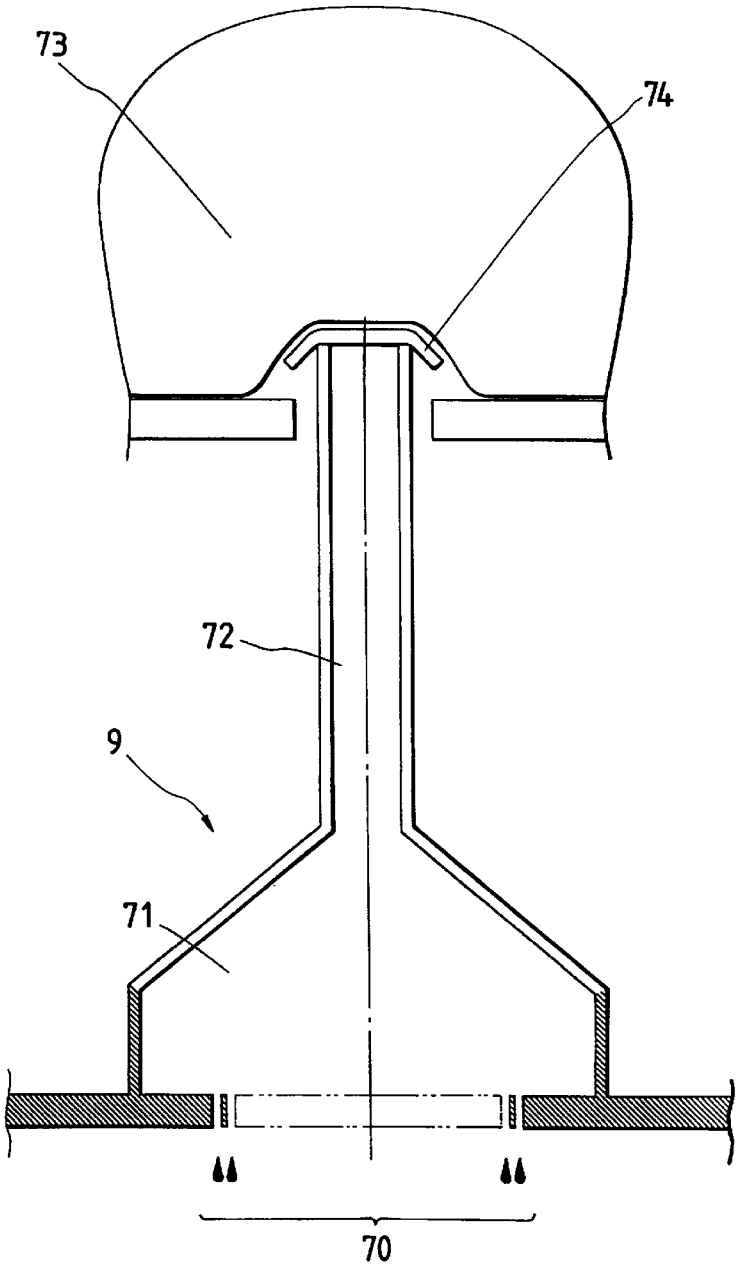
FIG. 31 is a typical view of an ink cartridge having integrally an ink tank for a recording head according to the present invention.

After the waste ink tank state check, the head replacement cleaning operation is entered at step S57. This routine is to perform the cleaning operation before carrying out the recording operation, when the head is used up and a new head is mounted on the printer, in order to prevent damages of the recording operation unless the ink is filled in the nozzles or the liquid chamber of the recording head. FIG. 31 typically shows the constitution of a disposable ink cartridge with the ink tank and the head portion integrated. 70 is a nozzle portion, wherein a heater not shown is disposed for each nozzle and an ink droplet is discharged through the nozzle by conducting to the heater. 71 is a common chamber for temporarily storing the ink to be supplied to each nozzle, and 72 is a tube for connecting the ink tank called a chip tank to the common liquid chamber 71. 73 is a sponge within the ink tank to keep the ink leaking out. 74 is a filter for preventing the dirt or air bubbles from entering the chip tank. When the head cartridge is left away for a long time, air bubbles may enter the ink passage from the filter 74 to the nozzle portion 70, so that the ink passage is expanded and becomes unfilled with the ink. Also, when the vibration is applied to the head cartridge during transportation, the similar state may occur. In such a case, because the heater portion is not filled with the ink, the empty-heating condition may occur by conducting to the heater, so that the bubbling will not normally occur. When the head cartridge is replaced and mounted in order to prevent this empty-heating condition, the cleaning operation at step S57 is performed.

Figure 32:
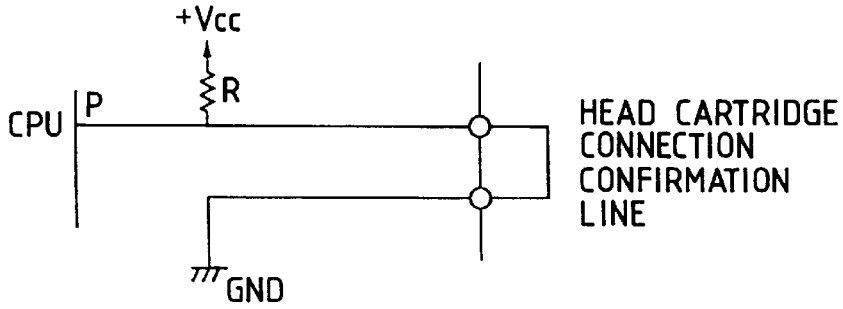
FIG. 32 is an explanation view showing an example of sensing the mounting of the recording head according to the present invention.

The sensing of head replacement is conducted by a CPU 1000 monitoring the electrical contact disposed in the head cartridge in this embodiment, as shown in FIG. 32.

Figure 33:
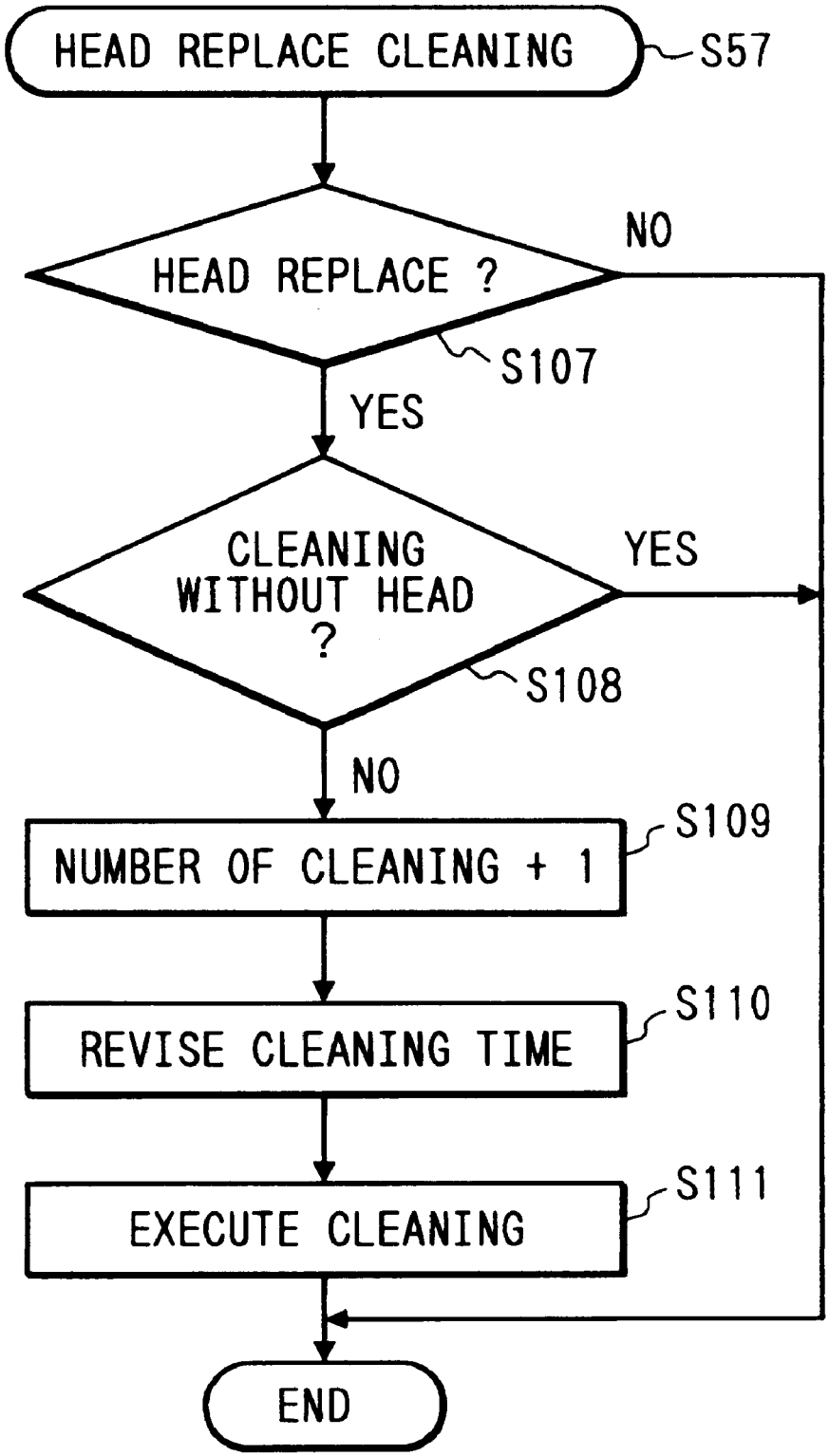
FIG. 33 is a flowchart for explaining the cleaning operation in detaching the recording head according to the present invention.

FIG. 33 shows a flowchart for the head replacement operation of step S57. First, at step S107, a check is made to determine whether or not the head replacement is sensed. If no replacement is sensed, this routine is immediately ended. If replacement is sensed, a check is made to determine whether or not the cleaning operation is made in the head unmounted state at step S108. In this embodiment, if the cleaning operation is performed in the head unmounted state, the head mounted after the cleaning operation is judged to be a mono-color head until the next head replacement is sensed. When the mono-color head is mounted, the head replacement cleaning or the automatic timer cleaning as will be described later is not performed to prevent the color mixture from occurring with the cleaning operation. Accordingly, if the no head cleaning is affirm ed at step S108, this routine is ended. If the negative judgement is made at step S108, the current cleaning number is read out from the non-volatile data holding means and incremented by +1, and then stored again in the non-volatile data holding means 1005 (S109), in order to count the accumulated number of cleaning operations to determine whether the normal ink reception of the waste ink tank is permissible, before the cleaning operation is performed. Then, at step S110, the cleaning execution time in the previous head mounted state stored in the non-volatile data holding means is read out and updated, and then stored again in the non-volatile data holding means, like the cleaning number, for effecting the automatic timer cleaning as will be described later. At step S111, the cleaning operation is performed, and this routine is ended. Then the operation transfers to the automatic timer cleaning of step S58 as shown in FIG. 26.

Figure 34:
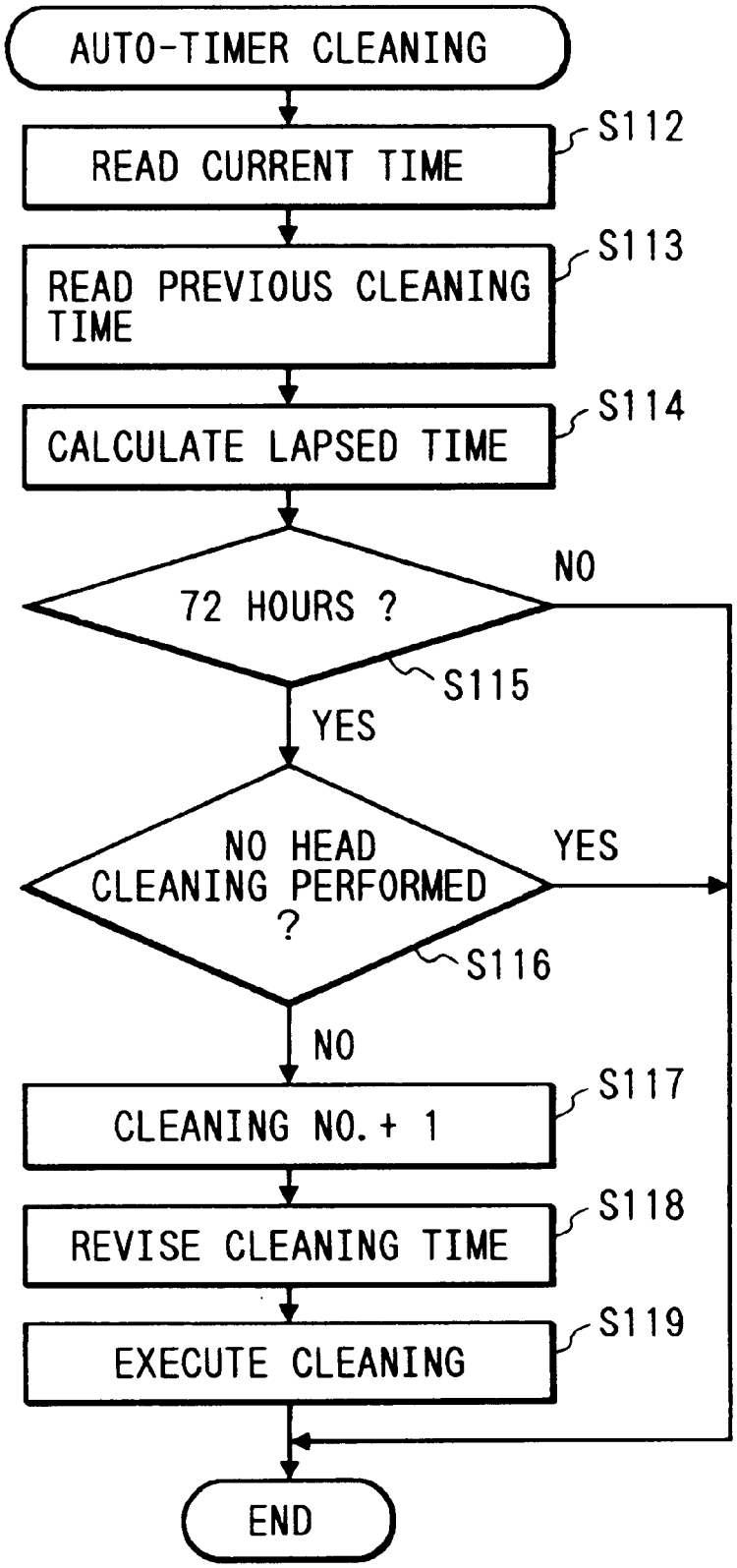
FIG. 34 is a flowchart for explaining an automatic timer cleaning according to the present invention.

FIG. 34 is a flowchart showing the automatic timer cleaning operation. This operation is performed to prevent the empty-heating, because the ink unfilled state may occur when the head remains mounted on the printer for the long time, as previously described. In this embodiment, when the elapse of 72 hours or longer occurs from the previous cleaning time, the cleaning operation is carried out. First, at step S112 and step S113, the current time and the previous cleaning operation time are read out, and at step S114, the elapsed time from the previous cleaning operation is calculated. At step S115, the elapsed time is judged, wherein if the elapsed time is equal to or less than 72 hours, this routine is ended; while if beyond 72 hours, the operation proceeds to step S116. At step S116, a determination is made whether or not the no head cleaning is performed. If the cleaning has been, performed, the operation is ended without cleaning even if 72 hours or greater have passed. If the negative judgement is made at step S116, the number of cleanings is counted at step S117 to determine the ink reception state of the waste ink tank, the cleaning execution time is updated at step S118, and then the cleaning operation is performed at step S119.

Figure 35:
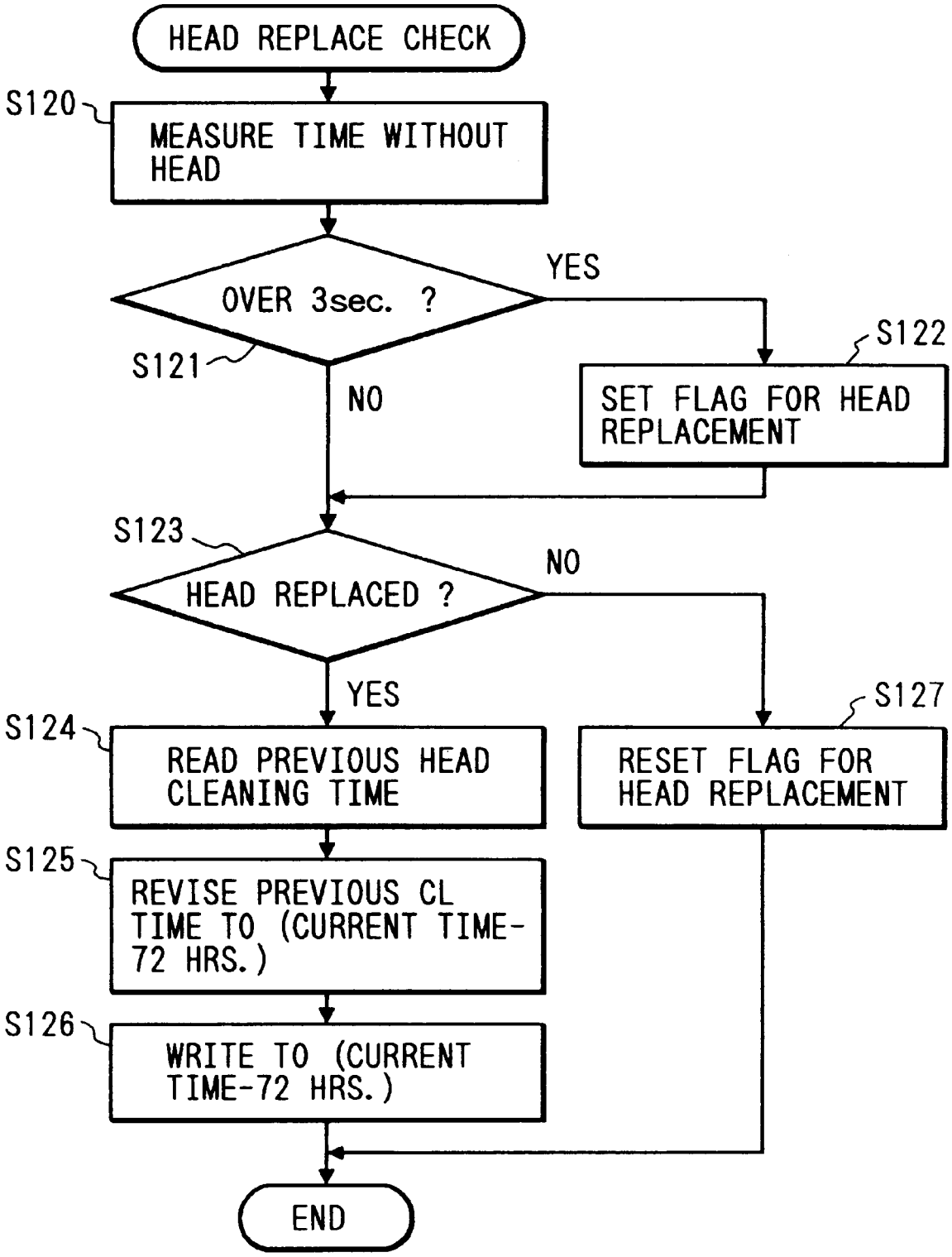
FIG. 35 is a flowchart for explaining the sensing of the mounting of the recording head according to the present invention.

The sensing of the head replacement as described previously will be now described further in detail. In this embodiment, the head replacement is sensed every one second in accordance with a flow as shown in FIG. 35. In FIG. 35, first, at step S120, the head unmounted time is measured. If the head unmounted state is sensed for 3 seconds or longer at step S121, a head replacement flag for the judgement with the CPU is set at step S122, and then the operation proceeds to step S123. At step S123, referencing the head mounted state and the head replacement flag, the affirmative judgement is made if the head replacement flag is set and the head is mounted, wherein the operation proceeding to step S124. At step S124, the previous cleaning execution time is read out, then updated to the current time subtracted by 72 hours for the reason as will be described later at step S125, and stored in the non-volatile data holding means 1005 at step S126. At step S123, if the unmounted time is 2 seconds or less, or if the head is unmounted even with the head replacement flag set, the negative judgement is made, wherein the head replacement flag is reset at step S127, and this routine is ended.

In FIG. 26, the operation including the power-on of the recording apparatus, the replacement of the head cartridge 9, the reception of recording signal, and the paper supply operation of step S64 is considered. After the head is replaced, a recording signal is sent, and the waste ink tank state check at step S56 is performed; the operation transfers to steps S57 and S58 in other then the printer lock as described in FIG. 30. Herein, if the no head cleaning is performed, the head replacement cleaning is performed once, and the operation transfers to step S58. At step S58 where the automatic timer cleaning is performed, if the head is replaced, the affirmative judgement is made at step S115 in FIG. 34, because the cleaning execution time has been updated to the time 72 hours before as described in FIG. 35, whereby the cleaning operation is performed once. That is, if the head replacement is made and the no head cleaning is not performed, two cleaning operations are automatically performed, and then the recording operation is executed. The operation is performed twice to assure the filling state of the ink. If the no head cleaning has been executed, the head is judged to be a mono-color head, and the automatic cleaning operation is not performed to prevent the color mixture.

Next, when the head is replaced, the relation between the cleaning operation or manual cleaning operation and the automatic cleaning operation based on an instruction of the user will be described below.

Figure 36:
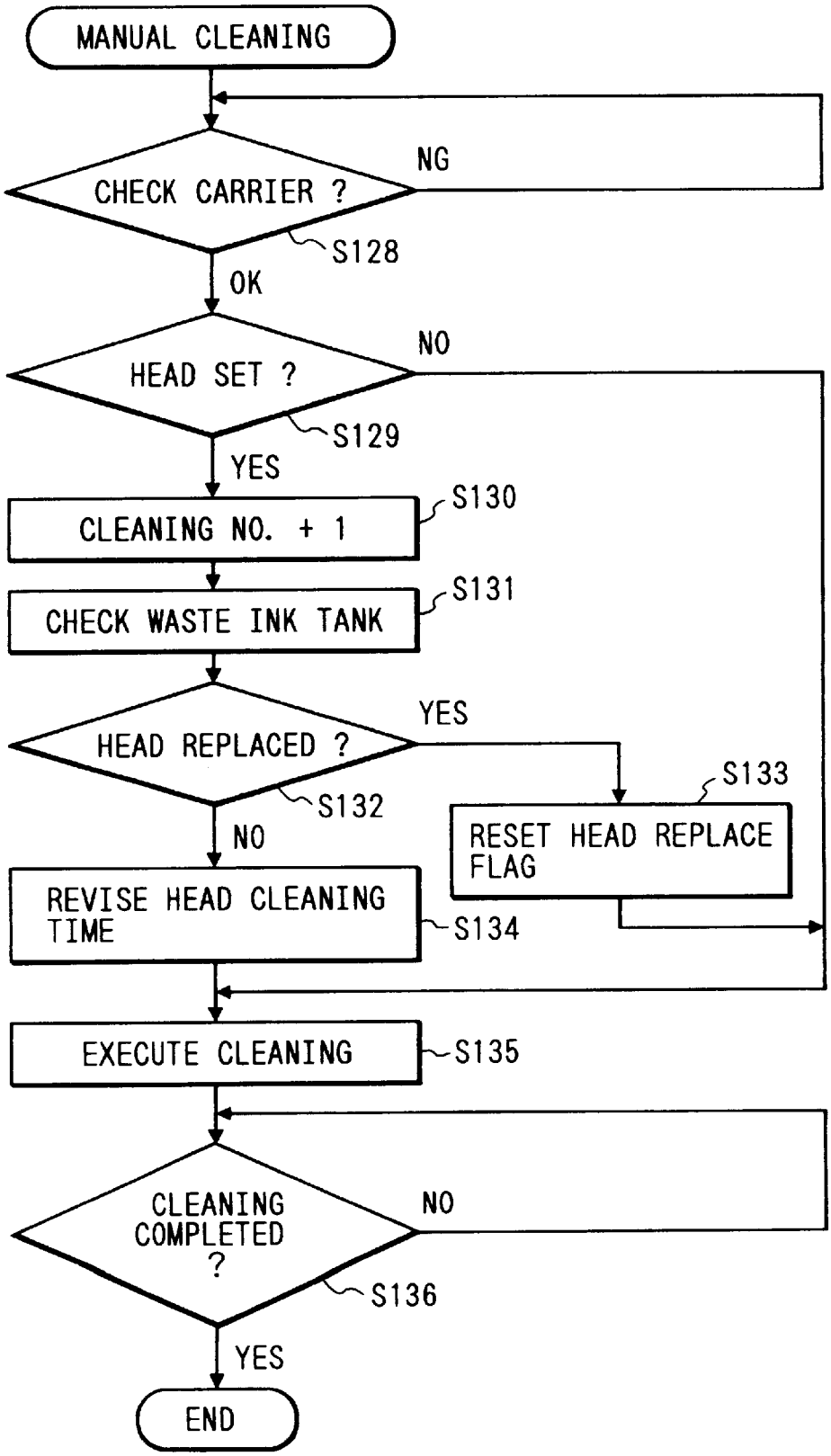
FIG. 36 is a flowchart for explaining a manual cleaning according to the present invention.

First, FIG. 36 is a flowchart showing the manual cleaning operation. In order to start the cleaning operation, a check is first made to determine whether or not the carrier is moving at step S128. If it is moving, the operation waits for the end of carrier movement. Then, at step S129, the head mounted state is checked. If the head is unmounted, the cleaning operation is directly performed. If the head is mounted, the accumulated number of cleaning is counted at step S130, and the waste ink tank state check is made at step S131. Then, the presence or absence of head replacement is determined by referring to the head replacement flag as described at step S122, and if that flag is not set, the operation proceeds to step S134, where the cleaning time is updated. And the cleaning operation is performed. At step S132, if the replacement is set, the affirmative judgement is made, and at step S133, the replacement flag is reset. And the operation transfers to step S135 for the cleaning operation without updating the cleaning time.

With such constitution, an instance where after the head replacement, the manual cleaning by the, user is performed once, and thereafter a recording signal is sent will be described below. First, the head replacement flag is set at step S122 by a head replacement check routine as shown in FIG. 35, and the cleaning time is updated to the time 72 hours before the current time at steps S224, S225 and S226. Herein, when the manual cleaning is performed, the affirmative judgement is made at step S132, because the head replacement flag has been set, as shown in FIG. 36. And the replacement flag is reset and the cleaning operation is performed. Then, the waste ink tank check of step S56 as shown in FIG. 26 is made, and the head replacement cleaning of step S57 is performed. Herein, because the head replacement flag has been reset in the previous manual cleaning, the cleaning is not performed. Then, at step S58, the automatic timer cleaning is performed. Herein, because the cleaning time is updated to the time 72 hours before, as previously described, the affirmative judgement is made at step S115, and the cleaning operation is performed. Accordingly, after two cleaning operations in total are performed, the recording operation is carried out.

Next, an instance where two manual cleanings are performed by the user after the replacement of the head will be described below. The first manual cleaning is performed as in the previous example, but in the second manual cleaning, the negative judgement is made,, because the replacement flag has been reset at step S132, the cleaning time is updated at step S134. and the cleaning operation is executed. Thereafter, the operation transfers to steps S56, S57 and S58 as shown in FIG. 26. At step S57, the cleaning is not executed, because the head replacement flag has been reset. Further, at step S58, the cleaning is not performed, because the cleaning execution time has been updated in the previous manual cleaning. Accordingly, when two manual cleanings are performed, and the recording operation is carried out.

Summarizing the above operation, firstly, when the head is mounted after the no head cleaning is performed, the automatic cleaning operation is not performed. On the other hand, when the head replacement is performed without the no head cleaning, the manual cleaning is performed once, and then the automatic cleaning is further performed once; when the manual cleaning is performed twice, the automatic cleaning is not performed; when the manual cleaning is not performed, the cleaning is automatically performed twice. Accordingly, two cleaning operations are necessarily performed before the recording operation.

In the above explanation, two cleaning operations after the head replacement are set, but it will be appreciated that the other number may be set, as required. Also, in the case of the mono-color head, the cleaning is not performed and only the black head is cleaned, but this setting is not so limitative. For example, among the same black heads, there are some heads liable to unfilling of the ink due to the dispersion on manufacturing, for which head judging means further provided. Herein, when a head unliable to unfilling of the ink is mounted, the cleaning is not performed; when a head liable to unfilling of the ink is mounted, the cleaning is performed.

Further, in this recording apparatus, using discharge control means as proposed by the present applicant, the ambient temperature and the energy amount applied to the recording head for a predetermined period in the past are detected, and the ink discharge control of the recording head is made based on the detected result. When the head replacement is sensed, the applied energy amount is judged for another head mounted, and the reset is done.

Figures 37, 37A:
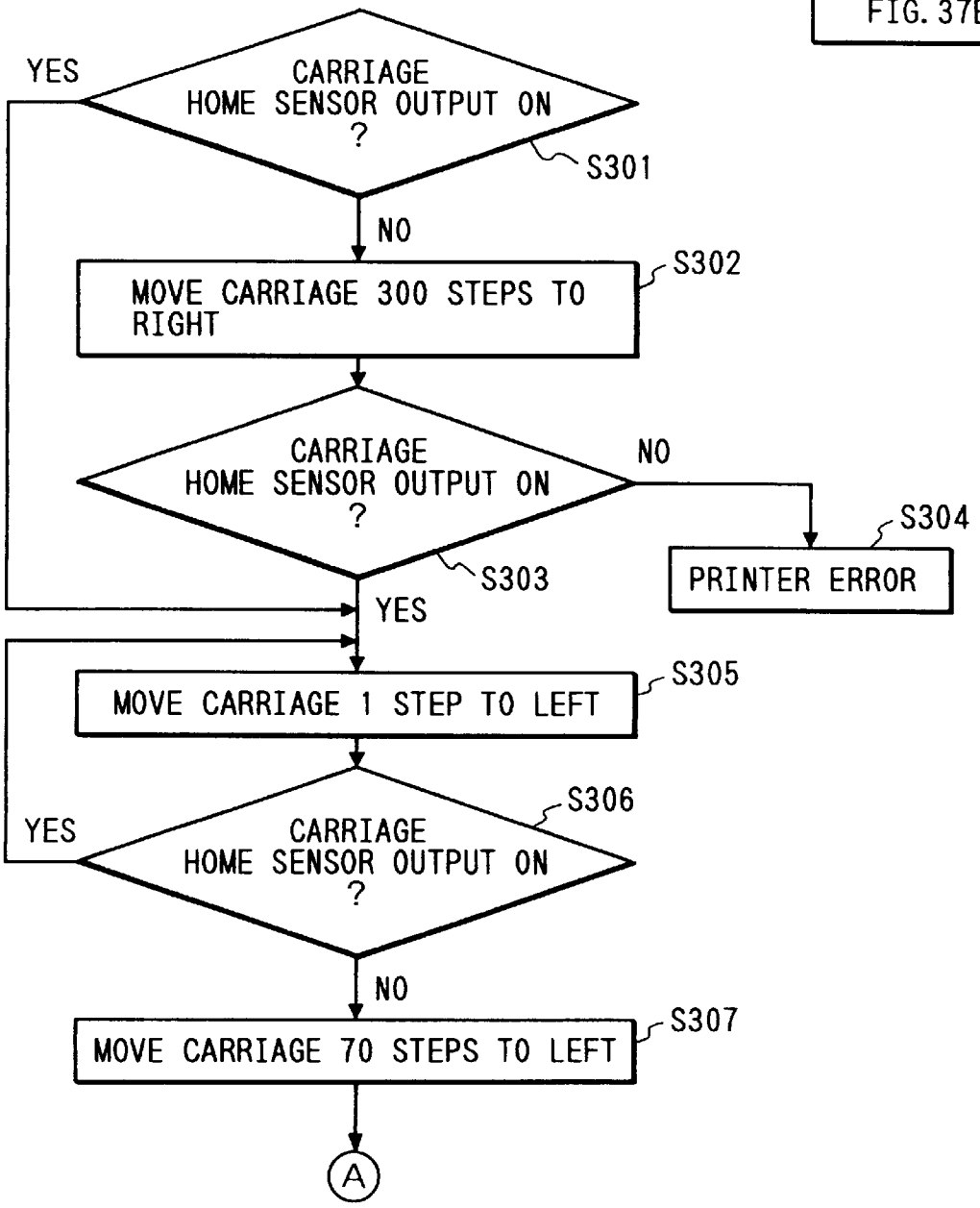
FIG. 37 is comprised of FIGS. 37A and 37B showing flowcharts for explaining the initialization of a carriage for the recording apparatus according to the present invention.
Figure 37B:
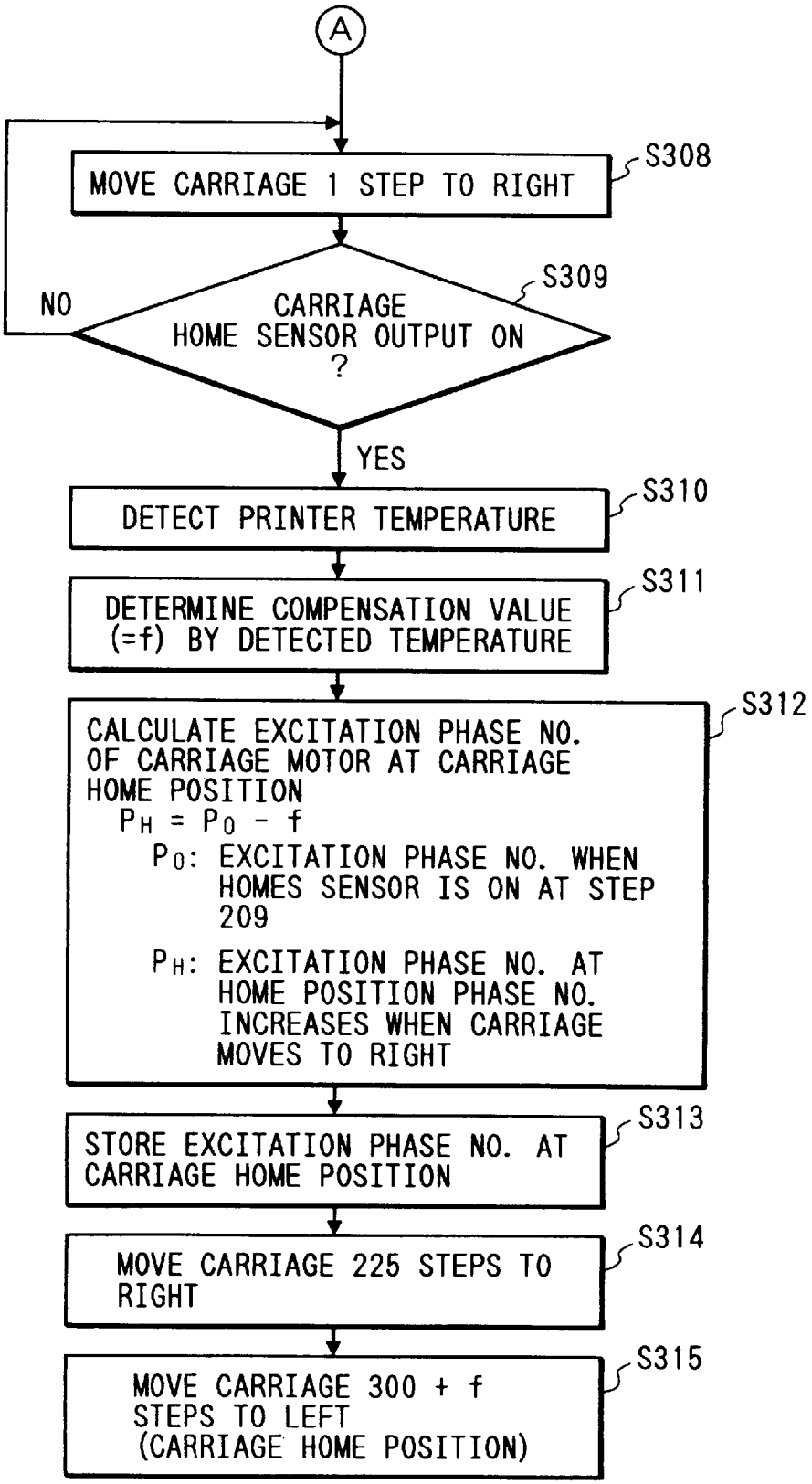

Then, the carriage initialization will be described below with reference to the flowchart of FIGS. 37A and 37B.

Figures 38, 40:
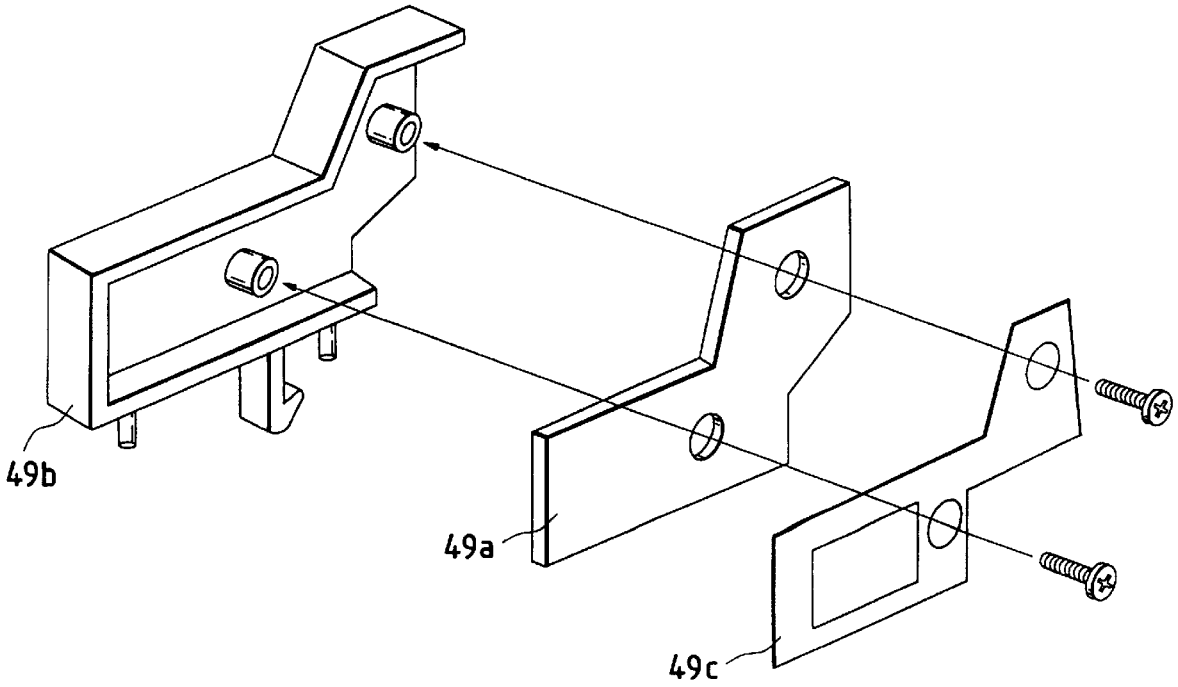
FIG. 38 is a compensation table for compensating the home position of the carriage for the recording apparatus according to the present invention.
FIG. 40 is an exploded perspective view of a wiper cleaner unit for a conventional recording apparatus.
Figure 39:
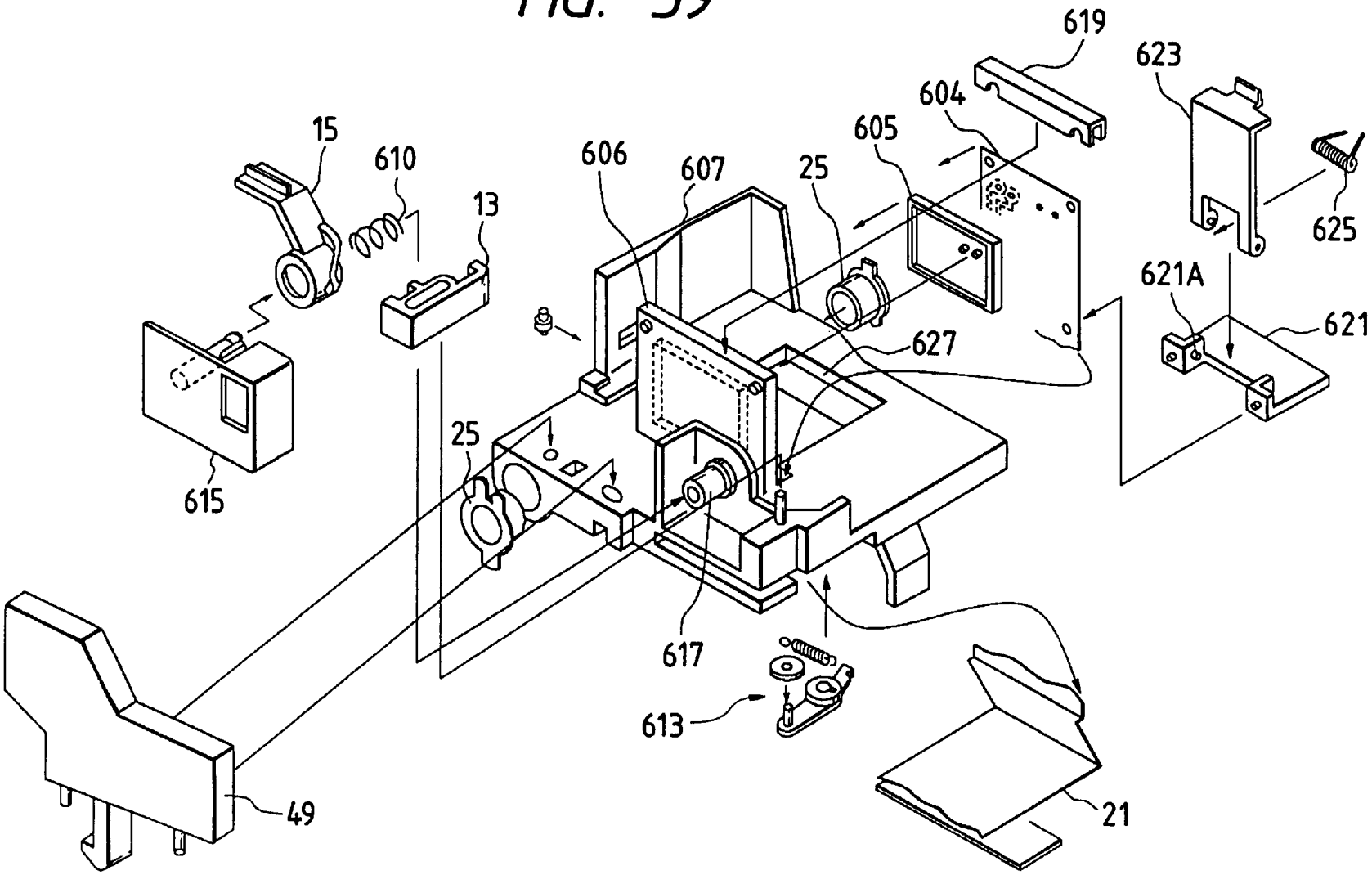
FIG. 39 is an exploded perspective view of the carriage for a conventional recording apparatus having a wiper cleaner.
Figure 41:
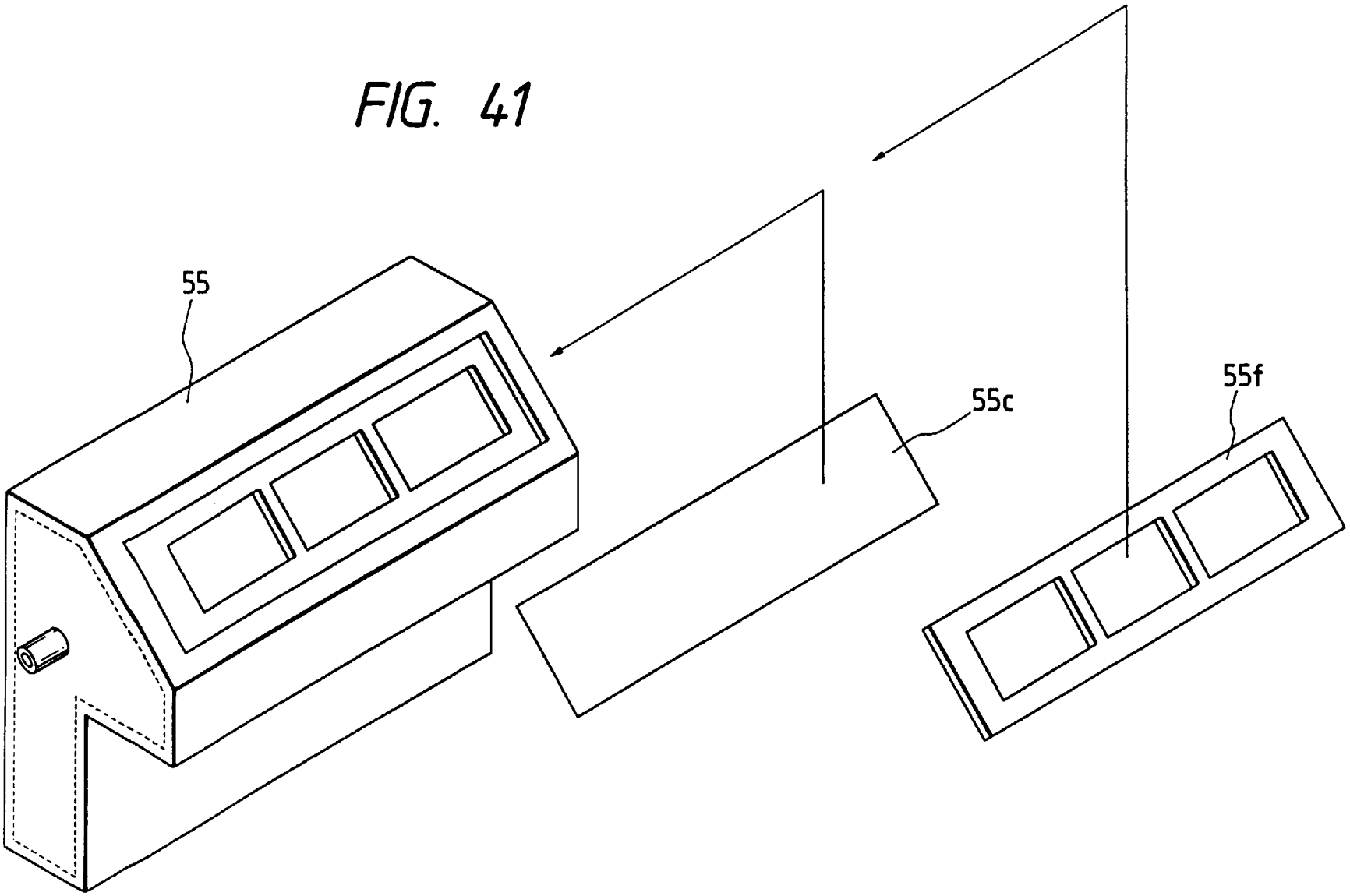
FIG. 41 is an exploded perspective view of a conventional waste ink tank having a breathable film.
Figure 42:
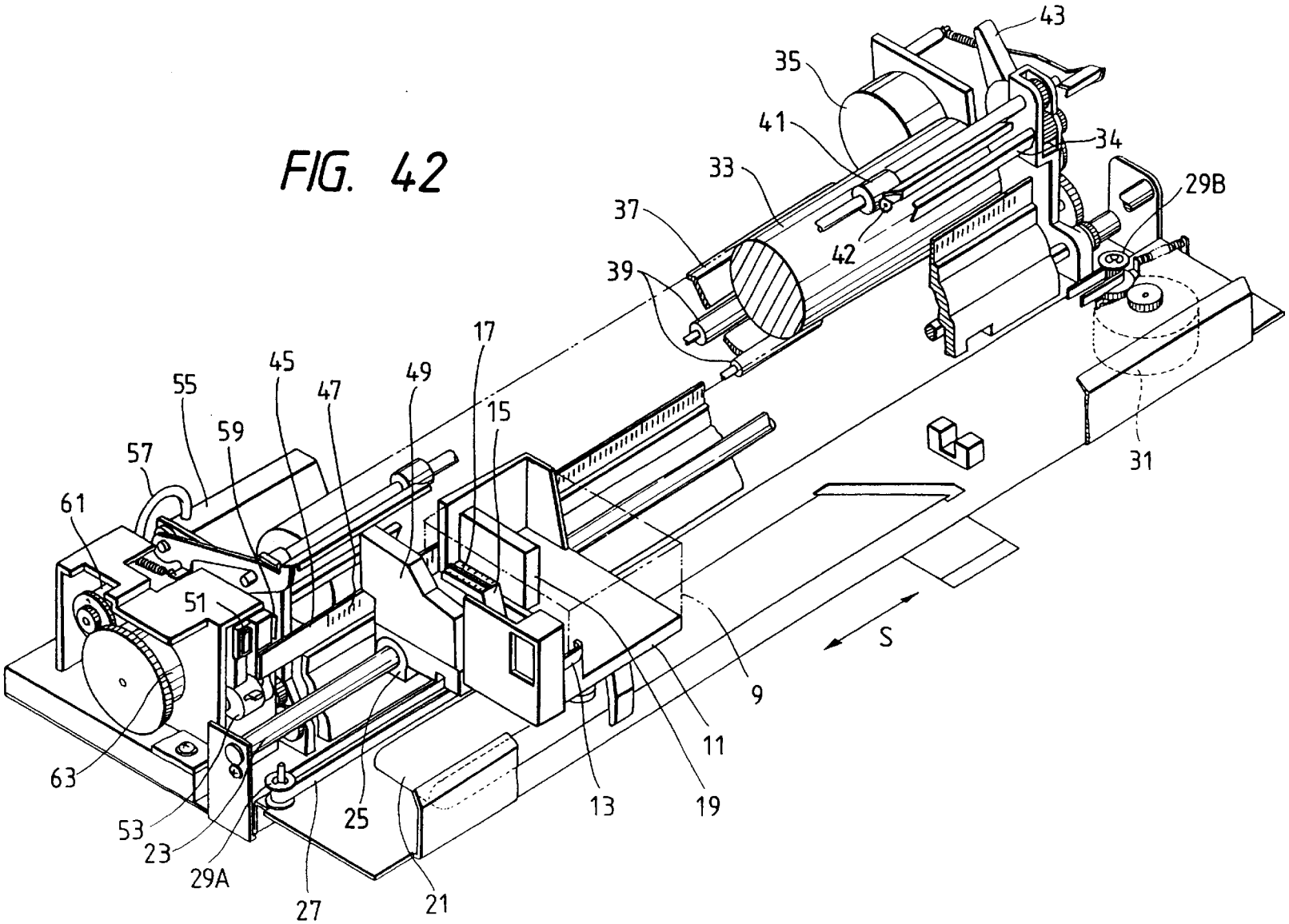
FIG. 42 is an external perspective view of the conventional recording apparatus.
Figure 43:
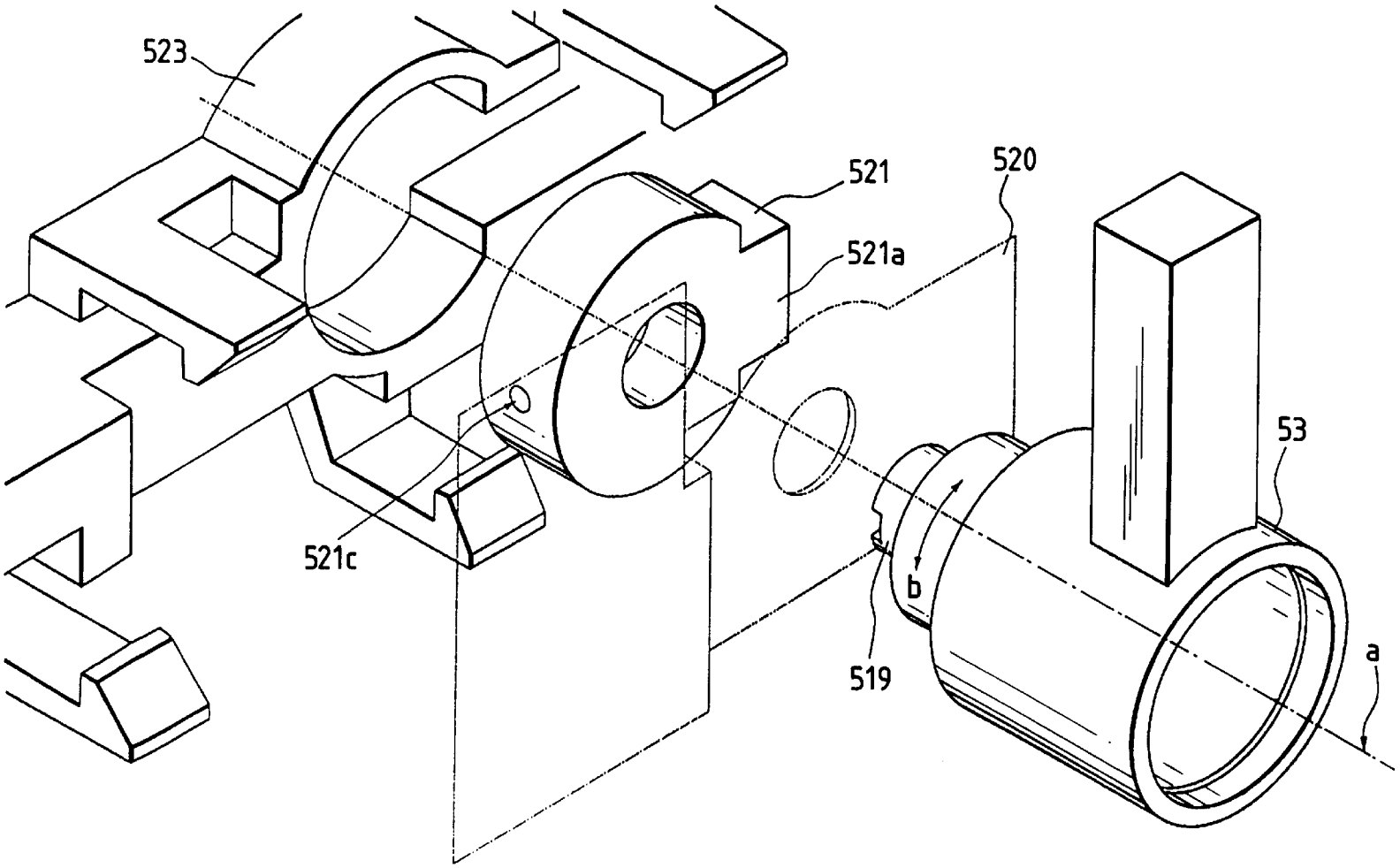
FIG. 43 is an exploded detailed perspective view of a waste ink seal for the conventional recording apparatus.
Figure 44:
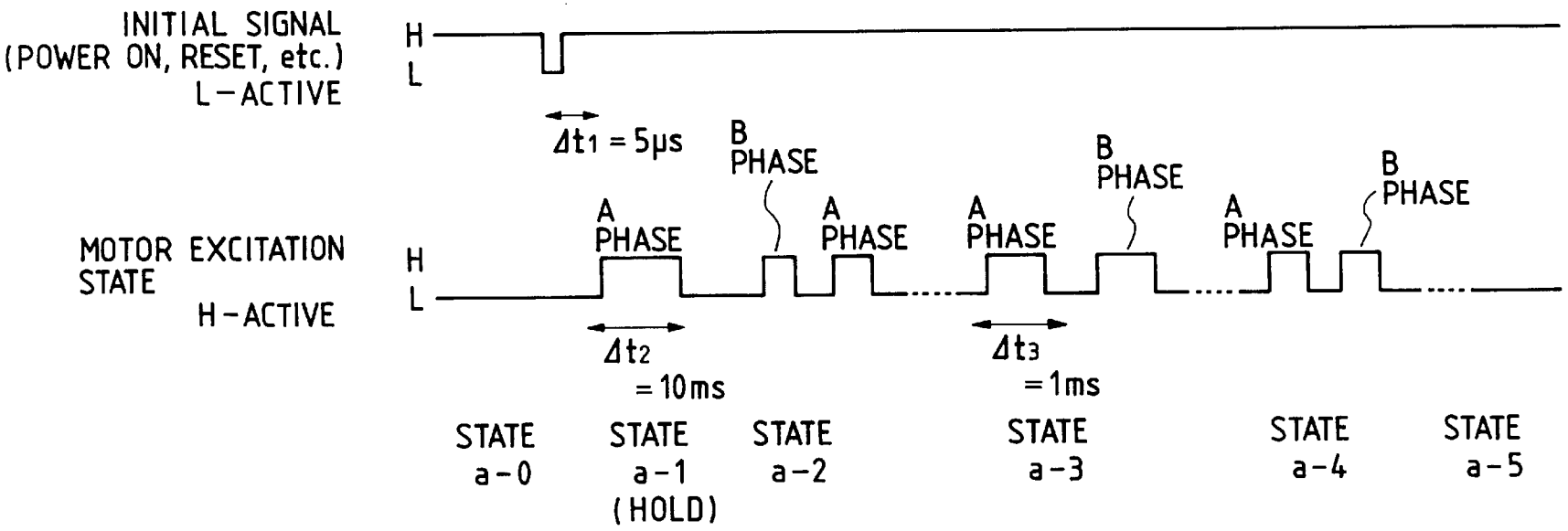
FIG. 44 is a time chart representing the initial operation of a conventional motor.

First, at step S301, the output of a carriage home sensor 67 is judged to be on or off. In this embodiment, the carriage home sensor 67 is a transmission type optical sensor, which is turned on when a light shielding plate (not shown) formed integrally with the carriage does not interrupt the light path of the sensor 67, or otherwise turned off, that is, turned on when the carriage 11 is located at the home position (or capping position), or turned off during the printing. The operation transfers to step S305 in the on state, or to step S302 in the off state, where the carriage 11 is moved to right 300 steps for the sensor to be positively turned on. Herein, the step as a unit movement of the carriage is a drive unit of the carriage motor 31 which is a stepping motor for driving the carriage (one step for the movement amount of driving motor in this embodiment is substantially equal to 0.070 mm). At step S303, the output of a carriage home sensor 67 is judged to be on or off. If the sensor output is off at step S303, the carriage home sensor is abnormal, a printer error is displayed at step S304, and the operation is interrupted. If the sensor output is on at step S303, the carriage 11 is moved one step to left at step S305, and the output of the carriage home sensor 67 is judged to be on or off at step S306. If the sensor output is on at step S306, the operation transfers to step S305, while if it is off, the operation transfers to step S307, where the carriage is moved 70 steps to left. At step S308, the carriage is moved again one step to right. At step S309, the output of the carriage home sensor 67 is judged to be on or off. If the sensor output is off at step S309, the operation transfers to step S308, while if it is on at step S309, the operation transfers to step S310, where the printer temperature is detected by temperature detecting means (not shown) such as a thermistor. At step S311, the carriage home position compensation value f at the detected temerature is obtained from a table as shown in FIG. 38. And at step S312, the excitation phase No. $P_H$ of the carriage motor at the carriage home position is calculated, and at step S313, the carriage motor excitation phase No. $P_H$ at the carriage home position is stored in the non-volatile date holding means 1005 such as EEPROM. Then, at step S314, the carriage is moved 225 steps to right, and at step S315, reversely, the carriage 11 is moved 300+f steps to left, whereby the carriage initialization is ended. By setting the carriage stop position at this time a carriage home position (capping position), it is possible to correct for the expansion or contraction of the chassis/carriage 11/recovery unit (see FIGS. 6A and 6B) due to printer temperature changes, and the dimensional variation from the on position of the carriage home sensor 67 to the carriage home position (or capping position) due to sensitivity changes of the carriage home sensor 67, whereby the capping is securely performed.

In this embodiment, the carriage initialization is effected at the power on, before printing of each page, before capping, and before cleaning. However, it is not performed before the capping and cleaning during the printing of one page. With the above, the carriage initialization is necessarily effected if the head cartridge has been left away for a long time in the capped state, whereby the head cartridge is by no means left away for the long time without being capped by any accident.

In this embodiment, the position at which the carriage 11 is moved 75 steps to left from the on position of the carriage home sensor 67 is designed to be a home position of the carriage.

In this embodiment, the carriage motor makes the driving at six times a mechanical resolution provided for the motor by electrically enhancing it, which is called a micro-step driving. Conventionally, the excitation phase in restarting the driving of the motor was initiated from the stable phase (i.e., a phase resolved at mechanical resolution) closest to the excitation phase $P_H$ at the carriage home position (i.e., capping position), but the driving amount at the first excitation was larger than the normal driving amount, depending on the positional relation between $P_H$ and the stable phase, which caused impact noise. Thus, when redriving the carriage 11 from the standby state of the carriage 11 at the carriage home position, with the power on, it is necessary to start the driving from the stop phase No. $P_H$ of the carriage motor 31 stored in EEPROM at step S313, whereby the occurrence of impact noise can be suppressed.

Embodiment 2

Figure 46:
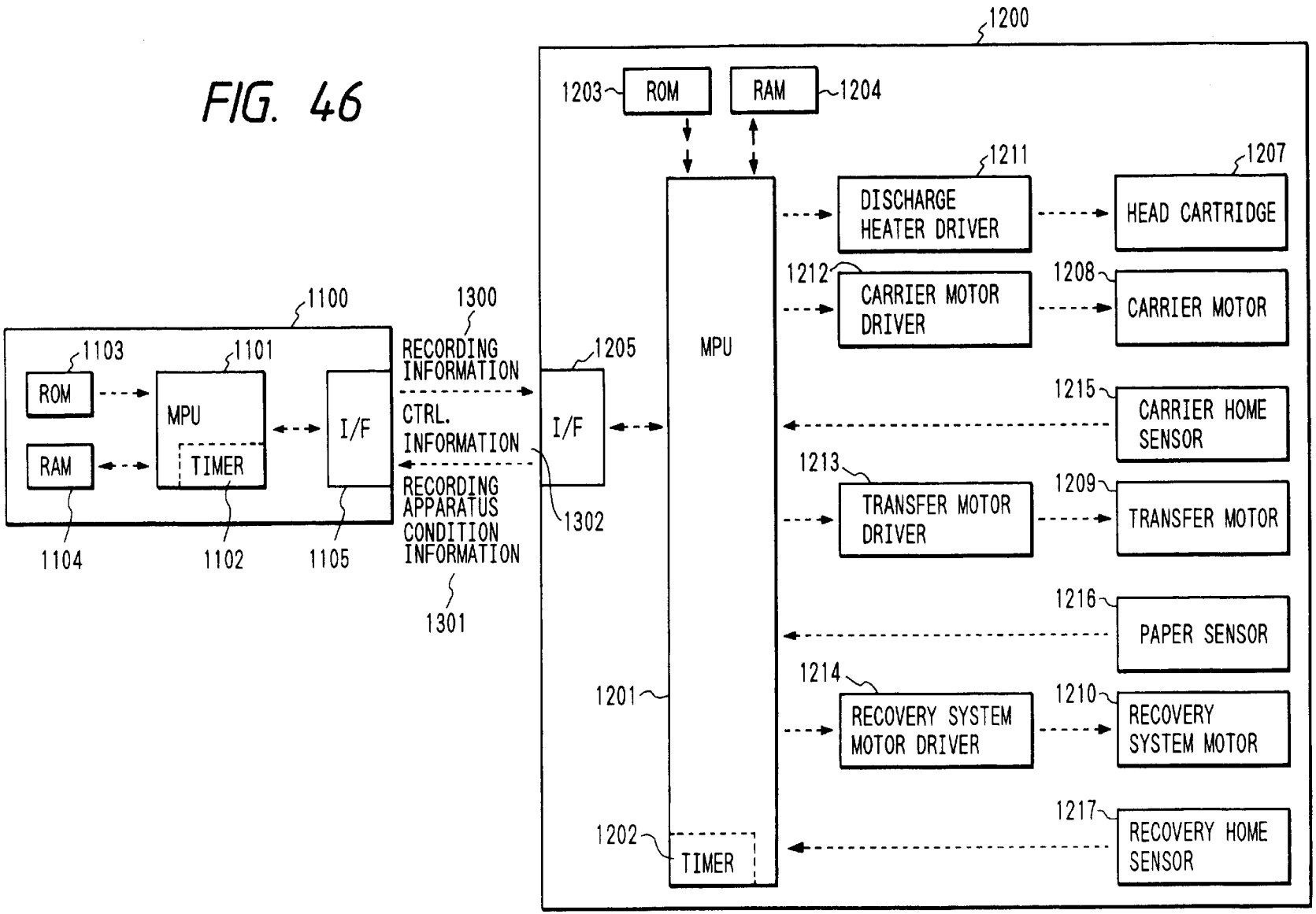
FIG. 46 is a block diagram of the control blocks for the recording apparatus and its surrounding, showing a second embodiment.

FIG. 46 is a control block diagram of a recording apparatus and a host connected thereto. Herein, 1100 is a host machine such as a computer or word processor. 1101 is an MPU for controlling the whole of the host machine 1100, having a timer 1102 for clocking in the control operation. This host machine 1100 is controlled by a program contained within a ROM 1103. 1104 is a RAM for use as the work area when the control is performed. 1105 is an interface portion for sending the recording information 1300 to a recording apparatus 1200, or for receiving the state information 1301 of recording apparatus such as no recording sheet condition from the recording apparatus 1200. By the way, it will be appreciated that the ROM 1103 and the RAM 1104 may be contained within the MPU 1101.

Also, the recording apparatus 1200, like the host machine 1100, has a MPU 1201, a timer 1202, a ROM 1203, a RAM 1204, and an interface portion 1205 for controlling the recording apparatus.

In the recording, the recording information 1300 sent from the MPU 1101 of the host machine 1100 is sent or received via the interface portion 1105, 1205, and stored in the RAM 1204 of the recording apparatus 1200. Thereafter, each portion of the recording apparatus 1200 is controlled by the MPU 1201 and the timer 1202 to carry out the recording. Also, the control information 1302 such as an initial signal is sent or received through the same path. In the recording with the recording apparatus 1200, the head cartridge 1207, the carrier motor 1208, the transport motor 1209, and the recovery motor 1210 are controlled by the MPU 1201, the head cartridge 1207 is driven by a discharge heater driver 1211, and the carrier motor 1208, the transport motor 1209, and the recovery motor 1210 are driven by the motor drivers 1212, 1213, 1214, respectively. Also, based on the detection with a carrier home sensor 1215, a sheet sensor 1216, and a recovery home sensor 1217, the MPU 1201 recognizes the position of the carriage 11, the presence or absence of sheet, and the cap position, as shown in FIG. 1. In the above form, the MPU 1101 of the host 1100 makes the controls of the recording apparatus 1200, but it is no problem that the MPU 1201 of the recording apparatus 1200 does not exist, that is, the first embodiment of the control block diagram of the recording apparatus as shown in FIG. 21 may be adopted.

Figure 45:
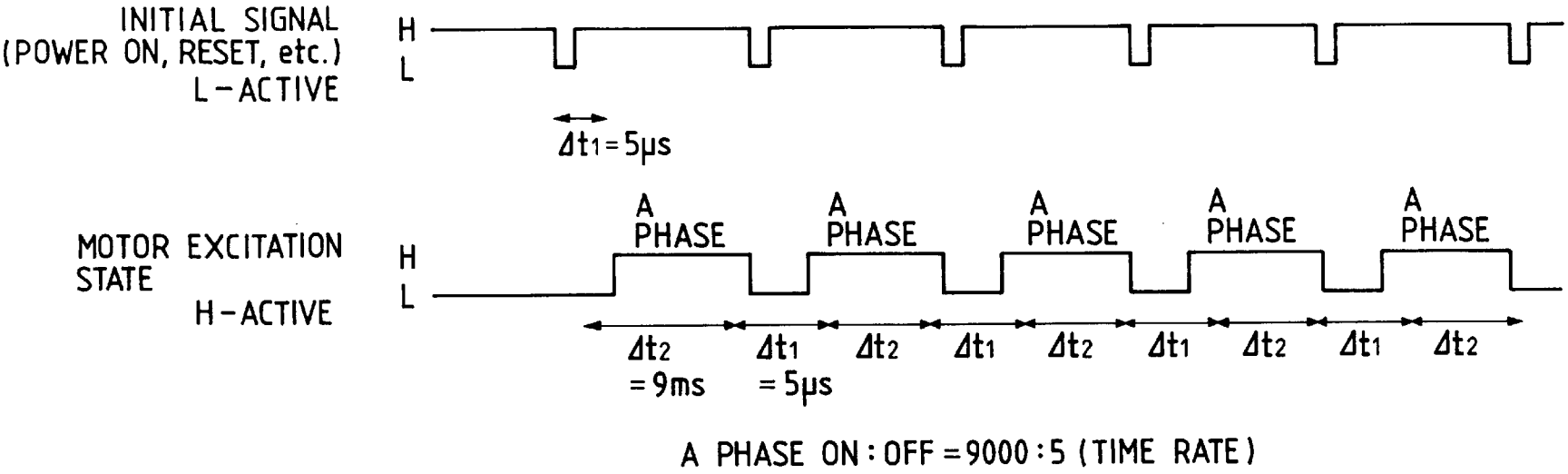
FIG. 45 is a time chart relating to the initial operation of motor required to indicate a conventional problem.
Figure 47:
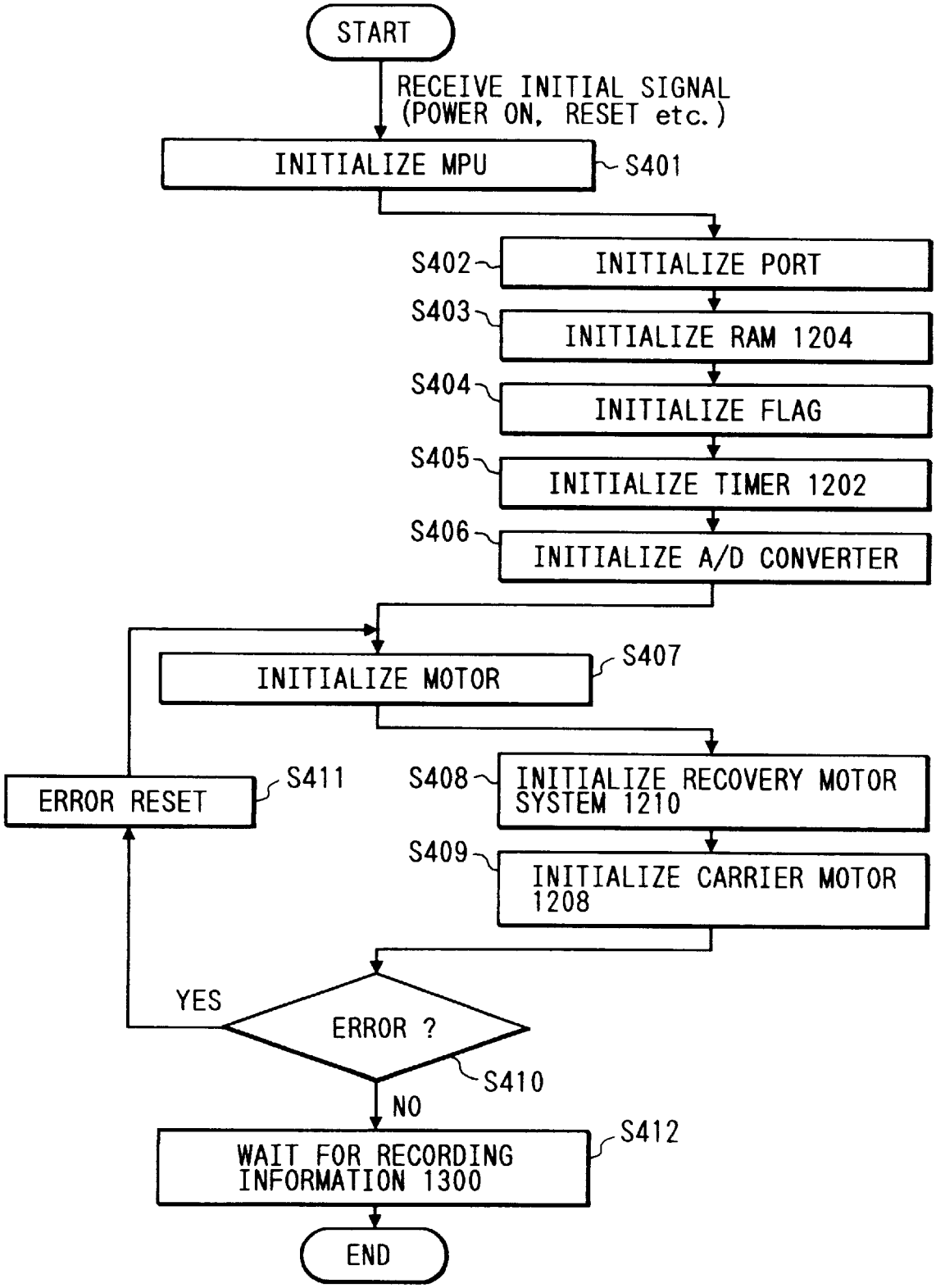
FIG. 47 is a flowchart showing the initial operation of the recording apparatus when receiving an initial signal.
Figure 48:
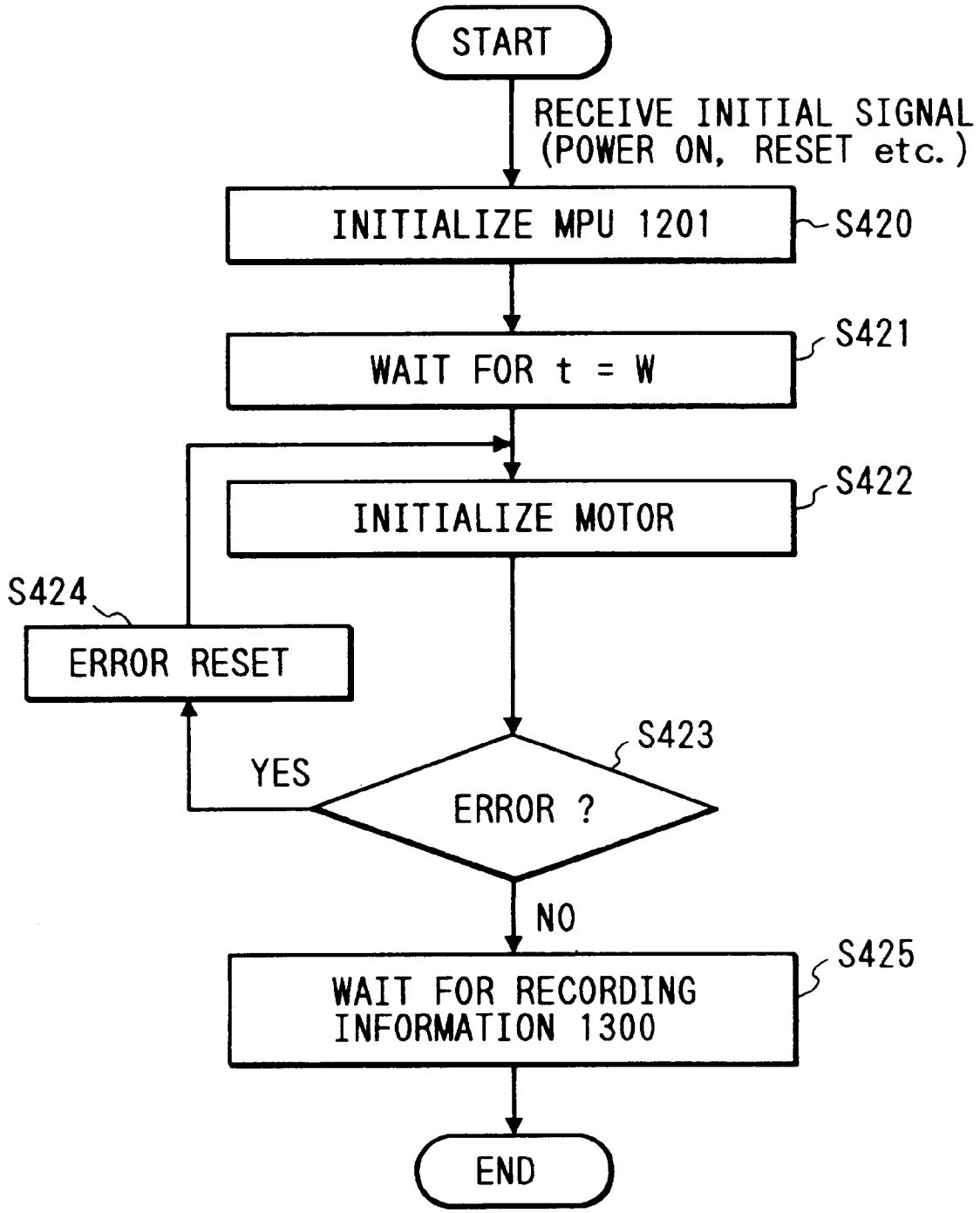
FIG. 48 is a flowchart showing the operation of the embodiment of the present invention.
Figure 49:
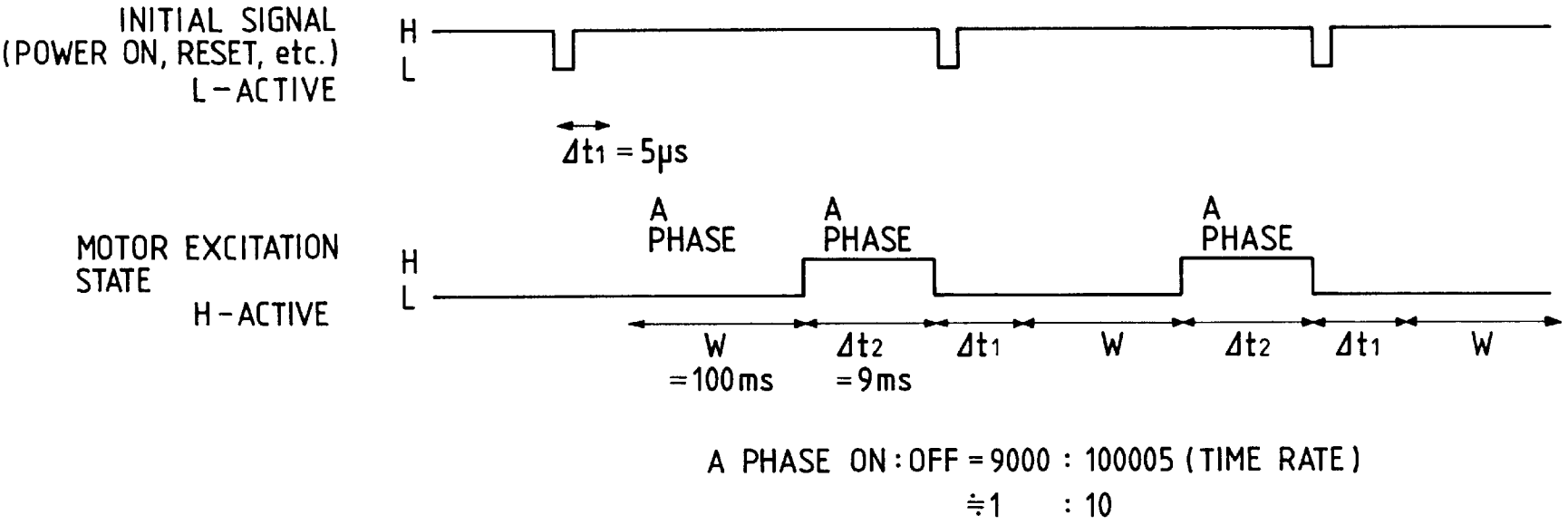
FIG. 49 is a time chart relating to the initial operation of a motor after practice of the present invention.

FIG. 47 is a flowchart showing the initial operation of the recording apparatus when the initial signal is received. If the initial signal is received as shown in the figure, the initial operation relating to the MPU 1201 as indicated at step S401 is performed. The initial operations include an initial operation of each port (S402), an initial operation of the RAM 1204 (S403), an initial operation of each flag (S404), an initial operation of the timer 1202 (S405), and an initial operation of A/D converter (S406). The time $\Delta t_1$ as described represents the time taken for S401, and the time of receiving the initial signal from the host. Thereafter, the operation transfers to step S407, where the initial operation is started. The initial operation of the motor includes setting each of the carrier motor 1208 and the recovery motor 1210 to a respective home position, based on the detected result of each of the carrier home sensor 1215 and the recovery home sensor 1217, as shown at step S408, S409. This operation involves the initial conduction to each predetermined phase, as previously described, including the hold operation. Of course, it is no problem that the initial operation S407 for the motor may be met with either one of S408 and S409. Unless there is an error at step S410, after the end of the operation, the operation is placed in the state of waiting for the reception of recording information 1300, thereby completing the initial operation. In order to resolve the aforementioned problems in the recording apparatus which performs the initial operation as above described, the wait time W is provided, using the timer 1202, based on data within the ROM 1203 from the, operation S401 to the operation S407 (see FIG. 48). The wait time W is determined based on $\Delta t_2$ and $\Delta t_3$ which are known values, but may be permitted as far as the internal temperature is at such degree that the motor will not fume or fire, even if the motor continuously conducts in one phase. FIG. 49 is a time chart regarding the initial operation of the motor, where when such control is applied, the initial signal is continuously sent, as shown in FIG. 45. As shown in the figure, the recording apparatus continuously receives the initial signal to effect the initial operation of the motor, wherein $\Delta t_1$ is lengthened to $\Delta t_1$+W as compared with that of FIG. 45, even if a certain phase is continuously excited. Supposing W=100 ms, the A phase of the motor is excited at a ratio of about 1 to 10 or less, whereby it is possible to prevent the abnormal temperature elevation, the fuming or firing of the motor, even when the initial signal is consecutively issued.

Other Embodiment

While in the above embodiments, among the ink jet recording systems, especially a system of discharging the ink by the use of heat energy has been described, it will be understood that the present invention is not so limited, but can exhibit the excellent effects with a system of discharging the ink by applying a pressure to the ink using electromechanical conversion elements (piezo-electric elements), or a system of obtaining a pressure for discharge by utilizing the resistance in the ink by passing a current through the ink.

The present invention brings about excellent effects particularly in a recording apparatus using a recording head of ink jet system for effecting the recording by forming flying fine ink droplets by the use of heat energy among the various ink jet recording systems.

As to its representative constitution and principle, for example, one practiced by use of the basic principle disclosed in, for example, U.S. Pat. Nos. 4,723,129 and 4,740,796 is preferred. This system is applicable to either of the so-called on-demand type and the continuous type. Particularly, the case of the on-demand type is effective because, by applying at least one driving signal which gives rapid temperature elevation exceeding nucleus boiling corresponding to the recording information on electrothermal conversion elements arranged corresponding to the sheets or liquid channels holding a liquid (ink), heat energy is generated at the electrothermal conversion elements to effect film boiling at the heat acting surface of the recording head, and consequently the bubbles within the liquid (ink) can be formed corresponding one by one to the driving signals. By discharging the liquid (ink) through an opening for discharging by growth and shrinkage of the bubble, at least one droplet is formed. By making the driving signals into the pulse shapes, growth and shrinkage of the bubbles can be effected instantly and adequately to accomplish more preferably discharging of the liquid (ink) particularly excellent in response characteristic. As the driving signals of such pulse shape, those as disclosed in U.S. Pat. Nos. 4,463,359 and 4,345,262 are suitable. Further excellent recording can be performed by employment of the conditions described in U.S. Pat. No. 4,313,124 of the invention concerning the temperature elevation rate of the above-mentioned heat acting surface.

As the constitution of the recording head, in addition to the combination of the discharging orifice, liquid channel, and electrothermal conversion element (linear liquid channel or right-angled liquid channel) as disclosed in the above-mentioned respective specifications, the constitution by use of U.S. Pat. No. 4,558,333 or 4,459,600 disclosing the constitution having the heat acting portion arranged in the flexed region is also included in the present invention. In addition, the present invention can be also effectively made the constitution as disclosed in Japanese Laid Open Patent Application No. 59-123670 which discloses the constitution using a slit common to a plurality of electrothermal conversion elements as the discharging portion of the electrothermal conversion element, or Japanese Laid-Open Patent Application No. 59-138461 which discloses the constitution having the opening for absorbing pressure wave of heat energy correspondent to the discharging portion. That is, with the present invention, the secure and efficient recording can be effected, in whatever form the recording head may be configured.

Further, the present invention is effectively applicable to the recording head of the full line type having a length corresponding to the maximum width of a recording medium which can be recorded by the recording device. As such a recording head, either the constitution which satisfies its length by a combination of a plurality of recording heads or the constitution as one recording head integrally formed may be used.

In addition, among the serial-type recording heads as above described, the present invention is effective for a recording head fixed to the main device, a recording head of the freely exchangeable chip type which enables electrical connection to the main device or supply of ink from the main device by being mounted on the main device, or a recording head of the cartridge type having an ink tank integrally provided on the recording head itself.

Also, addition of a discharge recovery means for the recording head, a preliminary auxiliary means, etc., provided as the constitution of the recording device of the present invention is preferable, because the effect of the present invention can be further stabilized. Specific examples of these may include, for the recording head, capping means, cleaning means, pressurization or suction means electrothermal conversion elements or another type of heating elements, or preliminary heating means according to a combination of these, and preliminary discharge means which performs discharging separate from recording.

As for the types or number of recording heads to be mounted, two or more recording heads corresponding to a plurality of inks having different recording colors or densities, for example, may be provided. That is, as the recording mode of the recording device, the present invention is extremely effective for not only the recording mode only of a primary color such as black, etc., but also a device equipped with at least one of plural different colors or full color by color mixing, where the recording head may be either integrally constituted or combined in plural number.

In addition, though the ink is considered as the liquid in the embodiments as above described, another ink may be also usable which is solid below room temperature and will soften or liquefy at or above room temperature, or liquefy when a recording signal used is issued as it is common with the ink jet device to control the viscosity of ink to be maintained within a certain range of the stable discharge by adjusting the temperature of ink in a range from 30° to 70° C. In addition, in order to avoid the temperature elevation due to heat energy by positively utilizing it as the energy for the change of state from solid to liquid, or to prevent the evaporation of ink, the ink which will stiffen in the shelf state and liquefy by heating may be usable. In any case, the use of the ink having a property of liquefying only with the application of heat energy, such as liquefying with the application of heat energy in accordance with a recording signal so that liquid ink is discharged, or may be already solidifying prior to reaching the recording medium, is also applicable in the present invention. In such a case, the ink may be held as liquid or solid in recesses or through holes of a porous sheet, which is placed opposed to electrothermal conversion element, as described in Japanese Laid-Open Patent Application No. 54-56847 or No. 60-71260. The most effective method for the ink as above described in the present invention is based on the film boiling.

Further, the recording apparatus according to the present invention may be used as an image output terminal in an information processing equipment such as a computer, a copying machine in combination with a reader, or a facsimile terminal equipment having the transmission and reception feature.

As above described, with the present invention, the mounting of a recording head integral with an ink tank or ink supply means such as an ink tank is sensed, and the ink suction operation is performed by the desired number of times subtracted by the number of manually performed ink suction operations, when the demounting is sensed, so that the ink suction operations just enough for the desired number of ink suction operations can be performed. Also, since the desired number of ink suction operations in proper quantities can be achieved, no wasteful ink discharge occurs, and it is possible to prevent the increase in the time required for a series of operations associated with the ink discharge operation, as well as the increase in the running costs, and the shortened life of the waste ink tank or the recording apparatus, so that the proper recording conditions with the recording head can be securely maintained.

Also, in cap means for covering the nozzles of the recording head, negative pressure generating means applies negative pressure at a release position where the cap means release the nozzles, prior to applying negative pressure at a cap position where the cap means covers the nozzles, and negative pressure generating means applies negative pressure to the cap at the release position, prior to the movement of said cap means to the cap position, whereby it is possible to keep the ink unsuitable for the recording making contact with the nozzles of the recording head and their neighborhood to the minimum.

With the present invention, the ink absorption capacity is the wiper cleaner portion can be increased without the increase in the costs, and further the precision at the top end of the wiper cleaner can be enhanced.

A presser plate part which was heretofore necessary for welding the breathable film can be dispensed with so that the costs can be reduced.

The parts such as "cover", "trough" as the flow passage for flowing the waste ink, and "absorbing member" which were heretofore necessary for protecting the electrical components from the leaking waste ink can be dispensed with, so that the costs can be reduced.

The finishing of the seal face for the waste ink seal or waste ink cap can be facilitated, resulting in higher reliability, more yield in molding the parts, and the reduced costs.

Also, the carriage can be silently driven and the capping can be made securely, whereby a reliable ink jet printer without clogging of the nozzles can be provided.

Also, as previously described, when the recording apparatus receives an initial signal from the host, the initial conduction of the motor can be inhibited for a fixed period by providing a sufficient waiting time before the initial operation of the motor, that is, the initial conduction to a predetermined phase, so that when the initial signal is consecutively sent owing to host malfunctions, the abnormal temperature elevation in the motor can be prevented, whereby a recording apparatus of high safety can be provided.

What is claimed is:

1. An ink jet recording apparatus with a recording head having discharge ports for discharging ink and for forming an image on a recording medium by discharging the ink through said discharge ports, comprising:

cap means for covering said discharge ports;

cap moving means for moving said cap means to a cap position where said recording head is opposite said cap means for covering said discharge ports and a release position for releasing said discharge ports;

negative pressure generating means, connecting to said cap means, for applying a negative pressure to said cap means; and control means for causing ink to be removed from said discharge ports of said recording head using said negative pressure generating means, wherein said control means performs operations for causing said negative pressure generating means to generate the negative pressure before an operation for moving said cap means to the cap position by said cap moving means, in succession setting said cap means in a state in which said discharge ports of said recording head are covered by operation of said cap moving means, and in succession causing said negative pressure generating means to remove ink from said discharge ports, by causing said negative pressure generating means to generate the negative pressure.

2. An ink jet recording apparatus according to claim 1, further comprising scanning means which can scan said recording head to a recording area with said recording head and said cap position.

3. An ink jet recording apparatus according to claim 1, wherein said recording head has discharge means for discharging the ink through the discharge ports.

4. An ink jet recording apparatus according to claim 3, wherein said discharge means is heat energy generating means for applying the heat energy to the ink, said recording head causing a state change in the ink with the heat to discharge the ink based on said state change.

5. An ink jet recording apparatus according to claim 3, wherein said control means causes said cap moving means to move said cap means to the cap position after said scanning means moves said recording head to a position opposite said cap means so that said negative pressure generating means generates the negative pressure and said ink is sucked, and wherein said control means causes said negative pressure generating means to generate the negative pressure in a state that said cap means does not cover said discharge port of said recording head between start of the movement of said recording head to the position opposite said cap means and termination of the movement of said cap means by said cap moving means to the cap position.

6. An apparatus according to claim 2, further comprising detecting means capable of detecting that said recording head moves to the position opposite said cap means.

7. An apparatus according to claim 1, further comprising a wiping member for wiping a discharge port surface of said recording head.

8. An apparatus according to claim 7, further comprising:

a scanning means capable of scanning said recording head; and wiping control means for causing said scanning means to move said recording head in a predetermined area including a position opposite said wiping member.

* * * * *

UNITED STATES PATENT AND TRADEMARK OFFICE

CERTIFICATE OF CORRECTION

PATENT NO. : 6,062,670
DATED : May 16, 2000
INVENTOR(S) : Iwata et al

It is certified that error appears in the above-identified patent and that said Letters Patent is hereby corrected as shown below:

Title page:
Under Foreign Patent Documents (second page) :
"2072962" should read -- 2 — 072962 --;
"3022113" should read -- 3 — 022113 --; and
"4099680" should read -- 4 — 099680 --.

Signed and Sealed this

Ninth Day of October, 2001

*Attest:*

Nicholas P. Godici

*Attesting Officer*

NICHOLAS P. GODICI
*Acting Director of the United States Patent and Trademark Office*